US006919865B2

(12) United States Patent
Tamaru

(10) Patent No.: US 6,919,865 B2
(45) Date of Patent: Jul. 19, 2005

(54) DISPLAY DEVICE FOR WORK MACHINE

(75) Inventor: Masatake Tamaru, Ishikawa (JP)

(73) Assignee: Komatsu Ltd., Tokyo (JP)

( * ) Notice: Subject to any disclaimer, the term of this patent is extended or adjusted under 35 U.S.C. 154(b) by 122 days.

(21) Appl. No.: 09/973,763

(22) Filed: Oct. 11, 2001

(65) Prior Publication Data

US 2002/0045986 A1 Apr. 18, 2002

(30) Foreign Application Priority Data

Oct. 12, 2000 (JP) ..... 2000-312275
Apr. 26, 2001 (JP) ..... 2001-129951

(51) Int. Cl.[7] ..... G09G 5/00
(52) U.S. Cl. ..... 345/2.1; 345/204; 701/1; 701/207; 340/463
(58) Field of Search ..... 345/156, 2.1, 204, 345/716; 701/1, 50, 202, 207, 120; 340/463

(56) References Cited

U.S. PATENT DOCUMENTS 4,845,629 A * 7/1989 Murga ..... 701/120
6,041,657 A * 3/2000 Sutherland ..... 73/646
6,411,205 B1 * 6/2002 Reid ..... 340/468
6,522,342 B1 * 2/2003 Gagnon et al. ..... 345/716
6,529,804 B1 * 3/2003 Draggon et al. ..... 701/1
6,564,143 B1 * 5/2003 Alewine et al. ..... 701/207
6,643,582 B2 * 11/2003 Adachi et al. ..... 701/207
2001/0044693 A1 * 11/2001 Gotou et al. ..... 701/202

* cited by examiner

*Primary Examiner*—Alexander Eisen
*Assistant Examiner*—Kimnhung Nguyen
(74) *Attorney, Agent, or Firm*—Varndell & Varndell, PLLC

(57) ABSTRACT

A display device for displaying information toward outside of a work machine is installed in the work machine.

8 Claims, 50 Drawing Sheets

(A) OF FIG.2
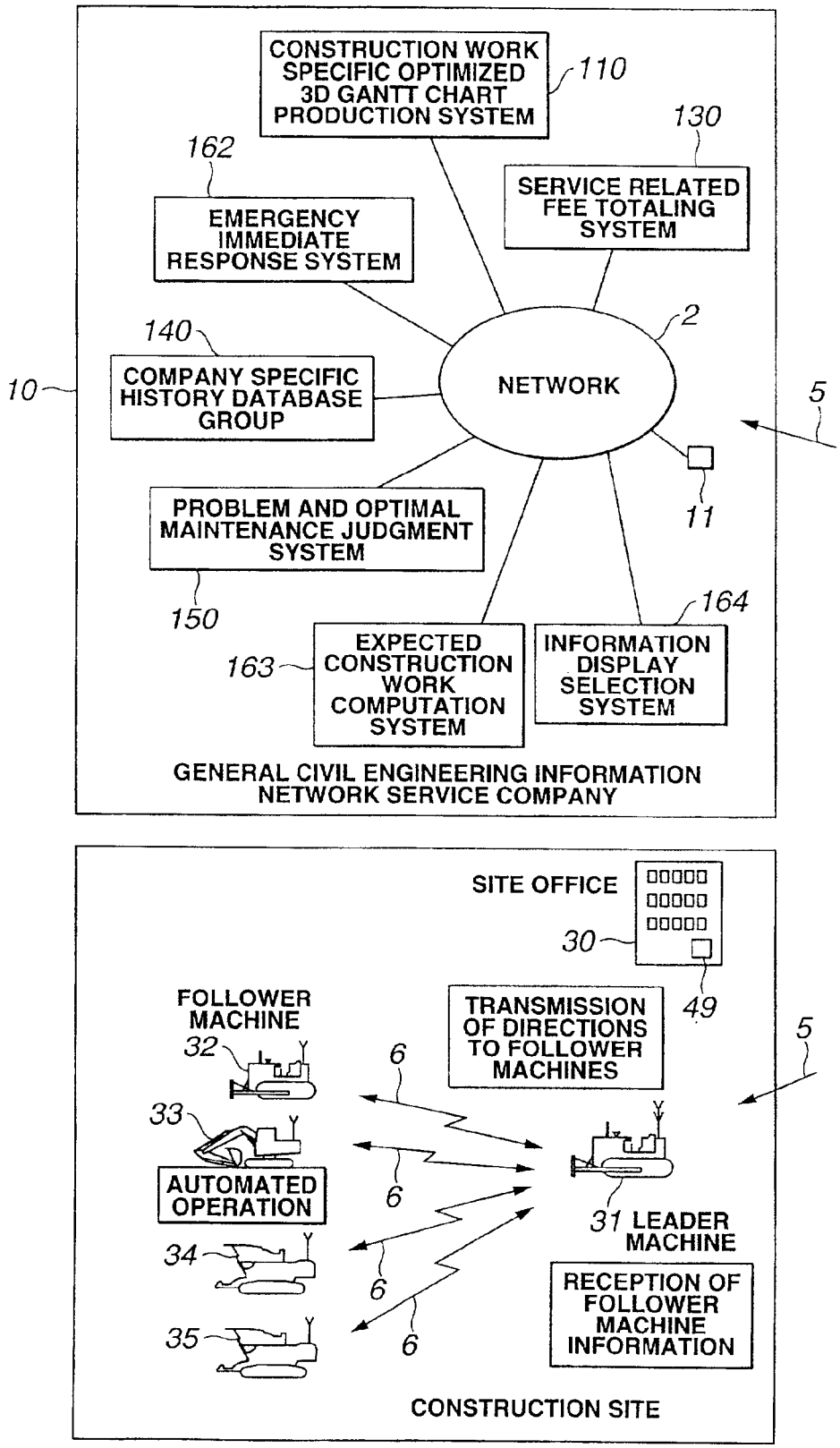

(B) OF FIG.2
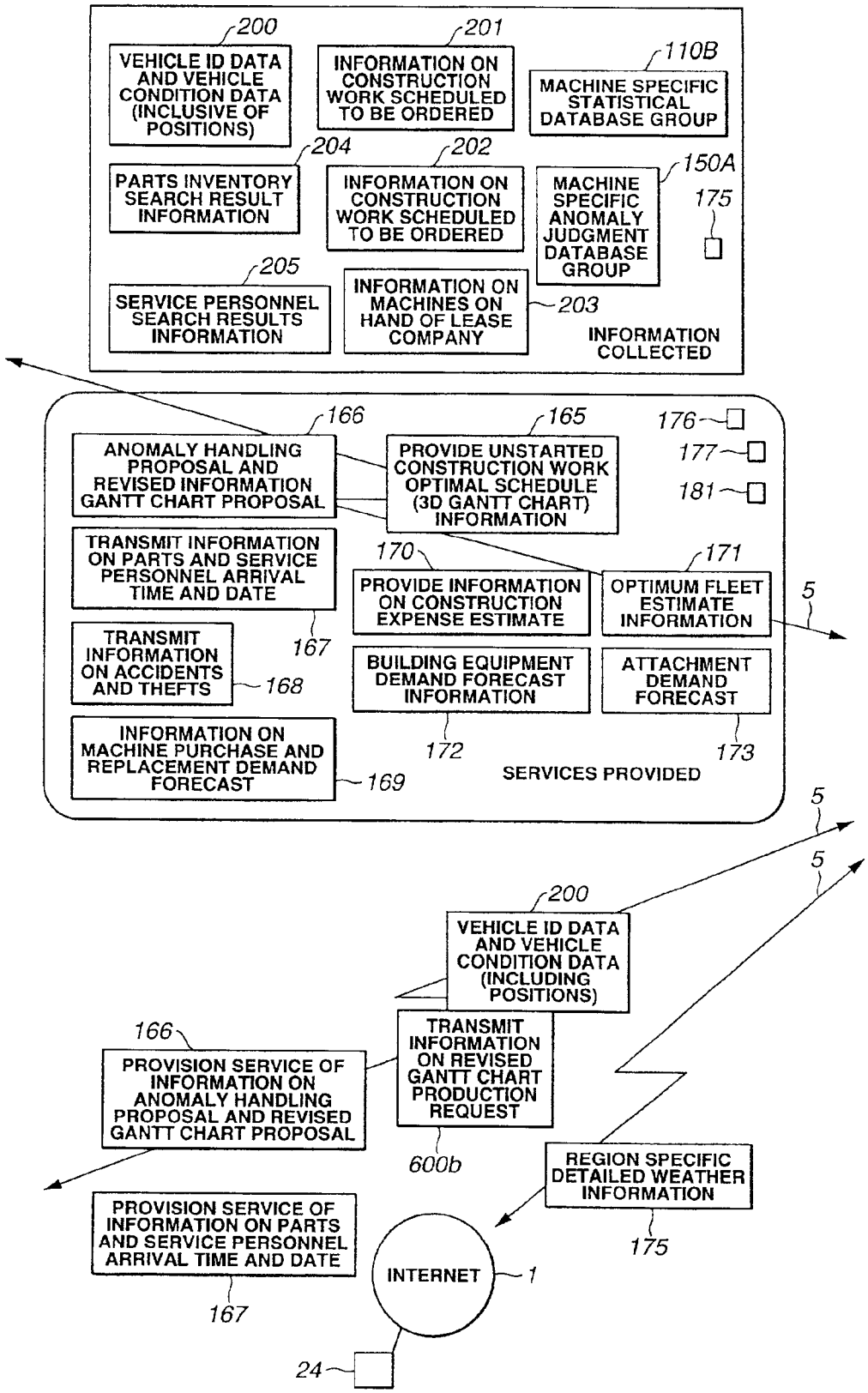

(C) OF FIG.2
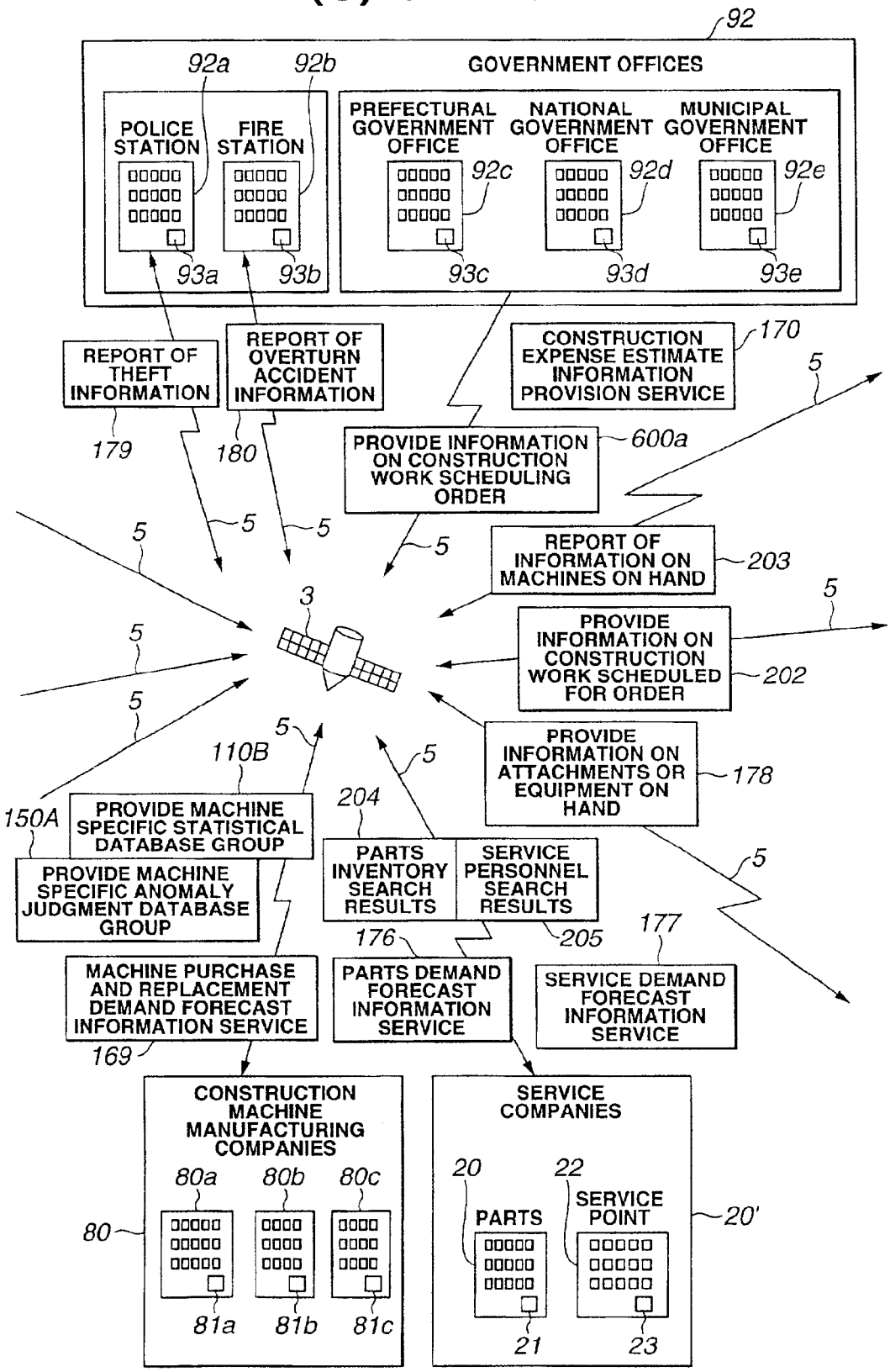

(D) OF FIG.2
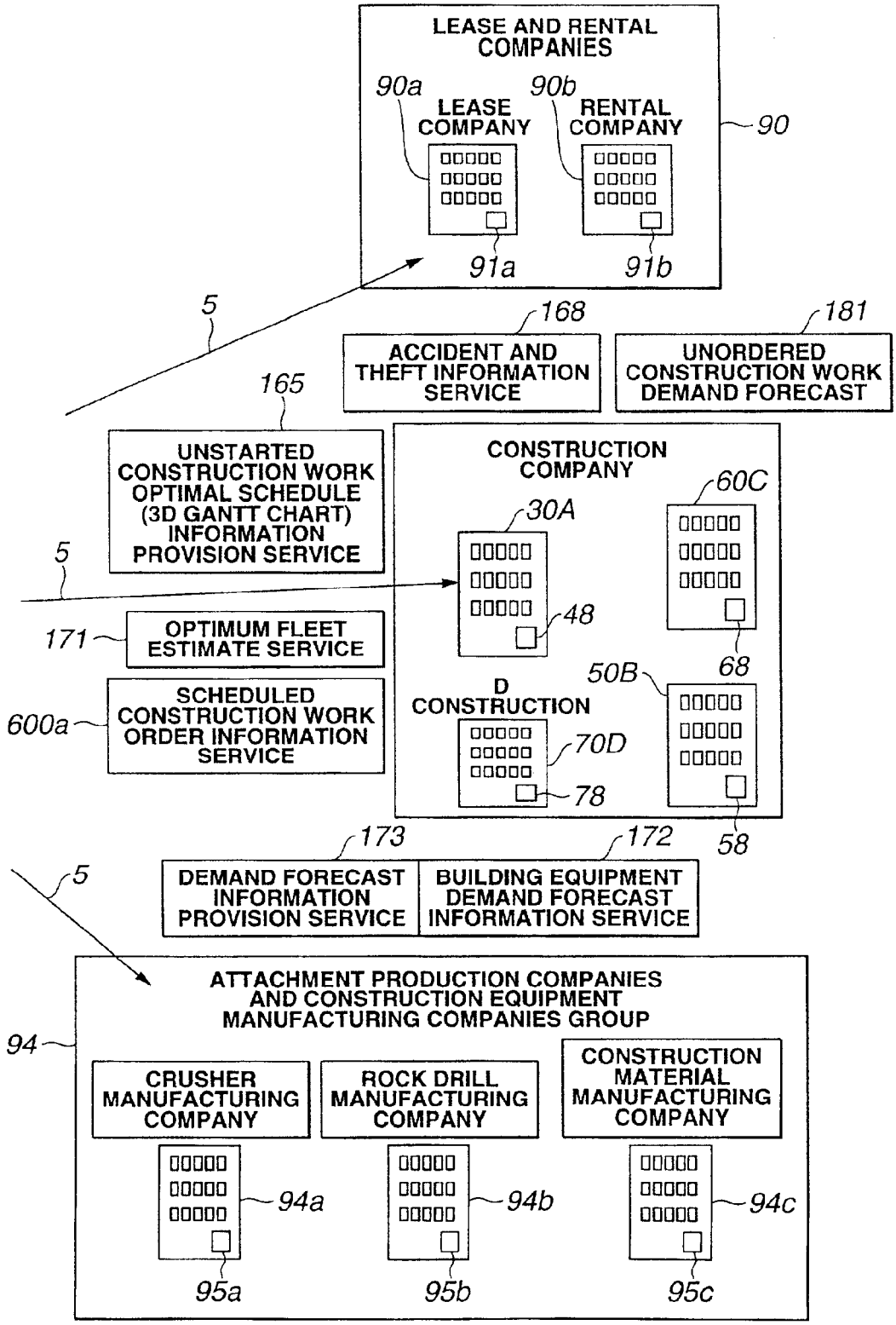

(A) OF FIG.3
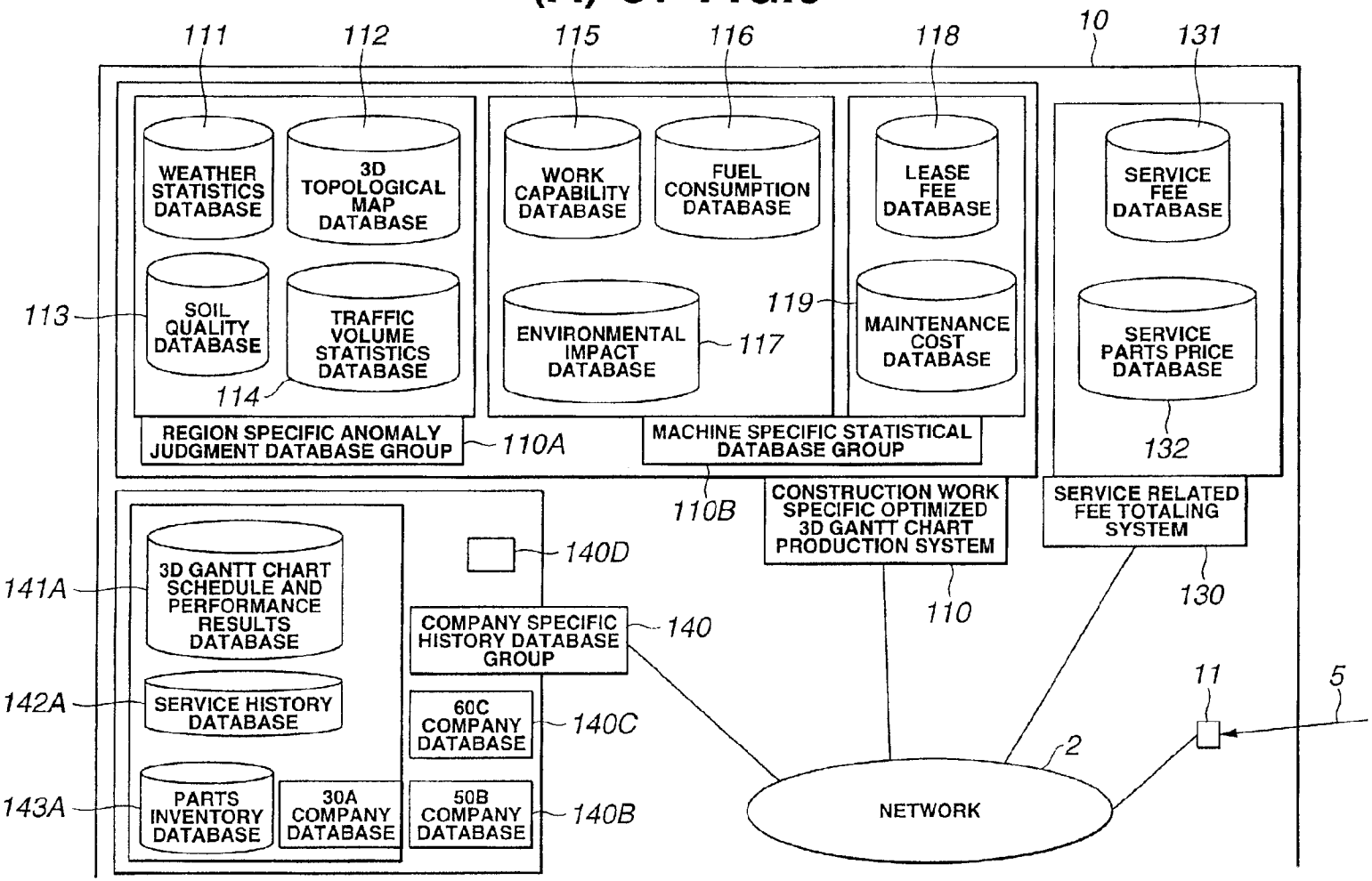

(B) OF FIG.3
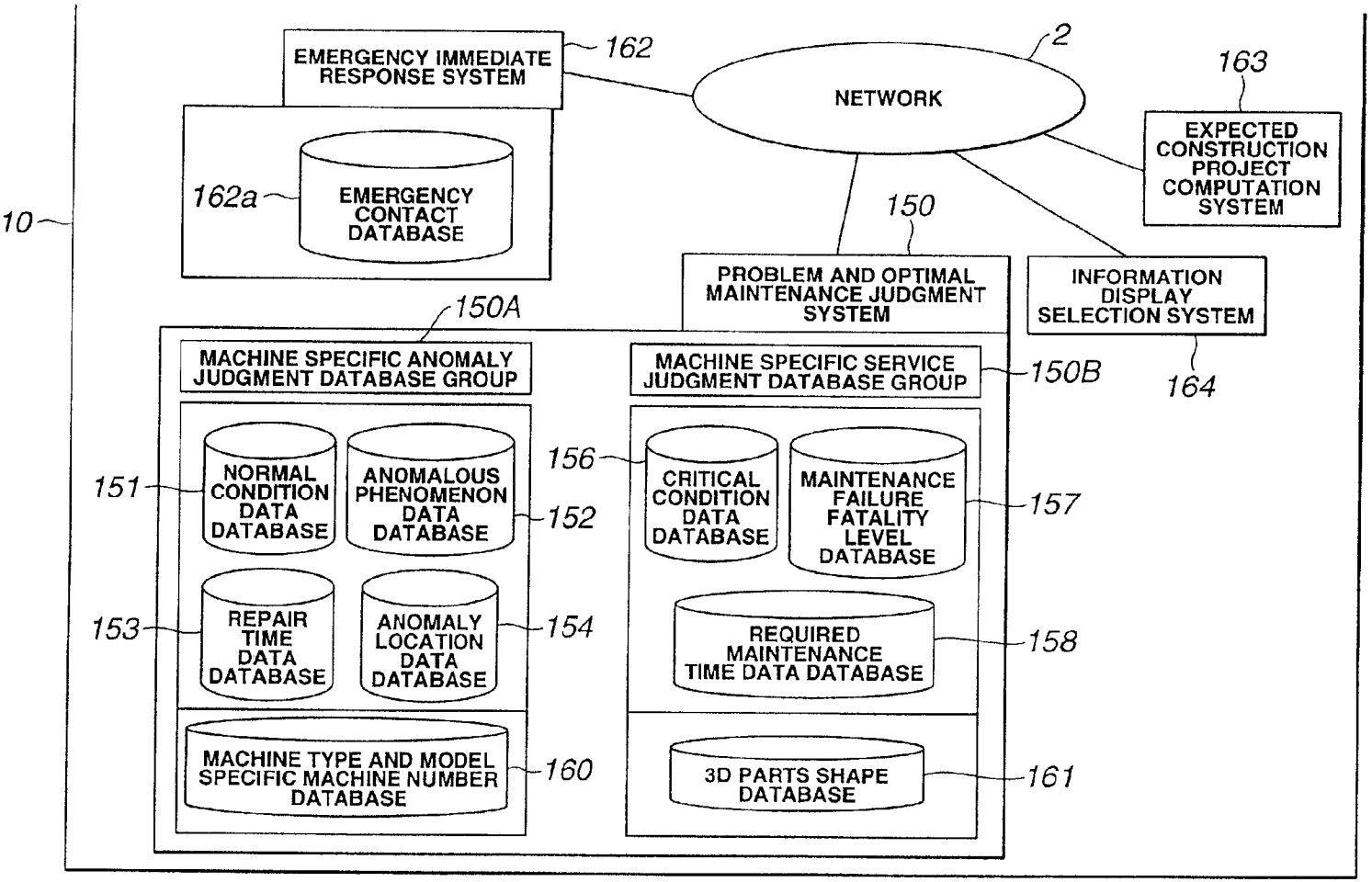

(C) OF FIG.3
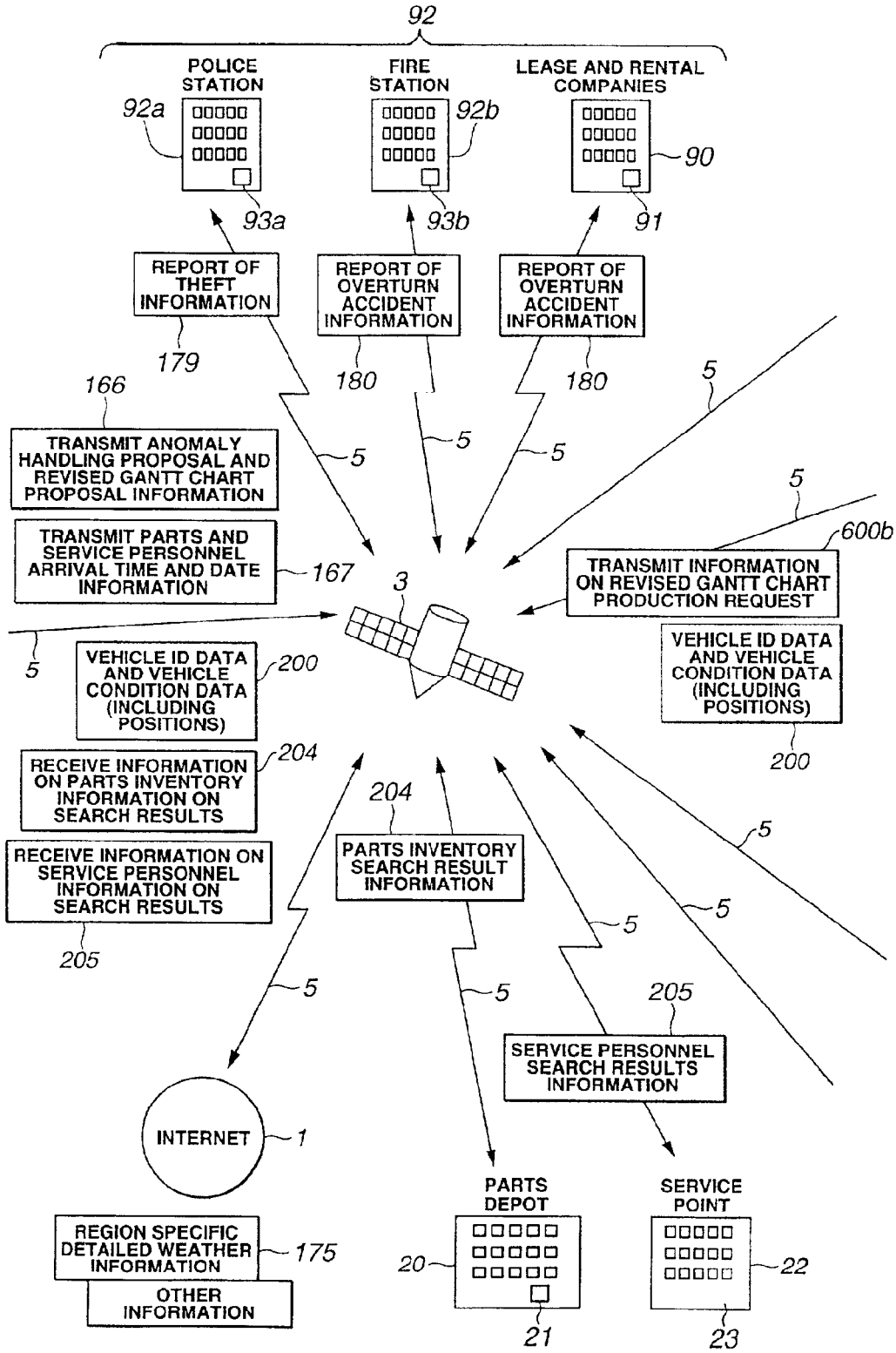

(D) OF FIG.3
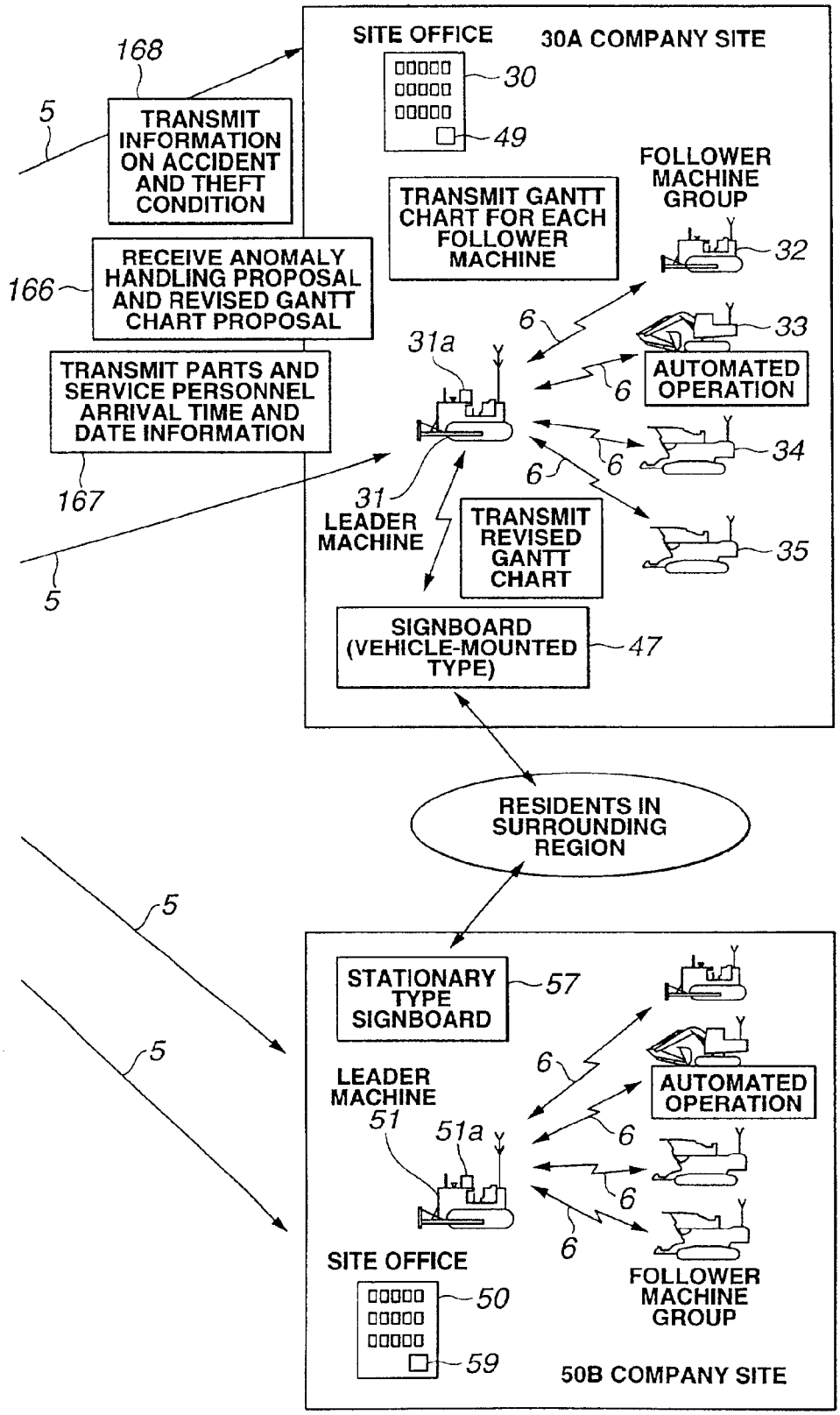

(A) OF FIG.5
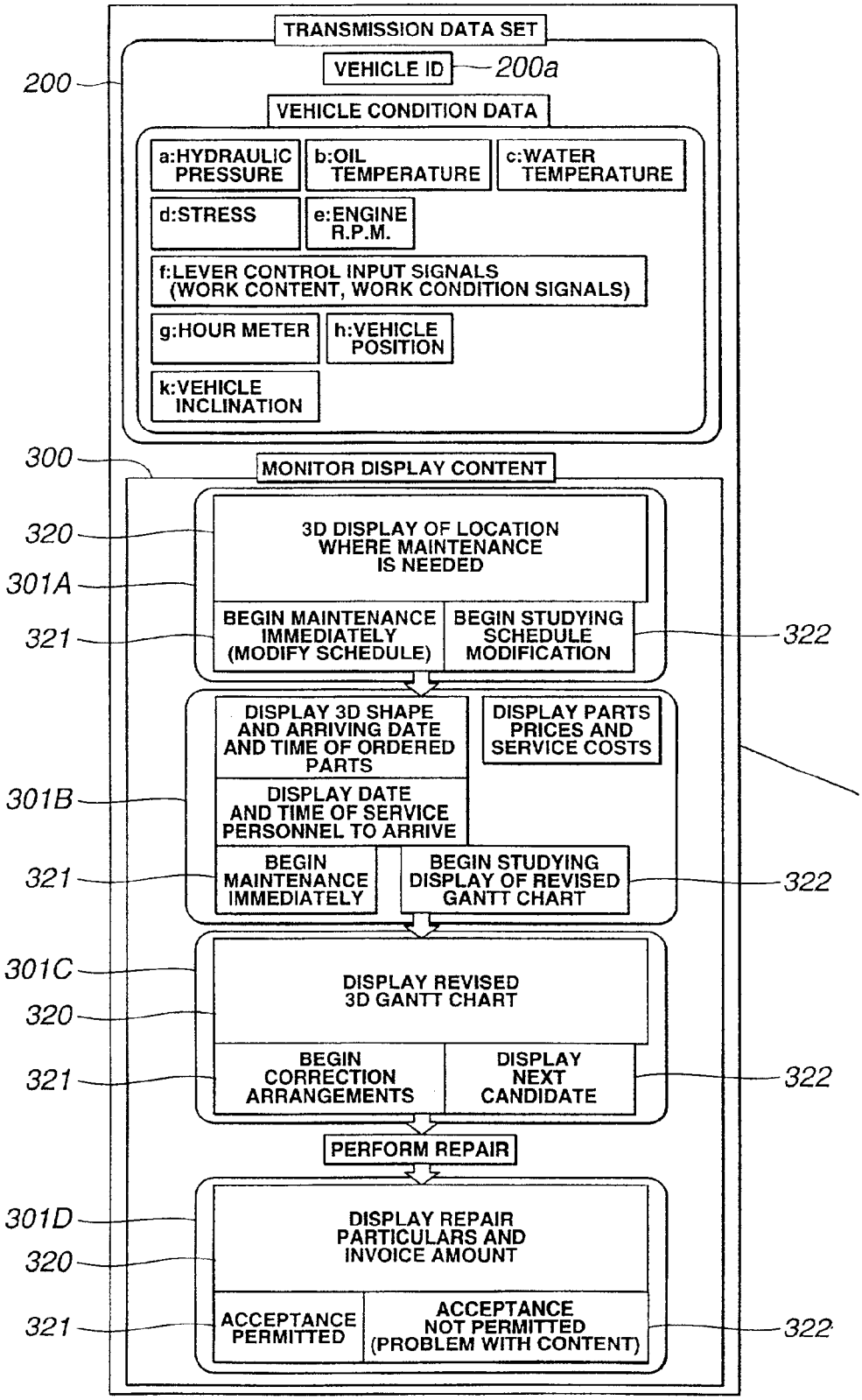

(B) OF FIG.5
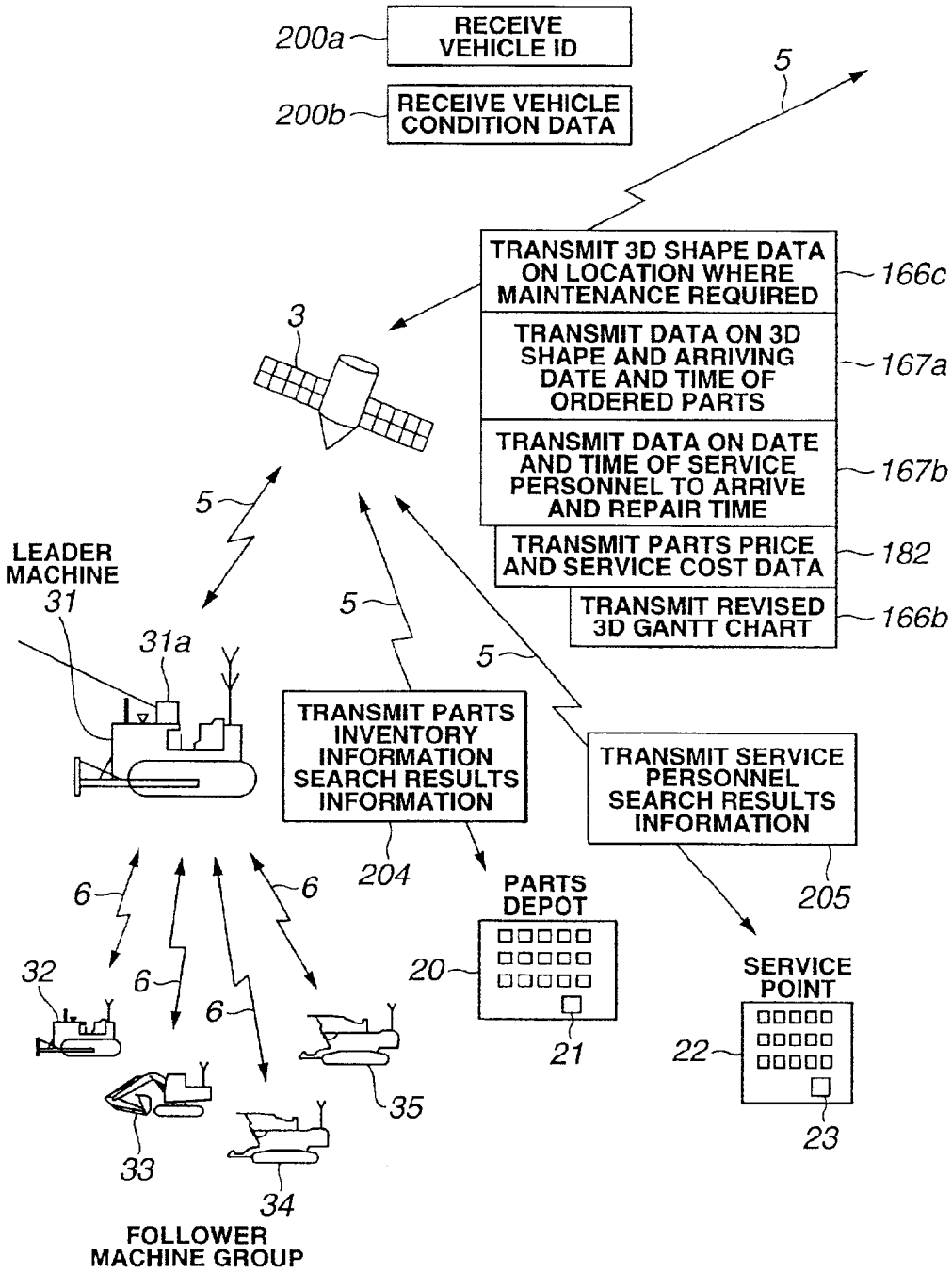

(C) OF FIG.5
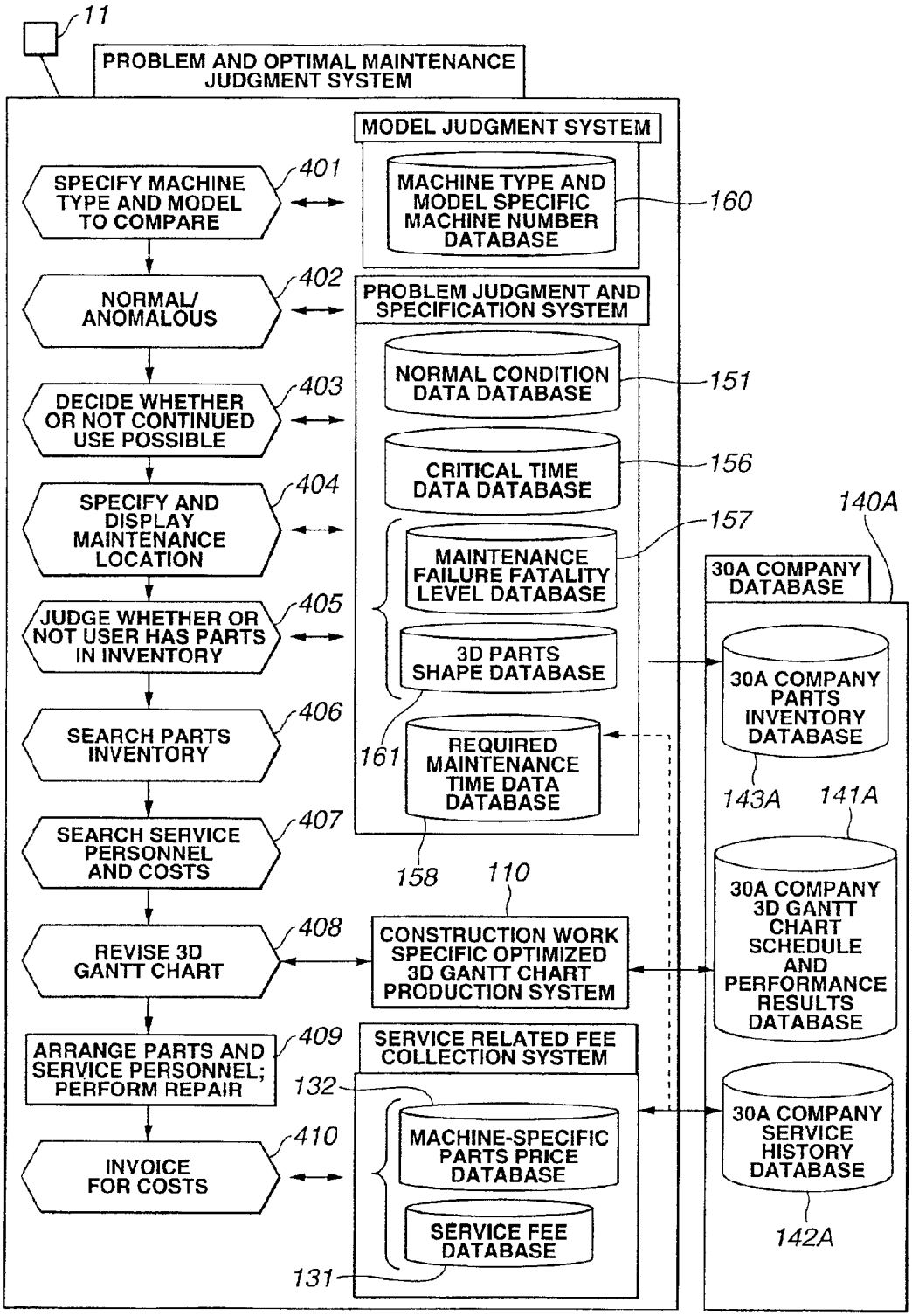

(A) OF FIG.6
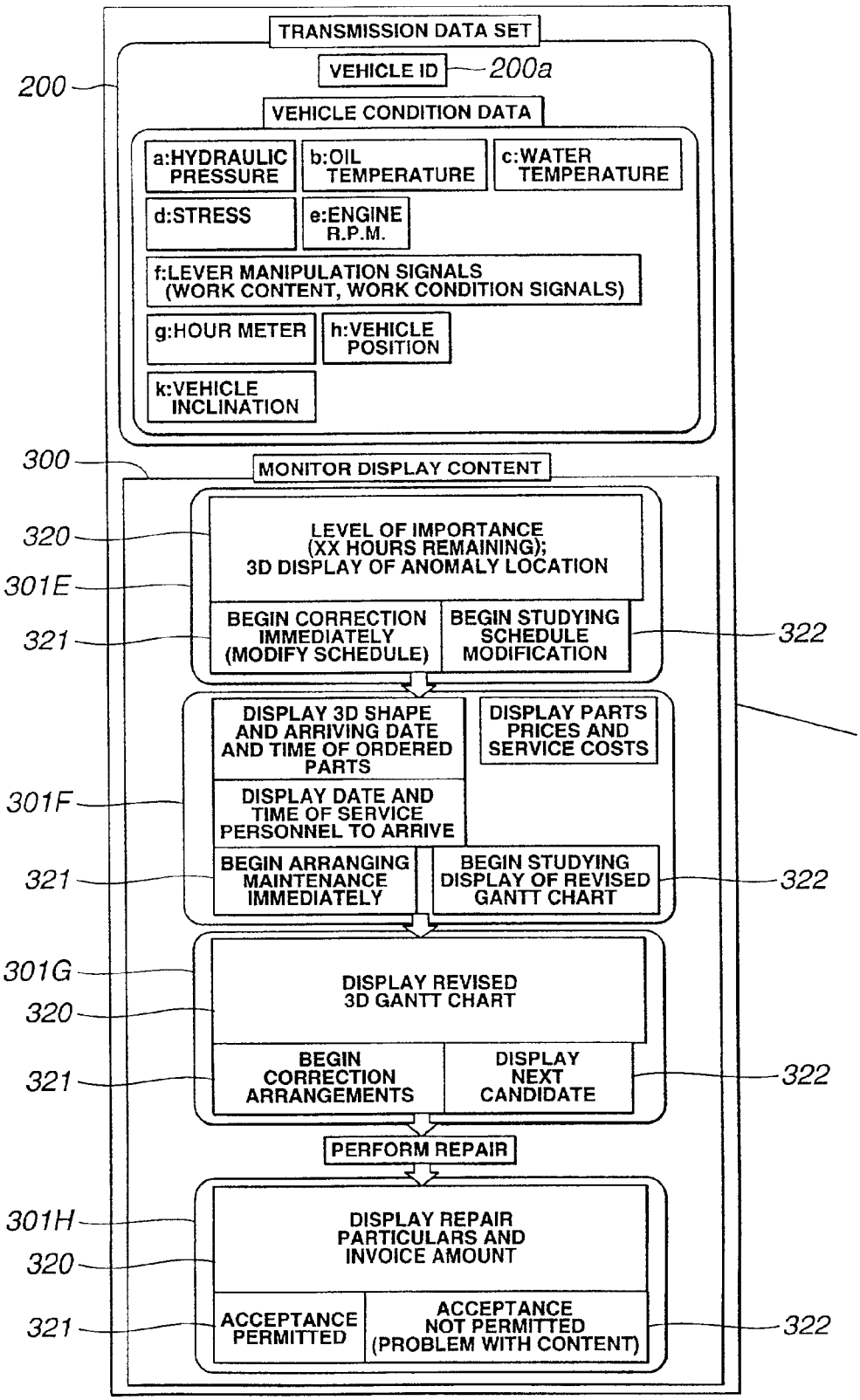

(B) OF FIG.6
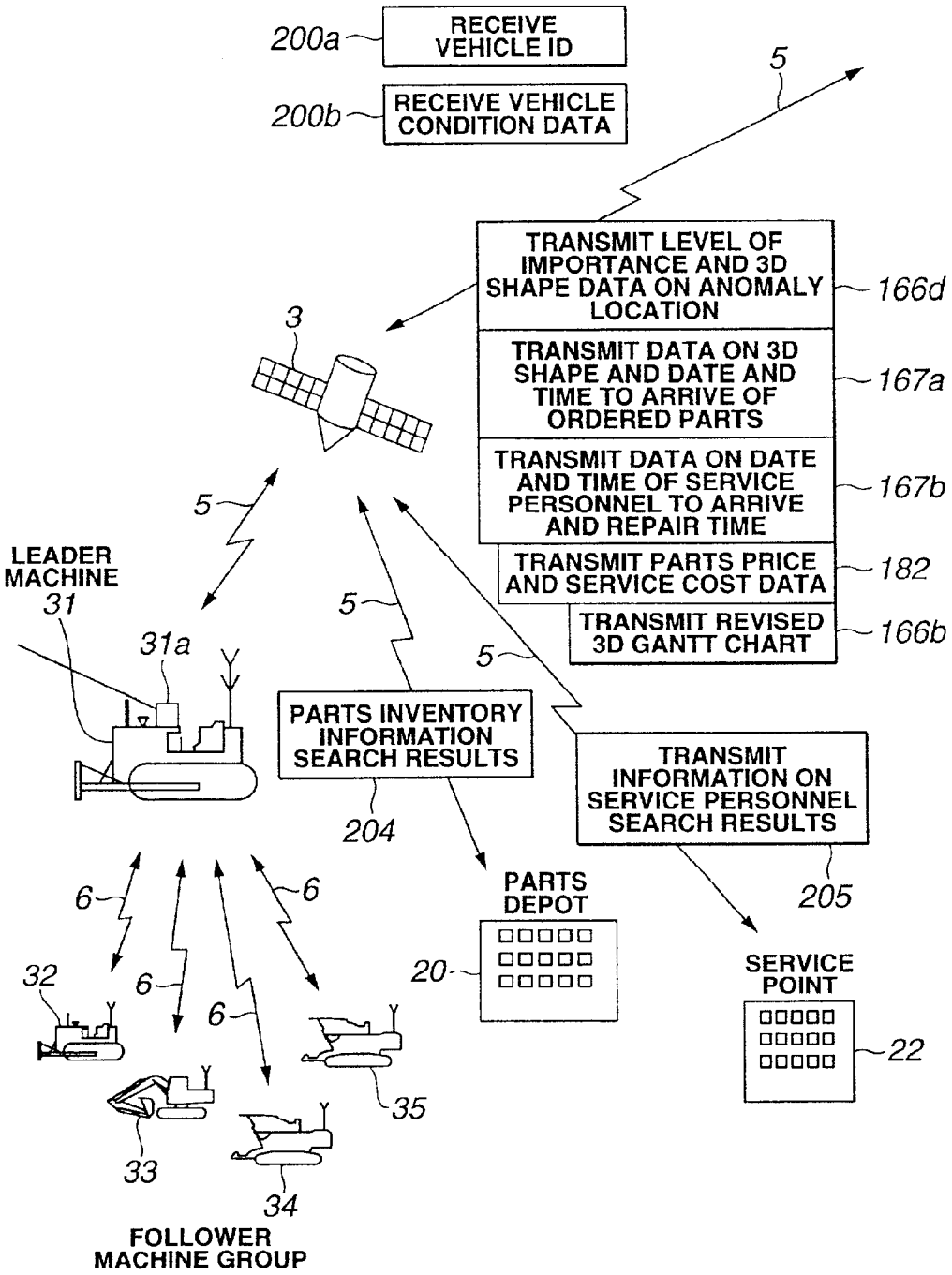

(C) OF FIG.6
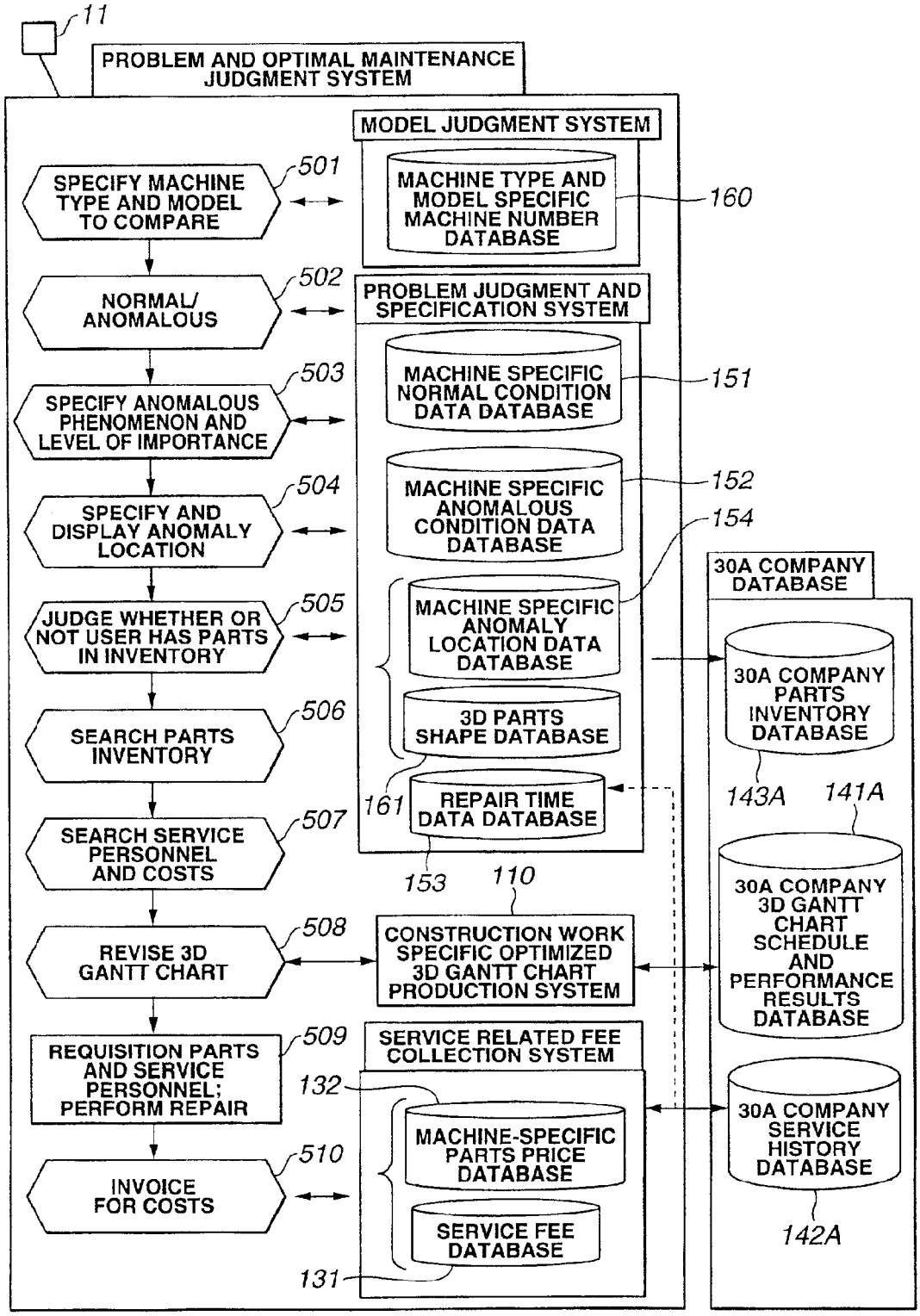

(A) OF FIG.7
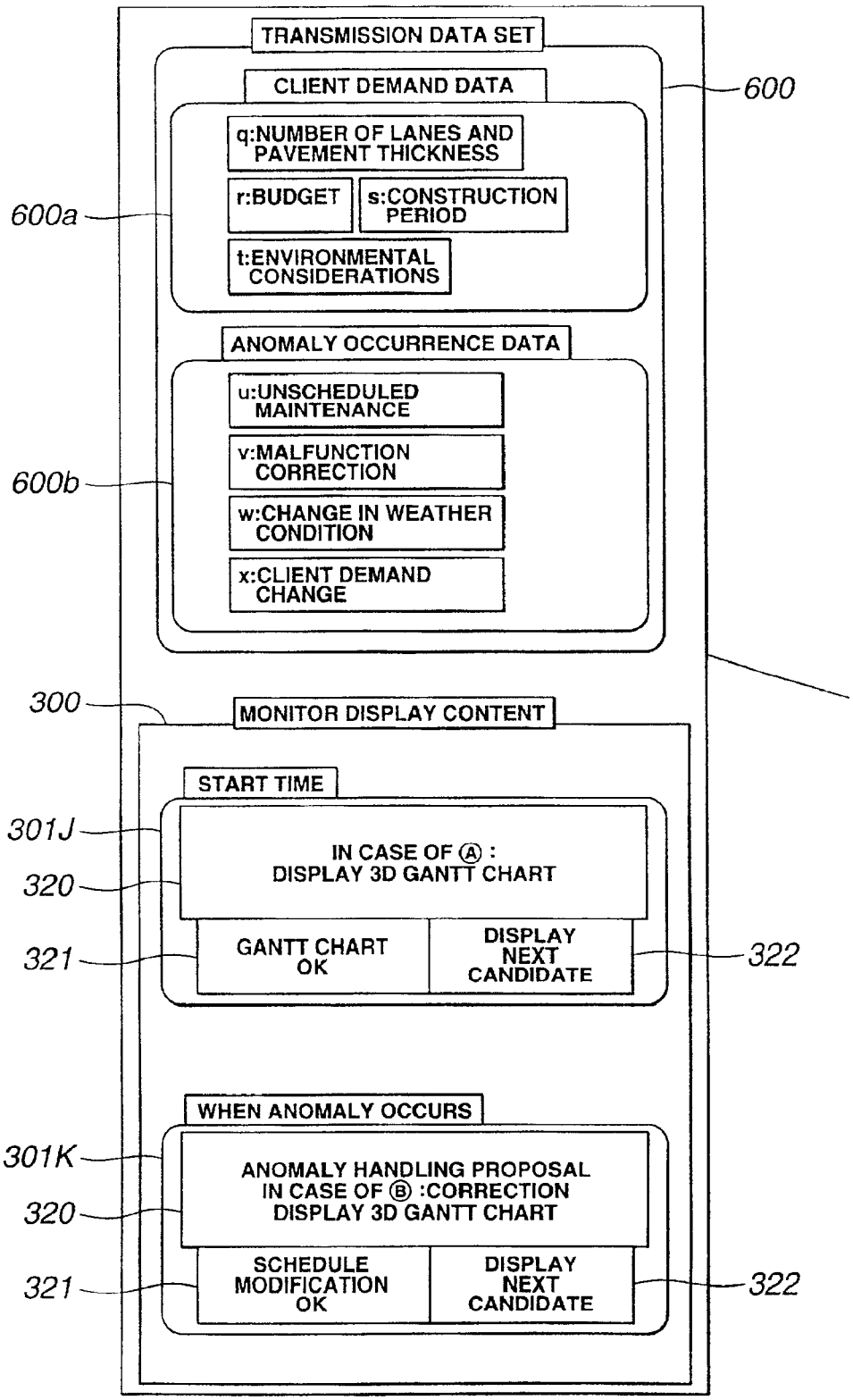

(B) OF FIG.7
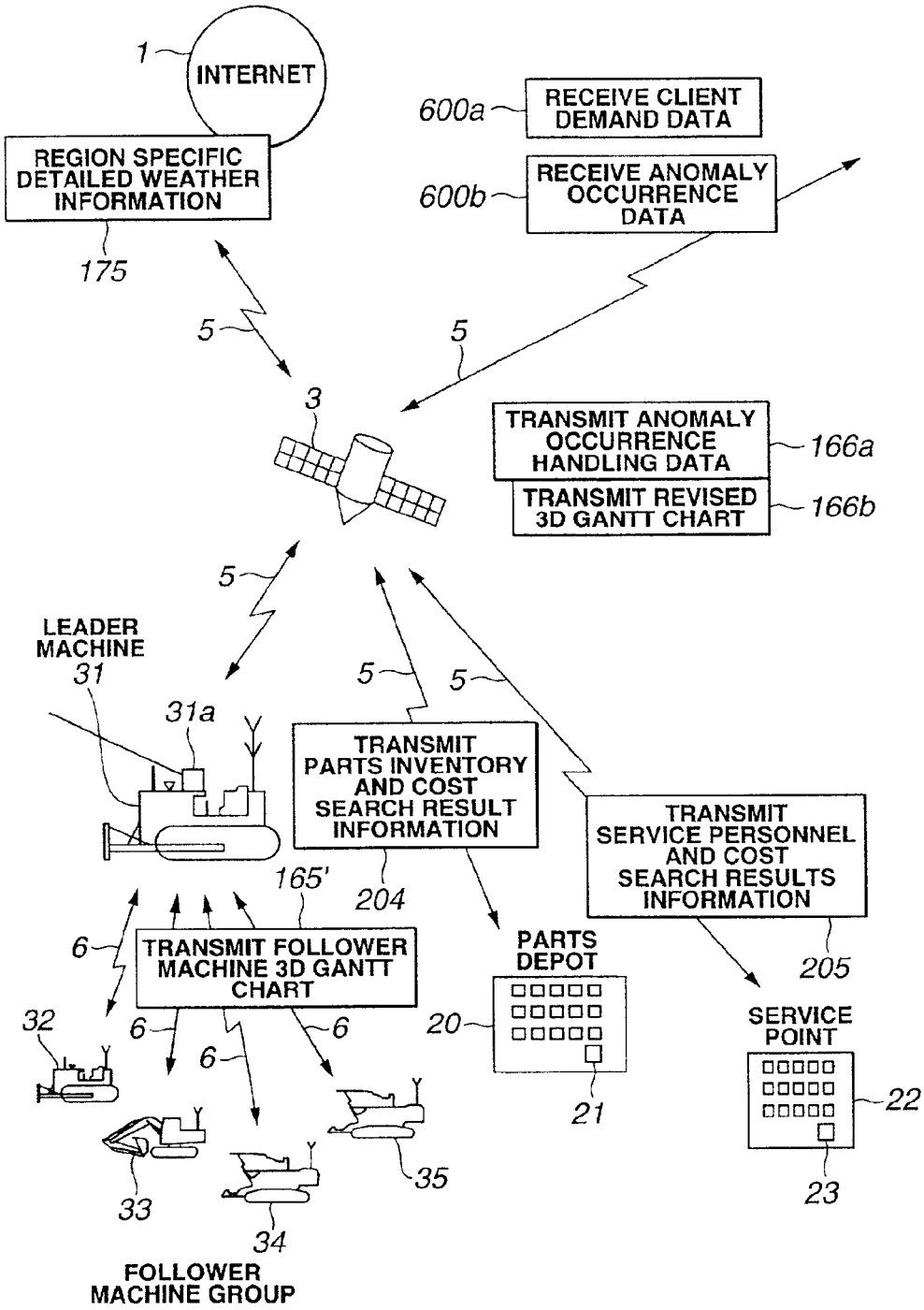

(C) OF FIG.7
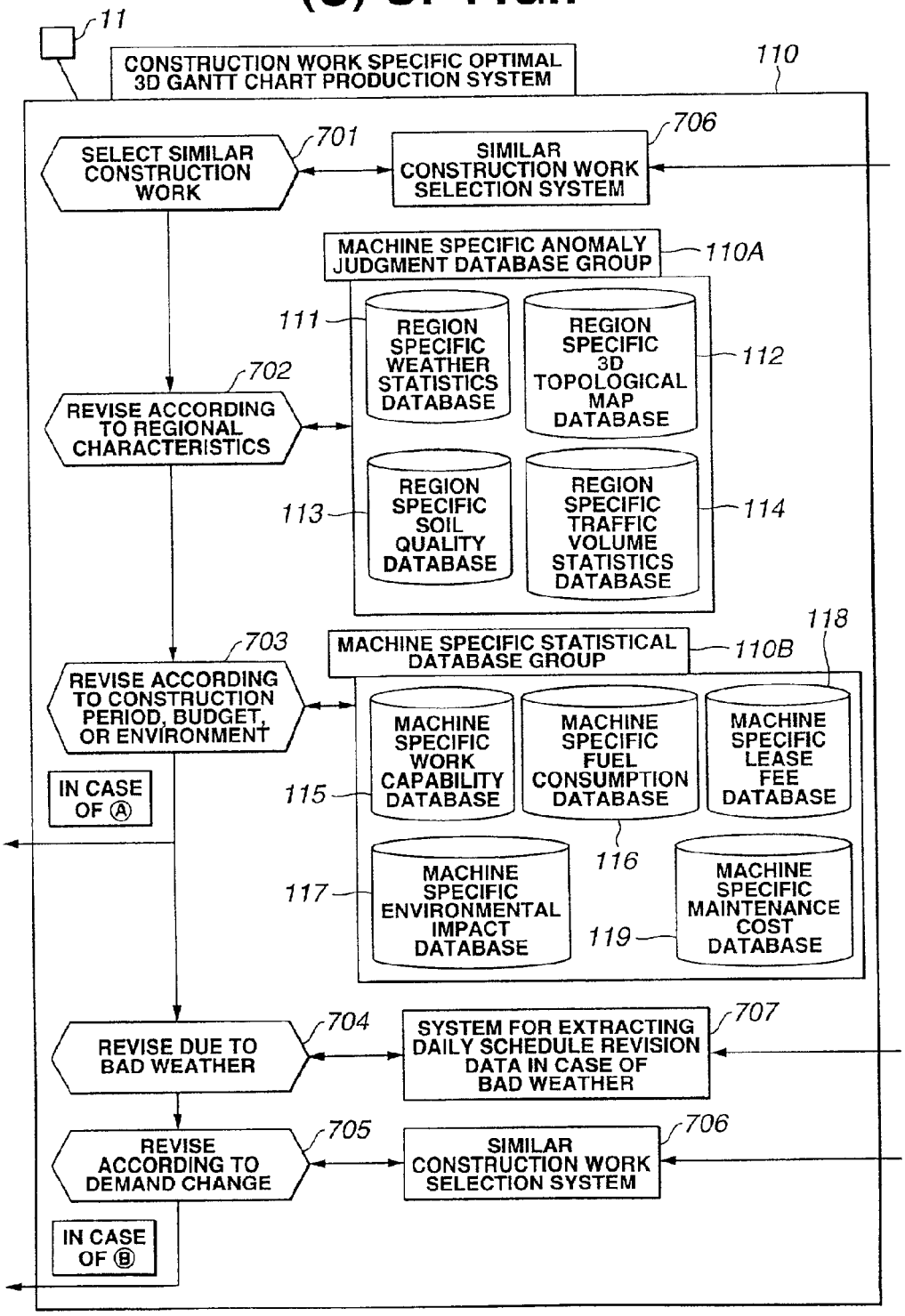

(D) OF FIG.7
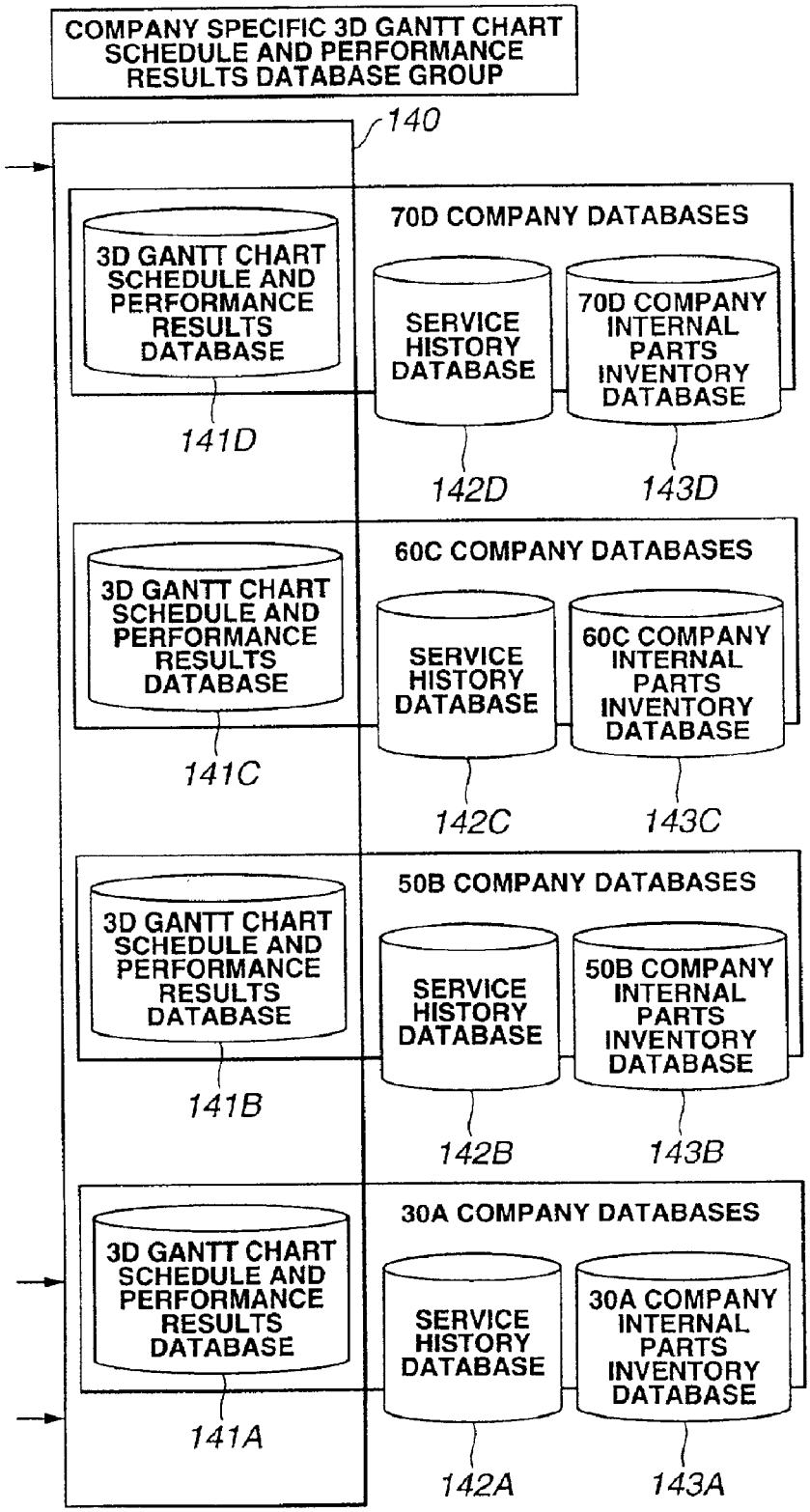

(A) OF FIG.8
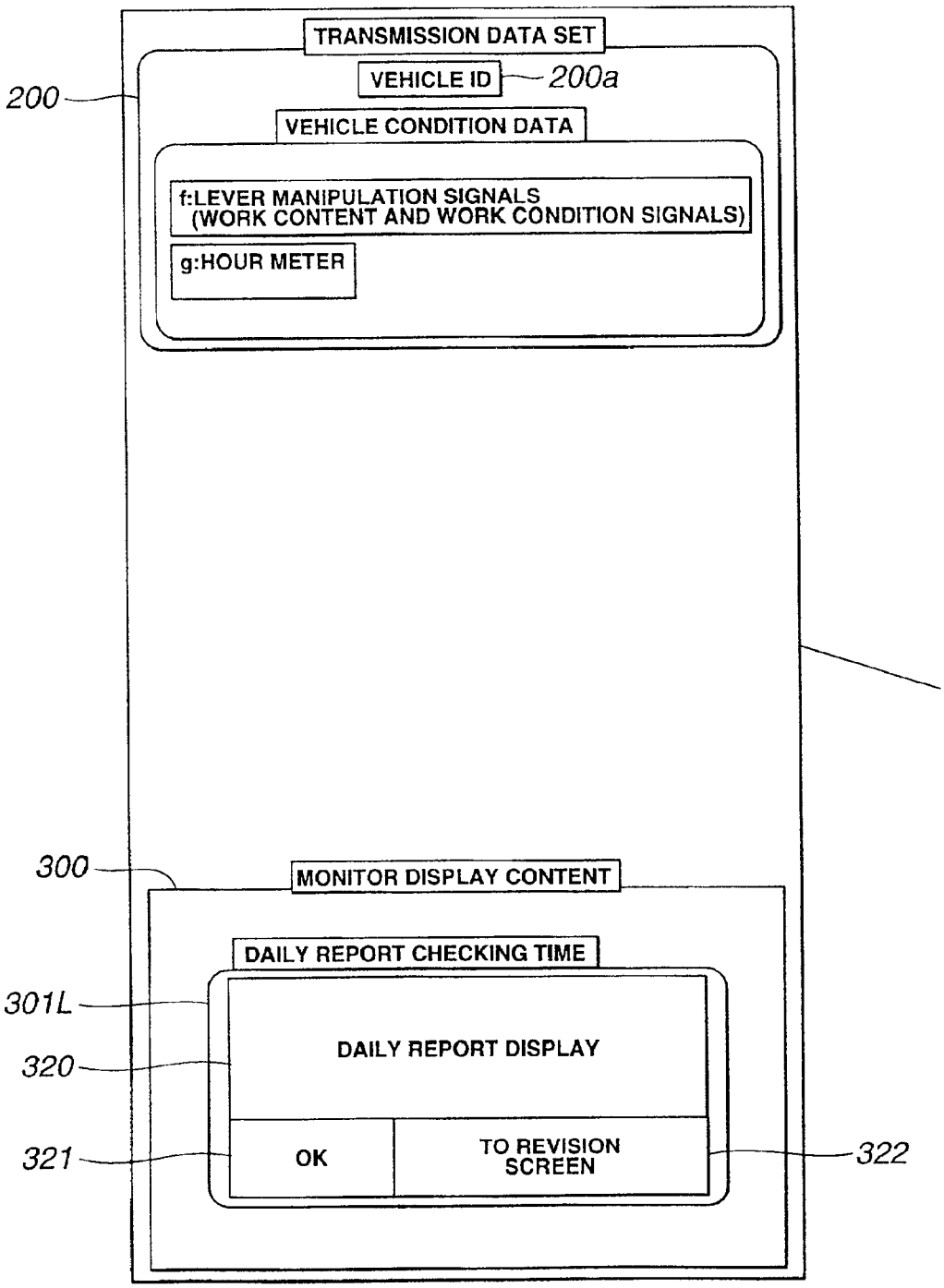

(B) OF FIG.8
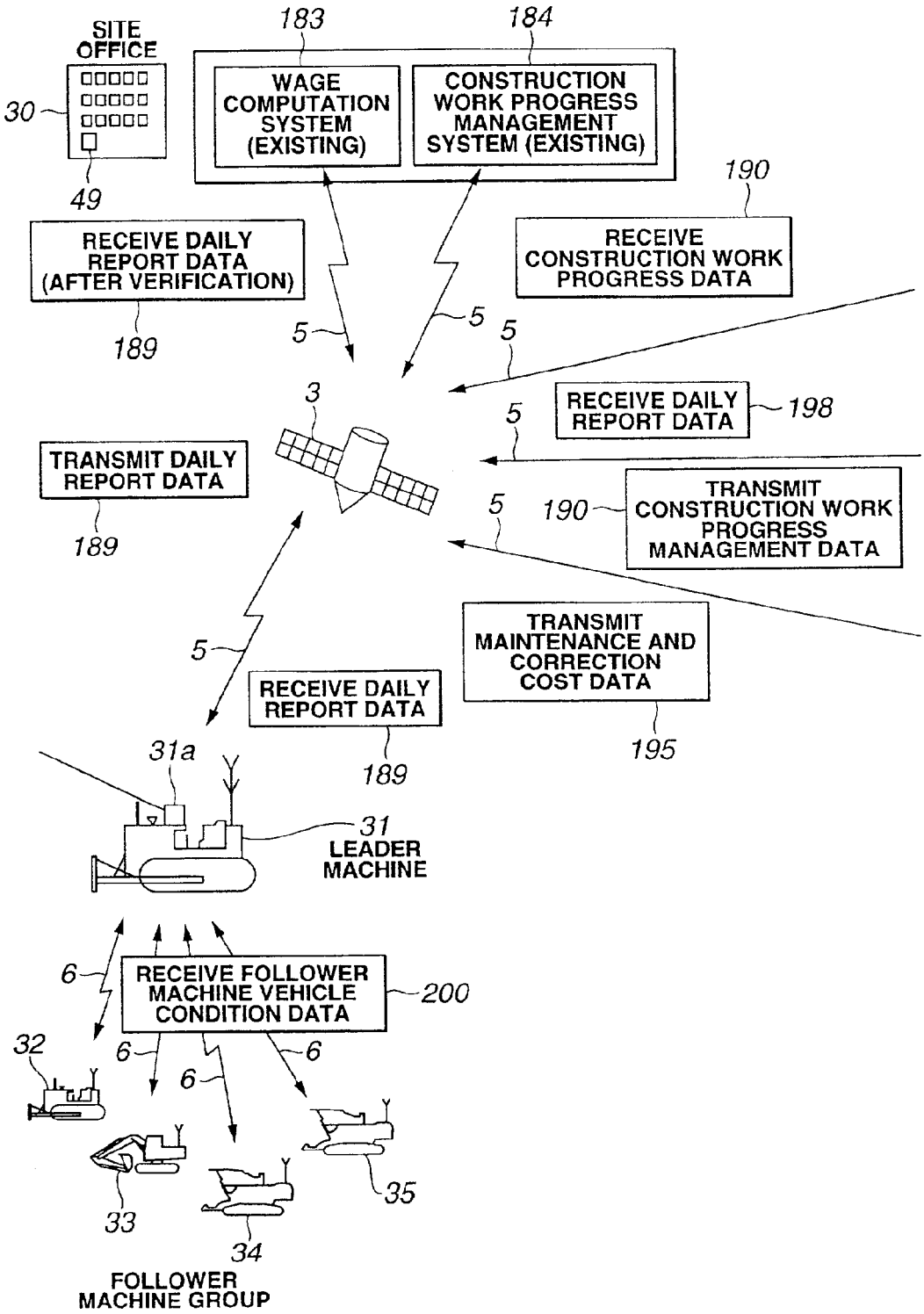

(C) OF FIG.8
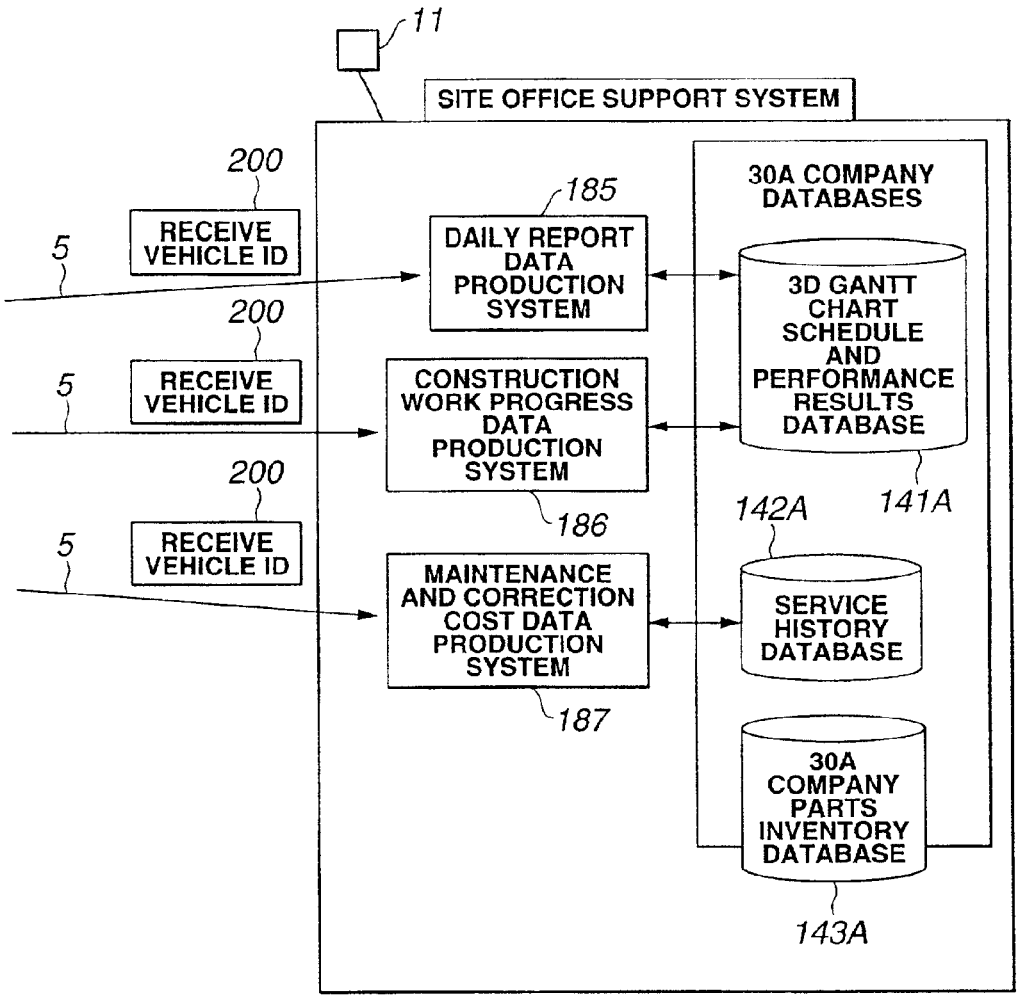

(A) OF FIG.9
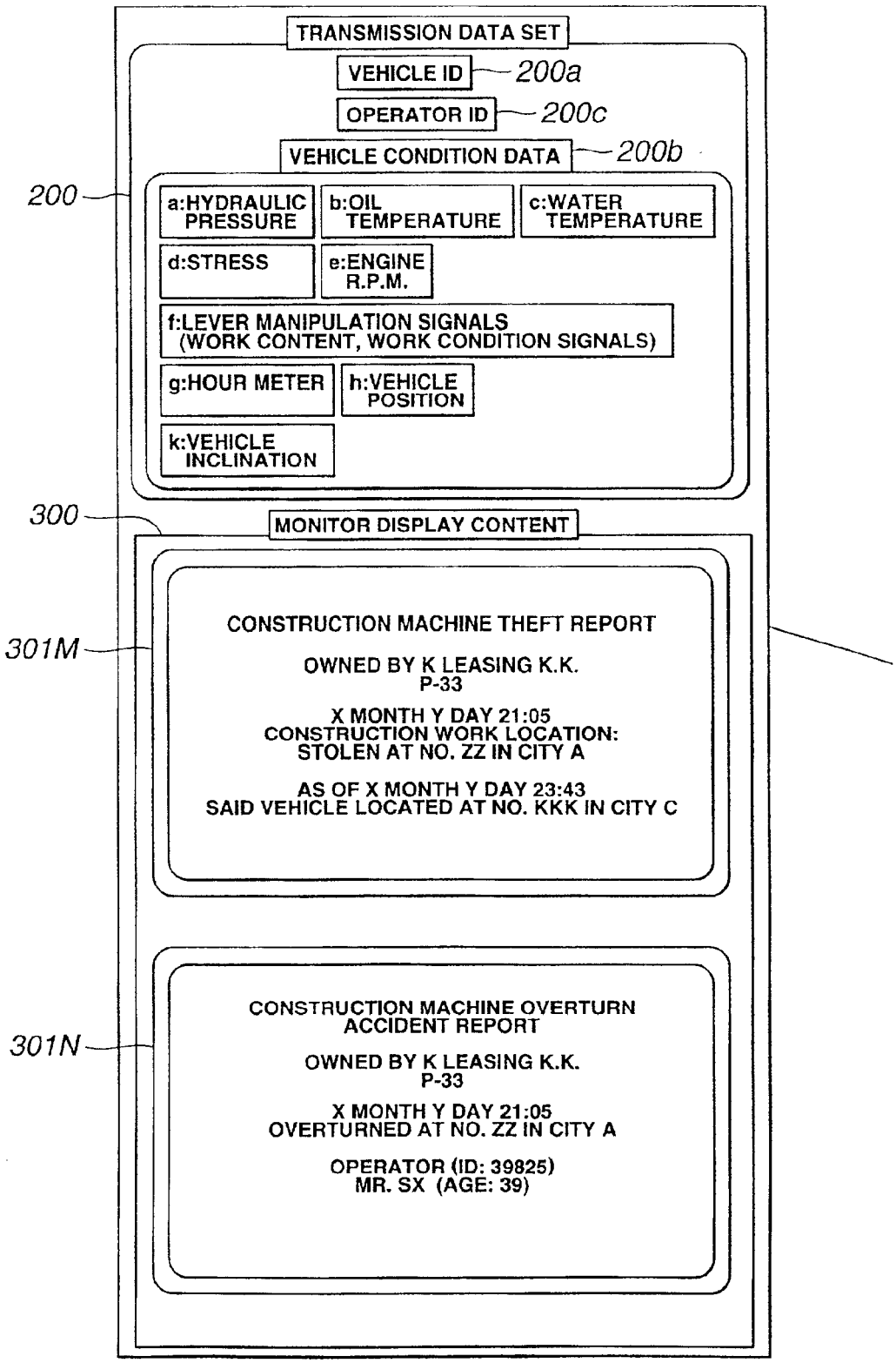

(B) OF FIG.9
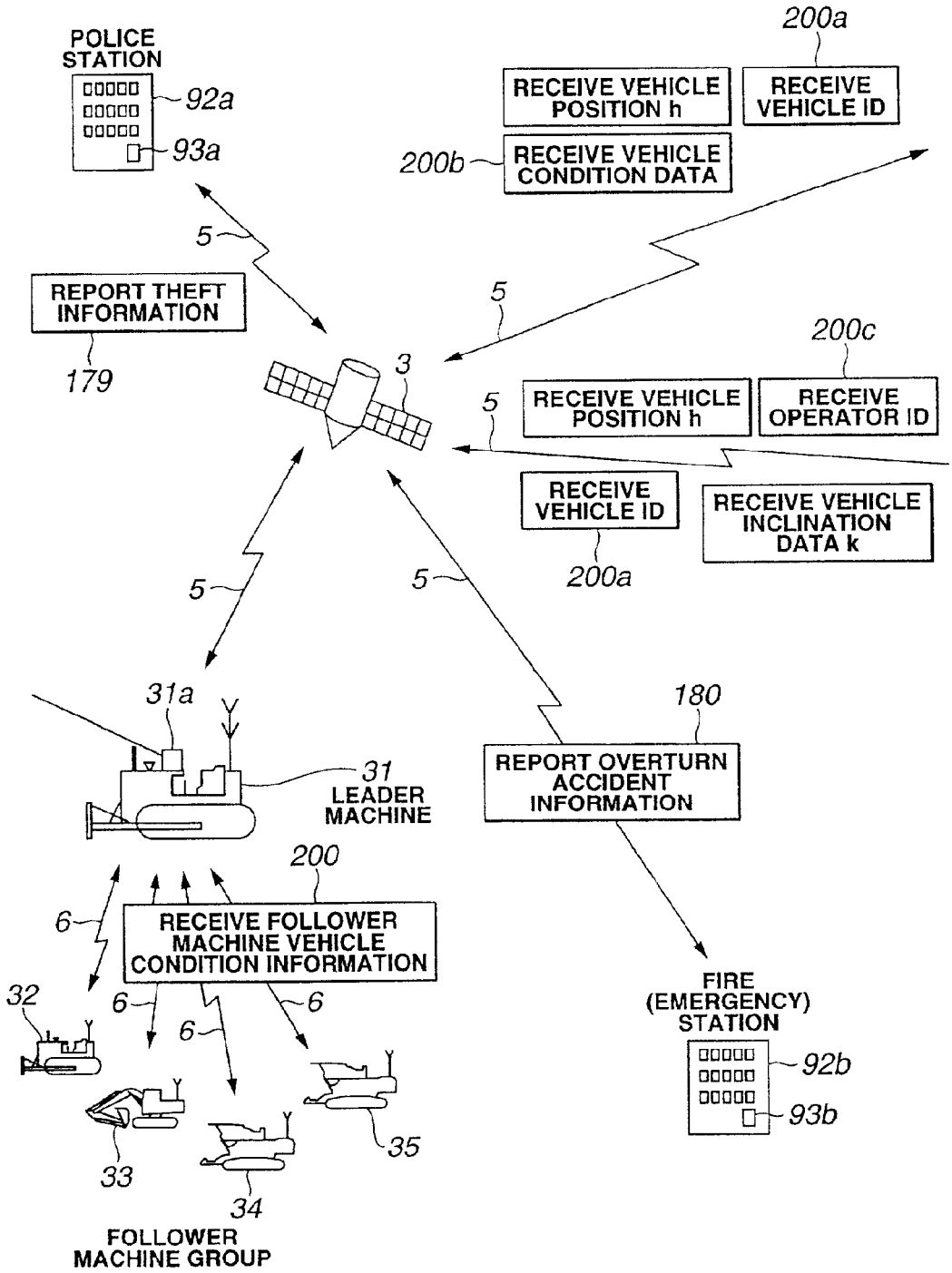

(C) OF FIG.9
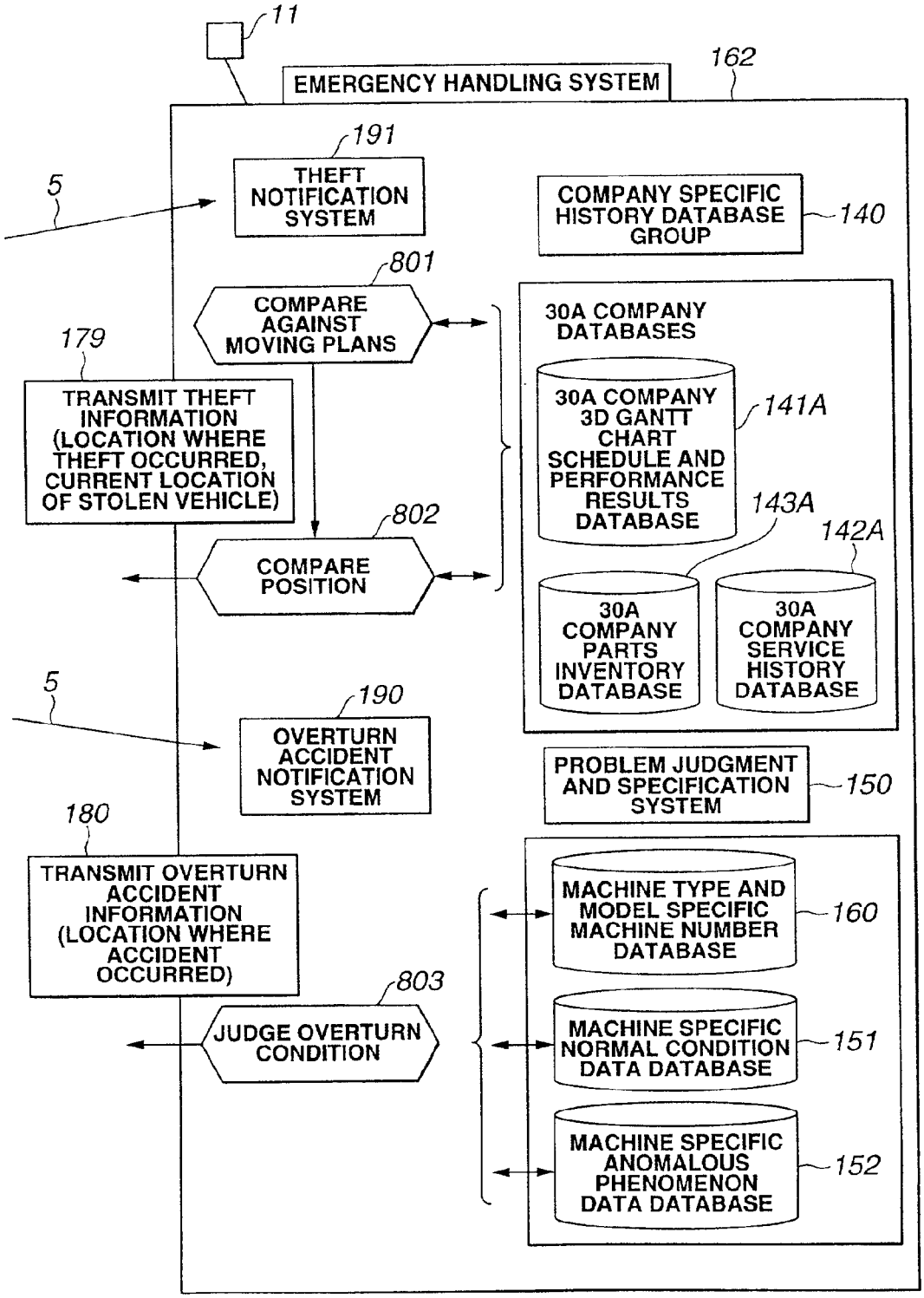

(A) OF FIG.10

301

TRUNK ROAD CONSTRUCTION WORK BETWEEN CITY A AND CITY B
CONSTRUCTION ZONE X (CITY A, REGION YY) 3D GANTT CHART

| | |
|---|---|
| CLIENT | NATIONAL GOVERNMENT |
| CONSTRUCTION PERIOD | FROM XX YEAR X MONTH XX DAY |
| | TO XX YEAR X MONTH XX DAY |

320

CONSTRUCTION ZONE NO.X X MONTH, X+1 MONTH
CONSTRUCTION WORK CONTENT

| CONSTRUCTION PHASE | WORK CONTENT | DIVISION | 3D TOPOGRAPHY | |
|---|---|---|---|---|
| | | | BEFORE STARTING WORK | AT COMPLETION OF WORK |
| CONSTRUCTION PHASE 1 | FOUNDATION CONSTRUCTION WORK (X-1 MONTH CONTINUOUS CONSTRUCTION WORK) | SCHEDULE | (DIAGRAM OF WHAT IS EXPECTED) | (DIAGRAM OF WHAT IS EXPECTED) |
| | | PERFORMANCE RESULTS | (PHOTO) | (PHOTO) |

(B) OF FIG.10

301

320

CONSTRUCTION WORK DETAILS

| MACHINES DEPLOYED | MACHINE NUMBERS | WORK START | WORK COMPLETION |
|---|---|---|---|
| FOR ENTIRE CONSTRUCTION PERIOD | INITIAL PLAN | AUGUST B | AUGUST R |
| | MODIFIED PLAN | AUGUST B | AUGUST S |
| D | LEADER MACHINE | AUGUST B | AUGUST S |
| D | - - - | AUGUST B | AUGUST P |
| P | - - - | AUGUST I | AUGUST S |
| B | - - - | AUGUST L | AUGUST S |
| B | - - - | AUGUST L | AUGUST S |
| | | | |
| | | | |
| | | REGIONAL WEATHER FORECAST | |
| FOR ENTIRE CONSTRUCTION PERIOD | | | |
| | | | |
| D | 31 | AUGUST B | AUGUST S |
| D | 32 | AUGUST B | AUGUST P |
| P | 33 | AUGUST I | AUGUST S |
| B | 34 | AUGUST L | AUGUST S |
| B | 35 | AUGUST L | AUGUST S |
| | | | |
| | | | |
| | | ACTUAL WEATHER/FORECAST WEATHER | |

(C) OF FIG.10
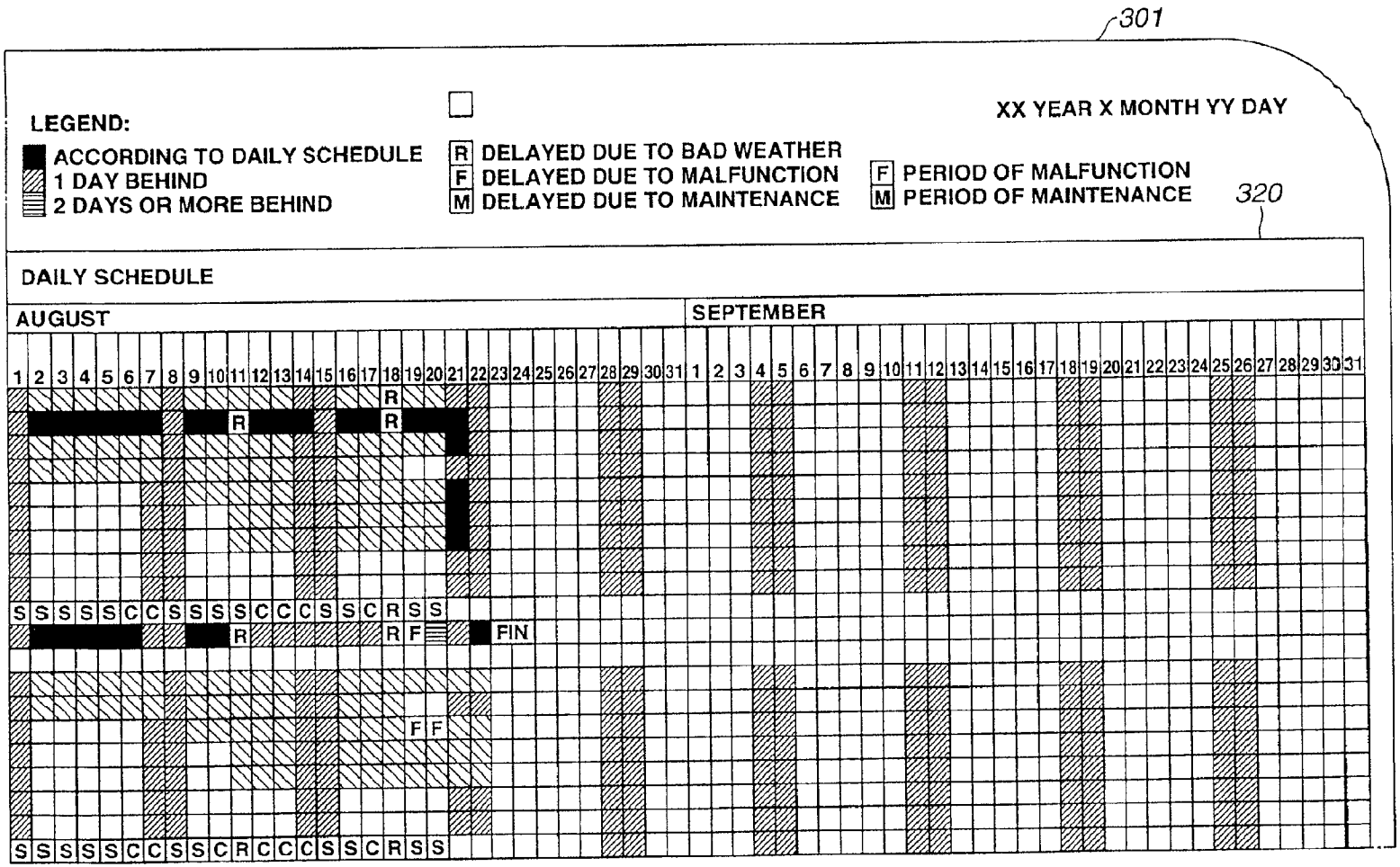

(A) OF FIG.11
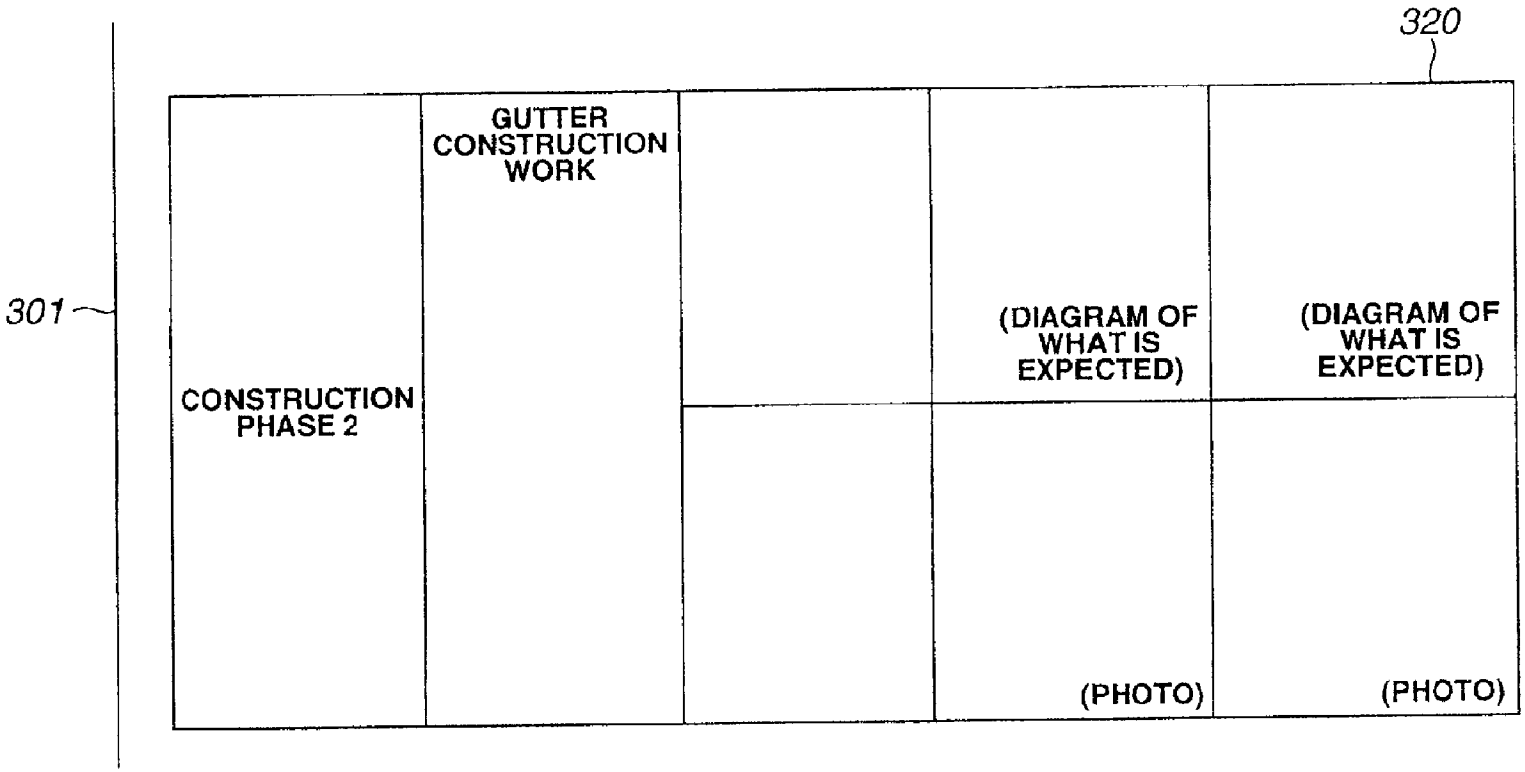

(B) OF FIG.11

320

| | | | |
|---|---|---|---|
| FOR ENTIRE CONSTRUCTION PERIOD | INITIAL PLAN | AUGUST Q | AUGUST J |
| | MODIFIED PLAN | AUGUST R | AUGUST J |
| P | LEADER MACHINE | AUGUST R | AUGUST J |
| P | - - - | AUGUST R | AUGUST J |
| P | - - - | AUGUST R | AUGUST J |
| PU | - - - | AUGUST Y | AUGUST D |
| L | - - - | AUGUST R | AUGUST J |
| | | | |
| | | | |
| | | REGIONAL WEATHER FORECAST | |
| FOR ENTIRE CONSTRUCTION PERIOD | | AUGUST Q | AUGUST J |
| | | | |
| P | 36 | AUGUST R | AUGUST J |
| P | 33 | AUGUST R | AUGUST J |
| P | 37 | AUGUST R | AUGUST J |
| PU | 38 | AUGUST Y | AUGUST D |
| L | 39 | AUGUST R | AUGUST J |
| | | | |
| | | | |
| | | ACTUAL WEATHER/FORECAST WEATHER | |

(C) OF FIG.11
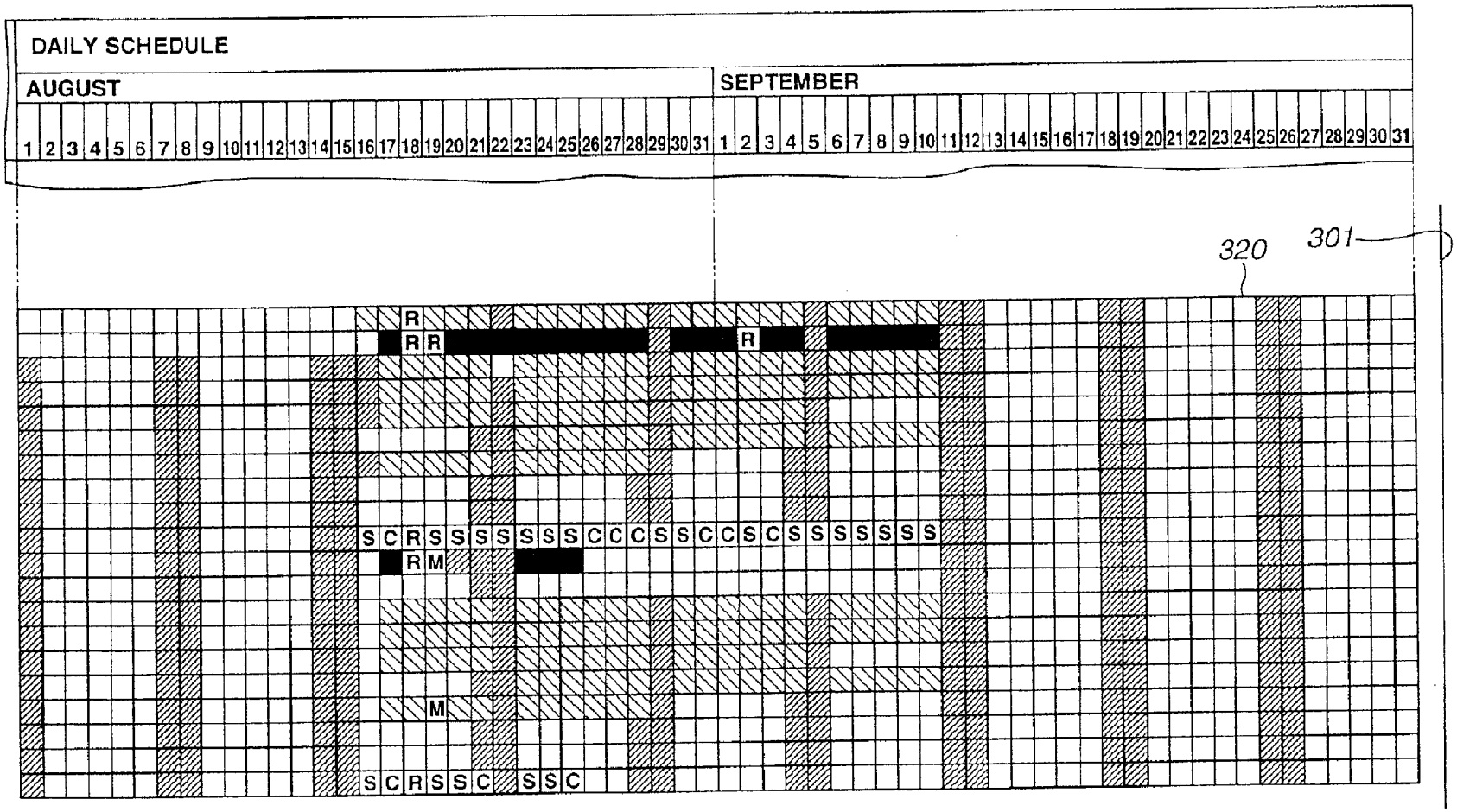

(A) OF FIG.12
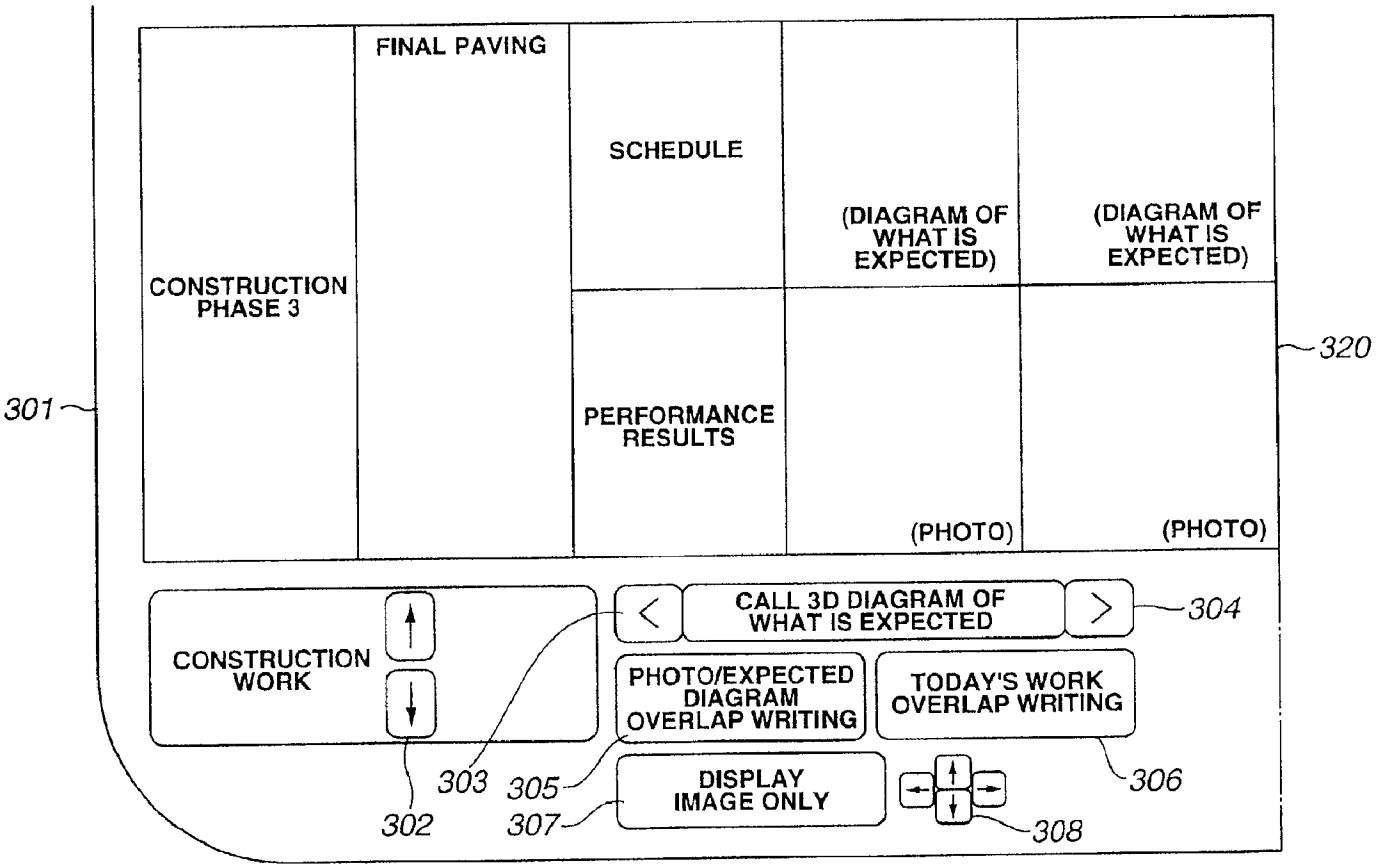

(B) OF FIG.12
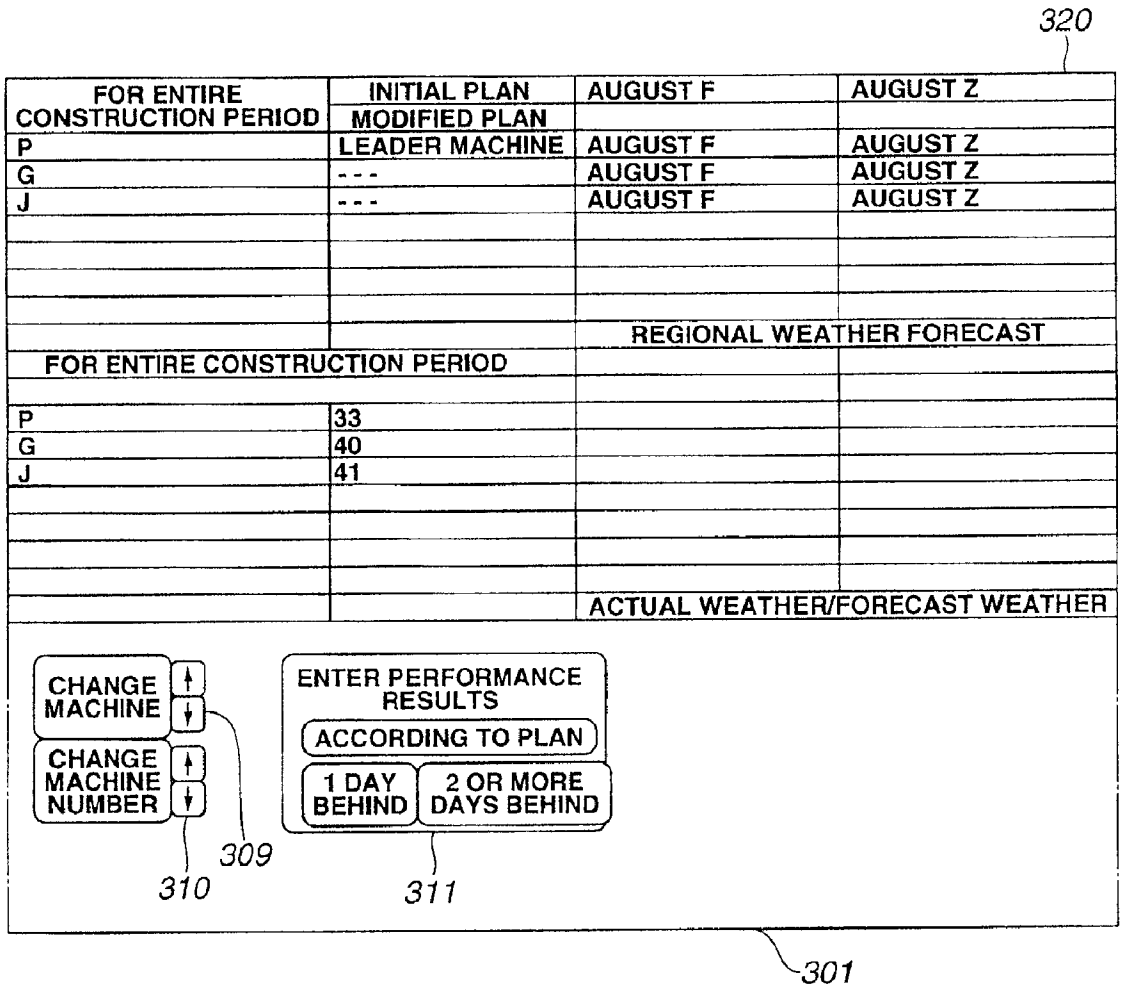

(C) OF FIG.12
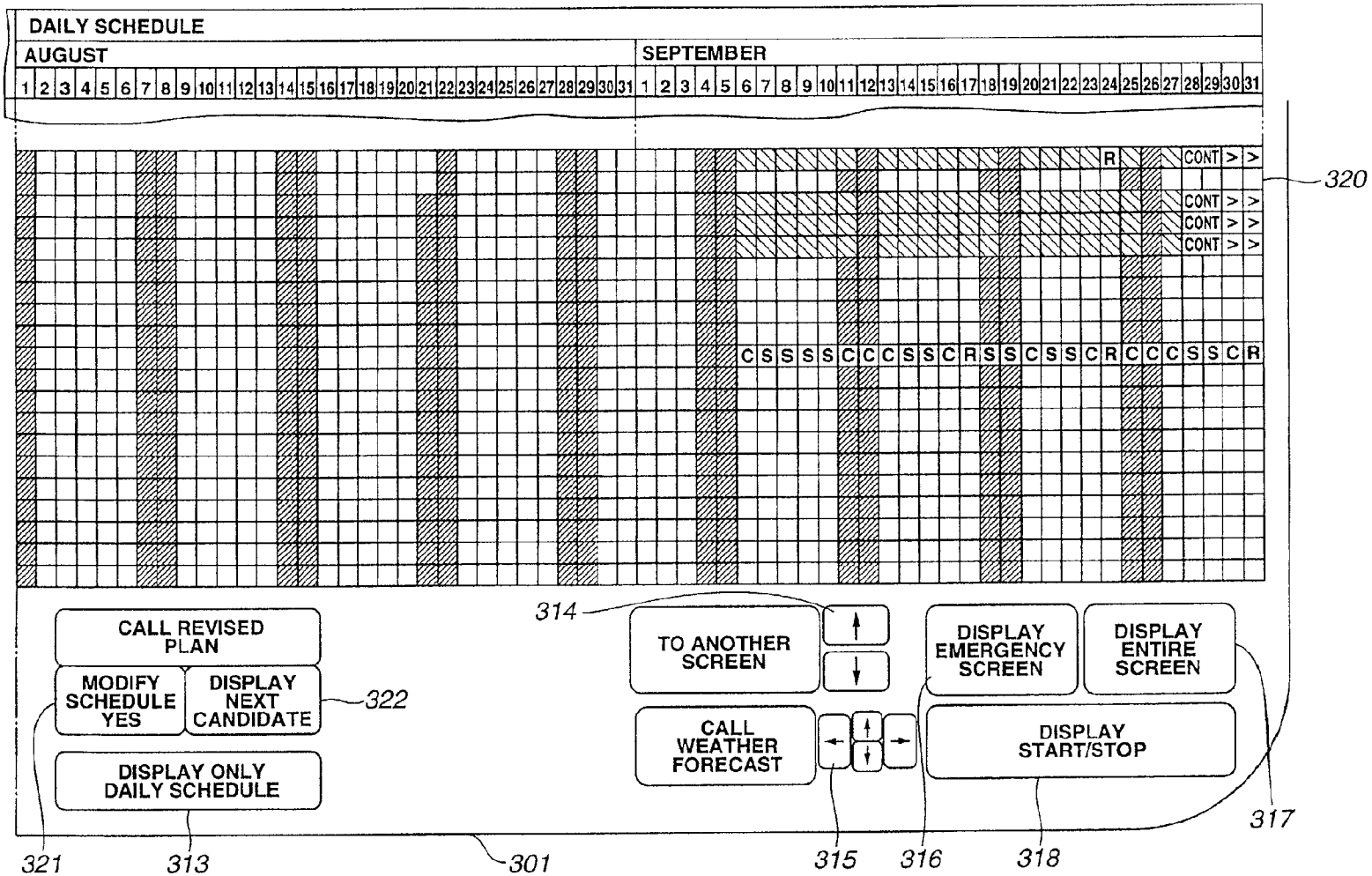

PROJECT NO. EF021A

PROCESS CHART

YESTERDAY TODAY TOMORROW

HOW WORK IS PROGRESSING: ON SCHEDULE

DAILY SCHEDULE FOR TODAY

| | |
|---|---|
| 31,32 | H-1 TO E-5 BLOCK WORK |
| ▶ 33,34 | E-7 TO F-1 BLOCK WORK |
| 35 | F-2 BLOCK WORK |

WORK CONTENT

E-7 BLOCK EXCAVATION WORK.
AFTER 2M EXCAVATION, POUR CONCRETE FOR FOUNDATION.
E-7 PERFORM SAME WORK FROM POINT 1 TO POINT 5.

DETAILED INFORMATION

FIG.17(A)

| f | a | b | c | d | e | g | h | k |
|---|---|---|---|---|---|---|---|---|
| $f_1$ | $a_1$ | $b_1$ | $c_1$ | $d_1$ | $e_1$ | $g_1$ | | |
| $f_2$ | $a_2$ | $b_2$ | $c_2$ | $d_2$ | $e_2$ | $g_2$ | | |
| $f_3$ | $a_3$ | $b_3$ | $c_3$ | $d_3$ | $e_3$ | $g_3$ | | |

FIG.17(B)

| f | a | b | c | d | e | g | h | k |
|---|---|---|---|---|---|---|---|---|
| $f_4$ | $a_4$ | $b_4$ | | | $e_4$ | $g_4$ | | |
| $f_5$ | $a_5$ | $b_5$ | | | $e_5$ | $g_5$ | | |
| $f_6$ | $a_6$ | $b_6$ | | | $e_6$ | $g_6$ | | |

FIG.18

| f | a | b | c | d | e | g | h | k |
|---|---|---|---|---|---|---|---|---|
| $f_7$ | $a_7$ | | | | $e_7$ | | | |
| $f_8$ | | | | $d_8$ | | $g_8$ | | |

DISPLAY DEVICE FOR WORK MACHINE

BACKGROUND OF THE INVENTION

1. Field of the Invention

This invention relates to a display device for a work machine

2. Description of the Related Art

When large scale public works construction such as road construction is carried out, a plural number of construction machines of a plurality of types, such as bulldozers, hydraulic shovels, road rollers, graders and dump trucks, performs work simultaneously.

In a construction site, a government approval plate in which work schedule, the name of the construction company, etc. are written is installed. However, this government approval plate only cannot tell contents of daily construction work and how far the work has been done. To improve this situation, a white board, for example, is installed around the construction site, and information concerning the construction site is written on the while board so that such information can be widely disclosed. In such a case, a noise-level meter is installed in the construction site, and a person in charge of public relations reads the indication of the noise-level meter and writes the indicated noise value on the while board in hand. In addition, the person in charge of public relations obtains work schedule and actual performance results of work from the general site manager, and writes the schedule and performance results on the white board.

However, information relating to the construction site is written on the white board is written by human hand. Thus, incorrect disclosure of the information and delay in disclosing the information may sometimes happen due to laziness of a person, reading errors and misunderstanding of the person who is engaged in this job. Because of this reasons, information relating to the construction work cannot be conveyed real time and correctly to the neighboring residents, and tremendous efforts are required by the person in charge of public relations. Therefore, the above-described information disclosing method has not widely adopted.

In view of the above-described situations, the present invention has been made, and an object of the present invention is to provide a display device for a work machine capable of disclosing information relating to the work site such as work schedule and environmental situations of the work site on a real-time bases and correctly to the neighboring residents so as to achieve tighter communications with the neighboring residents than before and to lessen the labor of the person in charge of public relations who serves to convey information relating to the work site to the neighboring residents.

The present invention is characterized in that a display device for displaying the information is installed on a work machine in such a manner as to be directed toward outside.

The present invention is described with reference to FIG. 3.

According to the present invention, an information display 47 for displaying information toward a work machine 31 is provided in the work machine 31. For example, noise values, toxic substance concentrations, a work schedule, and actual performance results are displayed on the display 47 that is mounted on the work machine 31 and is directed toward outside.

According to the present invention, information relating to the construction site, such as daily construction schedules and environmental conditions, can be provided accurately and in real time for residents living in the vicinity of the construction site, wherefore mutual understanding with those neighboring residents can be better fostered than conventionally. Also, the labors on the person in charge of public relations who communicates information relating to the construction site to the neighboring residents are not required.

The information displayed on the information display 47 is not limited to noise values, toxic substance concentrations, work schedules, or graphs of performance results, moreover, but may be other information such as weather forecasts for the area or the like. Further, "transmission of information" as transmission of advertisement can be made utilizing the information display.

BRIEF DESCRIPTION OF THE DRAWINGS

FIG. 2 is a diagram showing the relationship between information collected from various terminal apparatuses such as a terminal device in a leader work machine and services produced by a server apparatus and provided to the leader work machine or the like;

FIGS. 17(*a*) and 17(*b*) are diagrams for describing processing to judge whether or not maintenance should be done; and FIG. 18 is a diagram for describing processing for specifying the location of an anomaly.

DESCRIPTION OF THE EMBODIMENTS

Embodiments of the work machine management system according to the present invention are now described with reference to the drawings. In these embodiments, the work machines are assumed to be such construction machines as hydraulic shovels, bulldozers, road rollers, cranes, graders, and crushers.

Figure 1:
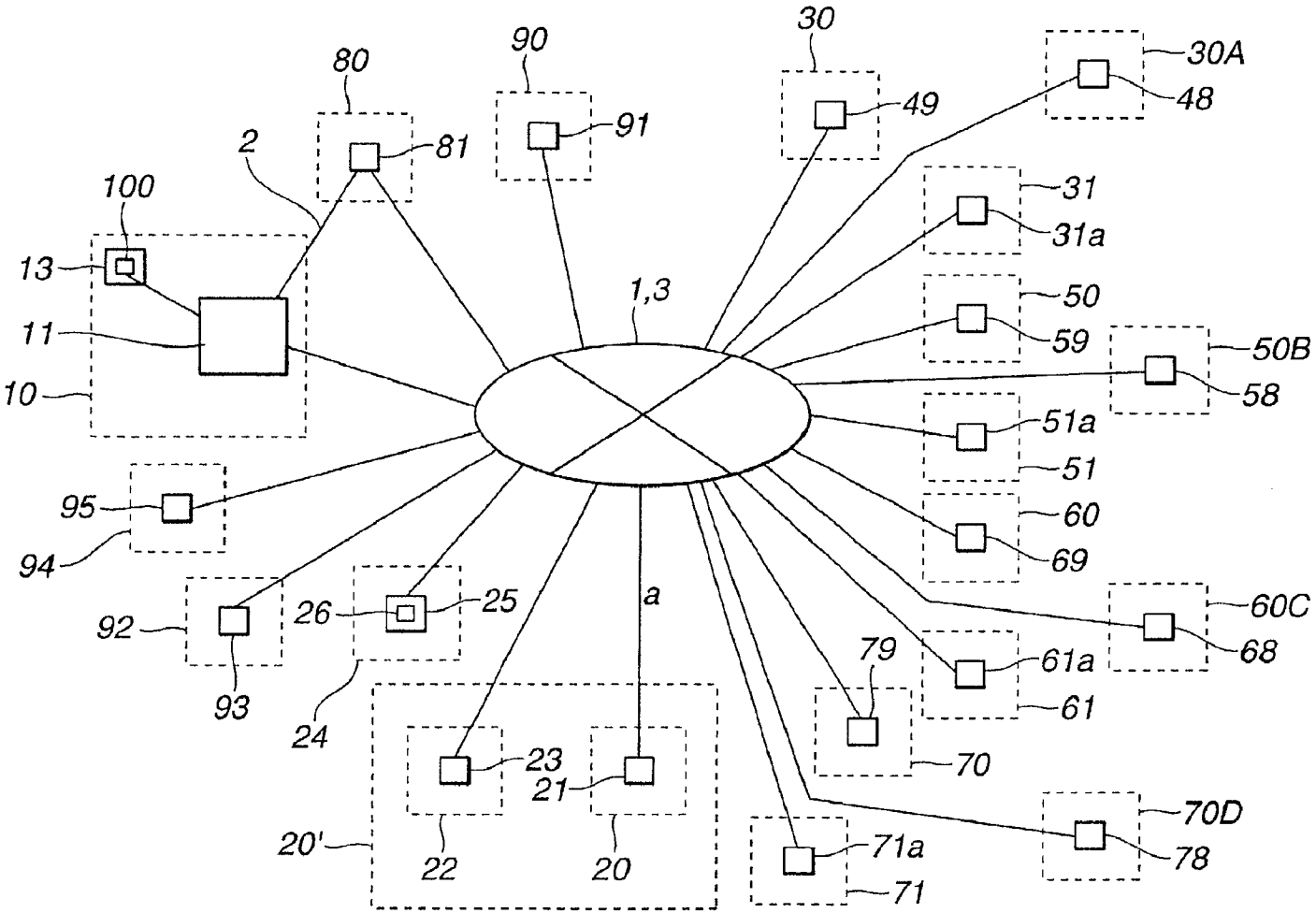
FIG. 1 is a diagram of a management system for managing construction machines in an embodiment.

In FIG. 1 is diagrammed a management system for managing construction machines in an embodiment.

As diagrammed in FIG. 1, a plurality of terminal devices 21, 23, 25, 31*a*, 51*a*, 61*a*, 71*a*, 48, 58, 68, 78, 49, 59, 69, 79, 81, 91, 93, and 95, and a server apparatus 11, are connected by the internet 1 or a communication satellite 3 such that reciprocal transmitting and receiving is possible. By the internet is meant the global communication network wherein a plurality of LANs (local area networks) are connected by gateways and bridges so that communications can be done reciprocally and freely.

The server apparatus 11 is deployed in a service provider company 10 which provides services performed by the management system of this embodiment. The server apparatus 11 may be installed in a construction machine having a display device.

A terminal device 13 is provided inside the service provider company 10. The terminal device 13 has a database 100. As will be described subsequently, a database 100 is provided such that it is dispersed among a plurality of terminal devices 13. Data are stored therein for managing the construction machines.

The terminal device 81 is deployed in a factory 80 of a manufacturer who makes construction machines.

The server apparatus 11, terminal device 13, and factory terminal device 81 are connected by an intranet 2 such that reciprocal transmitting and receiving are possible. By intranet is meant an internal company communication network built on the basis of internet technology.

The server apparatus 11 manages the input and output of data between the internet 1 or the communication satellite 3, on the one hand, and the intranet 2, on the other, processes the data stored in the database 100 inside the terminal device 13, and produces management information necessary for the management of construction machines at the construction site.

The terminal device 21 is deployed in a parts depot 20 that is a parts warehouse where construction machine parts are stored.

The terminal device 23 is deployed at a service point 22 which is a service area where such services as maintenance, inspections, and servicing are performed on construction machines. A service company 20' is configured by the parts depot 20 and the service point 22.

The terminal device 25 is deployed in a weather forecasting company 24 which provides weather forecasts. The terminal device 25 comprises a database 26. The database 26 stores detailed weather information by region.

The terminal device 48 is deployed in a construction company 30A which performs construction work using a plurality of construction machines.

The terminal device 49 is deployed in an office 30 within the construction site of the construction company 30A. The terminal device 31*a* is carried on board a construction machine 31 that of the construction machines belonging to the construction company 30A constitutes a leader work machine. By "leader work machine" here is meant, in a situation where construction work is performed by a plurality of construction machines, as described subsequently, a construction machine having on board an operator responsible for managing a plurality of construction machines. The construction machines managed by the leader work machine are defined as "follower machines."

Figure 4:
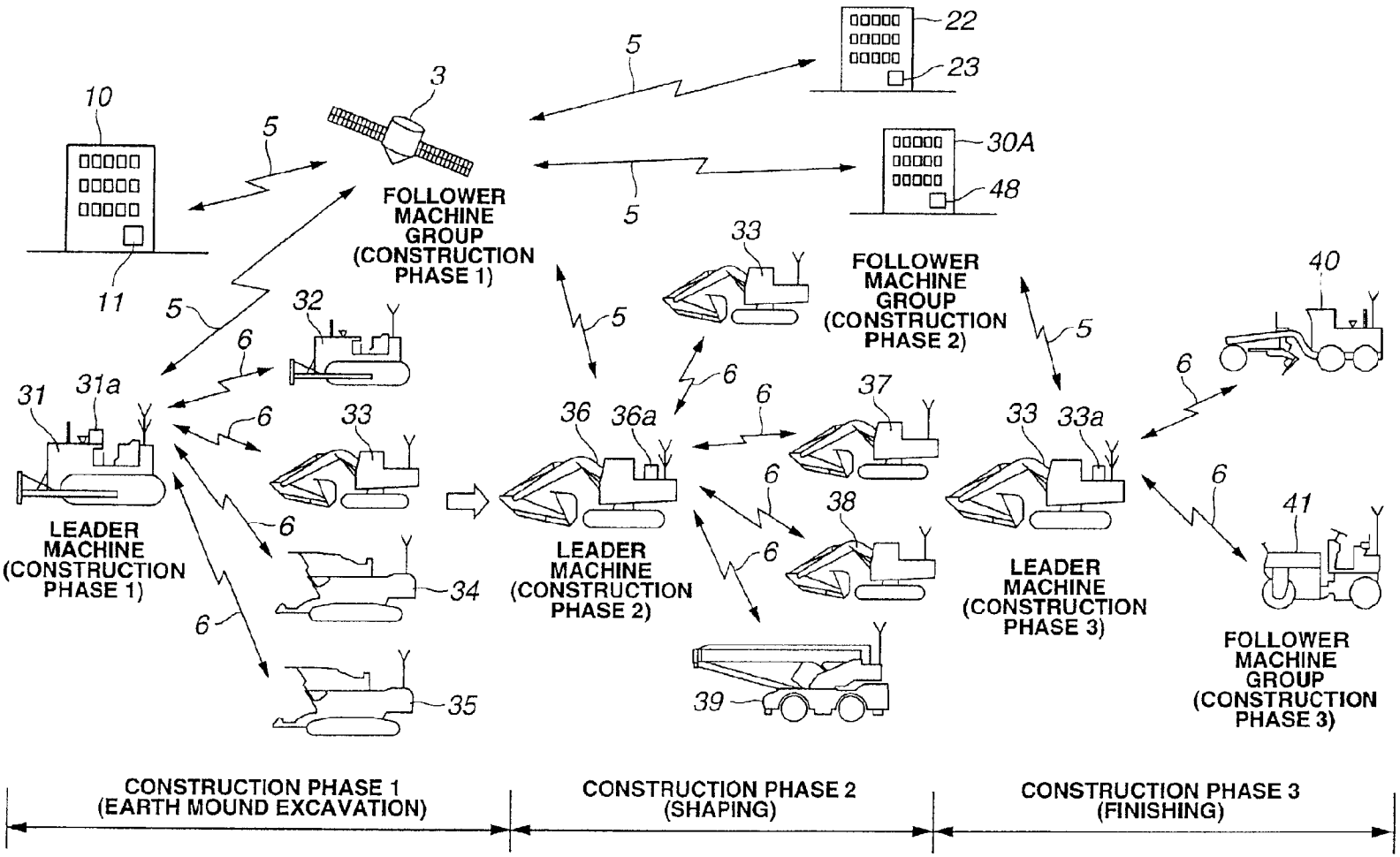
FIG. 4 is a diagram of how combinations of a plurality of construction machines change job by job in construction work.

As diagrammed in FIG. 4, it is assumed here that the construction company 30A has the construction machines 31 to 41 in its possession. A monitor device 300 is carried on board each of the construction machines 31 to 41. Various types of information, as will be described subsequently, are displayed on a display screen 301 of the monitor device 300 (cf. FIG. 5 to 16).

As diagrammed in FIG. 1, the terminal device 58 is deployed in a construction company 50B that performs construction work using a plurality of construction machines. The terminal device 59 is deployed in an office 50 inside the construction site of the construction company 50B. The terminal device 51*a* is carried on board a construction machine 51, which, of the construction machines belonging to the construction company 50B, constitutes a leader work machine.

Similarly, the terminal device 68 is deployed in a construction company 60C that performs construction work using a plurality of construction machines. The terminal device 69 is deployed in an office 60 inside the construction site of the construction company 60C. The terminal device 61*a* is carried on board a construction machine 61, which, of the construction machines belonging to the construction company 60C, constitutes a leader work machine.

Similarly, the terminal device 78 is deployed in a construction company 70D that performs construction work using a plurality of construction machines. The terminal device 79 is deployed in an office 70 inside the construction site of the construction company 70D. The terminal device 71*a* is carried on board a construction machine 71, which, of the construction machines belonging to the construction company 70D, constitutes a leader work machine.

The terminal device 91 is deployed in a leasing or rental company 90 that rents or leases construction machines.

The terminal device 93 is deployed in a government office 92 that is an ordering party (client) which orders construction work that is performed using construction machines.

The terminal device 95 is deployed in an attachment or construction equipment company 94 that manufactures construction equipment or attachments that are mounted on construction machines.

As will be described subsequently, the terminal devices 21, 23, 25, 31*a*, 51*a*, 61*a*, 71*a*, 49, 59, 69, 79, 81, 91, 93, and 95 can access data stored in the database 100 at the server apparatus 11 end, in accordance with access rights. Embodiment is also possible such that certain data of the data stored in the database 100 are only allowed to be accessed by certain terminals, and access by the other terminals is not permitted. That can be effected by making access conditional on the operation of entering a certain ID number or a certain code number at the terminal device end.

Next, the communications manner diagrammed in FIG. 1 is described in greater detail with reference to FIG. 2 and FIG. 3.

Figure 3:
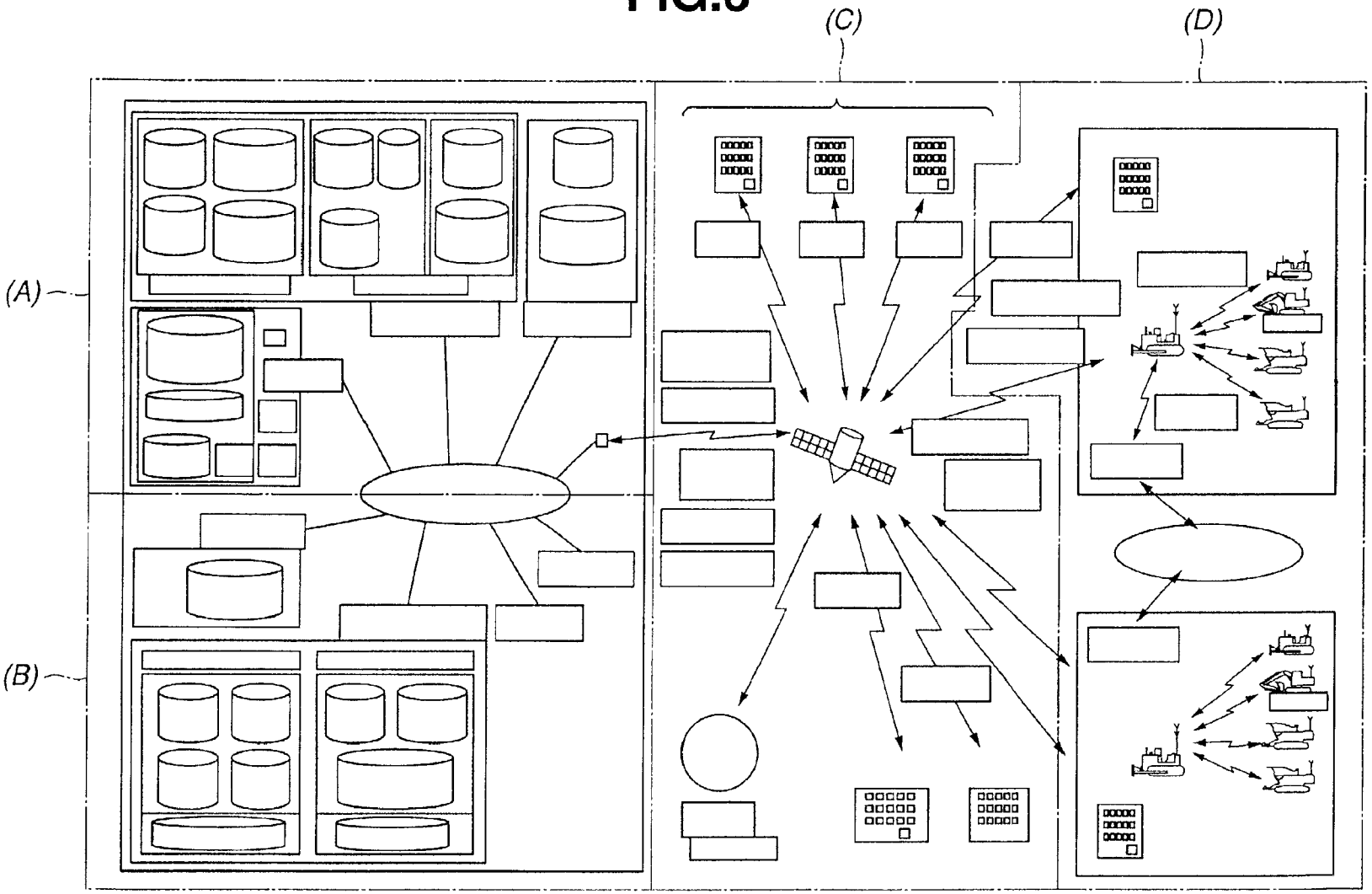
FIG. 3 is a diagram for showing the communications manners diagrammed in FIGS. 1 and 2, in greater detail.

As diagrammed in FIG. 3, reciprocal transmissions and receptions are made by radio communication links 5 via the communication satellite 3 between the terminal device 21 of the parts depot 20, the terminal device 23 of the service point 22, the terminal device 48 of the construction company 30A, the terminal device 58 of the construction company 50B, the terminal device 68 of the construction company 60C, the terminal device 78 of the construction company 70D, the terminal device 49 of the office 30, the terminal device 59 of the office 50, the terminal device 69 of the office 60, the terminal device 79 of the office 70, the terminal device 31*a* in the leader work machine 31, the terminal device 51*a* in the leader work machine 51, the terminal device 61*a* in the leader work machine 61, the terminal device 71*a* in the leader work machine 71, the terminal device 81 of the manufacturer head office 80, the terminal device 91 of the lease company 90, the terminal device 93 of the government office 92, the terminal device 95 of the attachment or construction equipment company 94, and the server apparatus 11 of the service provider company 10.

The terminal device 25 of the weather forecasting company 24 is connected to the internet 1 by a hard line. Therefore, reciprocal transmitting and receiving are done between the terminal device 25 of the weather forecasting company 24 and the other terminal devices 21, 23, 25, 31*a*, 51*a*, 61*a*, 71*a*, 48, 58, 68, 78, 49, 59, 69, 79, 81, 91, 93, and 95 and the server apparatus 11 via the internet 1 and the communication satellite 3.

FIG. 3 exemplifies a case where construction work is being performed by a plurality of construction machines 31 to 35 at a construction site where construction work undertaken by the construction company 30A is being done. Reciprocal transmitting and receiving are conducted between the plurality of construction machines 31 to 35 by radio communication links 6. For the radio communication links 6, a communication scheme is adopted wherewith radio communications are possible over distances traversing the entire area of the construction site and wherewith data can be transmitted and received at high speed. A spread spectrum (SS) radio scheme may be adopted, for example. On board the leader work machine 31, among the plurality of construction machines 31 to 35, a communication terminal for the radio communication links 5 and a communication terminal for the radio communication links 6 are carried. Also carried on board the leader work machine 31 is a monitor device 300 that displays data transmitted thereto from the communication satellite 3 via the radio communication links 5 on the display screen 301. A vehicle-mounted signboard 47 is also carried on board the leader work machine 31. The signboard 47 is an electric message board for notifying residents in the periphery of the construction site of information relating to the construction site.

Similarly, reciprocal transmitting and receiving are conducted between the plurality of construction machines inside the construction site of the construction company 50B by the radio communication links 6. A stationary type signboard 57 is also deployed in the construction site of the construction company 50B. The signboard 57, in like manner as the signboard 47, provides information relating to the construction site to residents living in the periphery of the construction site.

The situation is similar at the construction sites of the other construction companies 60C and 70D.

The database 100 inside the service provider company 10 is dispersed among the databases 110, 130, 140A, 140B, 140C, 140D, 150, 160, 161, 162, 163, and 164.

The database 110 is a database wherein are stored a program and data necessary for producing a three-dimensional (3D) Gantt chart for each construction project to constitute a construction project-specific optimized 3D Gantt chart production system. A three-dimensional Gantt chart can be produced for each construction project using the program and data stored in that construction project-specific optimized 3D Gantt chart production system 110.

The construction project-specific optimized 3D Gantt chart production system 110 comprises a region specific statistical database group 110A and a machine specific statistical database group 110B. The region specific statistical database group 110A, which is a database wherein are stored statistical data by region, comprises a weather statistics database 111, a 3D topological map database 112, a soil quality database 113, and a traffic volume statistics database 114.

The weather statistics database 111 stores weather statistics by region. The 3D topological map database 112 stores three-dimensional (3D) topographical maps by region. The soil quality database 113 stores soil quality data by region. And the traffic volume statistics database 114 stores statistics on traffic volumes by region.

The machine specific statistical database group 110B, which is a database wherein are stored statistical data on the construction machines, by type and model, comprises a work capability database 115, a fuel consumption database 116, an environmental impact database 117, a lease fee database 118, and a maintenance cost database 119.

The work capability database 115 stores work capability data by machine type and model. The fuel consumption database 116 stores fuel consumption data by machine type and model. The environmental impact database 117 stores data on the impact on the environment made, by machine type and model. The lease fee database 118 stores lease fee (rental fee) data by machine type and model. And the maintenance cost database 119 stores maintenance costs by machine type and model.

The database 130 is a database wherein are stored a program and data necessary for adding up service related fees that constitute a service related fee totaling system. Fees required for services can be calculated using the data and program stored in this service related fee totaling system 130. The service related fee totaling system 130 comprises a service fee database 131 and a service parts price database 132.

The service fee database 131 stores service fee (wages) data. The service parts price database 132 stores construction machine parts prices.

The database 140A, which is a database wherein are stored data related to the construction company 30A, comprises a 3D Gantt chart schedule and performance results database 141A, a service history database 142A, and an internal company 30A parts inventory database 143A.

The 3D Gantt chart schedule and performance results database 141A stores 3D Gantt chart schedule and performance results data for construction work performed by the construction company 30A. The service history database 142A stores the history of service provided to construction machines at the construction site of the construction company 30A. And the internal company 30A parts inventory database 143A stores data on construction machine parts in inventory at the construction company 30A.

The database 140B is a database wherein are stored data related to the construction company 50B. The content stored in the database 140B is similar to that stored in the database 140A. What has been said here applies similarly to the database 140C of the construction company 60C and the database 140D of the construction company 70D.

The databases 140A, 140B, 140C, and 140D of the construction companies 30A, 50B, 60C, and 70D are collectively called the company specific history database group 140.

The database 150 is a database wherein are stored a program and data necessary for judging troubles (anomalies such as failures) generated by construction machines and determining the content of the optimal maintenance to be performed on the construction machines, which program and data constitute a trouble and optimal maintenance judgment system. Using the program and data stored in this trouble and optimal maintenance judgment system 150, troubles that occur in a construction machine can be judged, and the content of the maintenance that should be performed on the construction machine can be determined. The trouble and optimal maintenance judgment system 150 comprises a machine specific anomaly judgment database group 150A and a machine specific service judgment database group 150B.

The machine specific anomaly judgment database group 150A, which is a database wherein are stored data for judging anomalies by construction machine type and model, comprises a standard condition data database 151, an anomalous phenomenon data database 152, a correction time data database 153, and an anomaly location data database 154.

The standard condition data database 151 stores standard condition data that indicate standards for judging anomalies by machine type and model. The anomalous phenomenon data database 152 stores data on anomalous phenomenon that occur at the construction machines and the seriousness of each anomalous phenomenon in the form of anomalous phenomenon data. The correction time data database 153 stores the times required before anomalies are corrected to normal, by machine type and model, in the form of repair time data. And the anomaly location data database 154 stores the locations where anomalies occur, by machine type and model, in the form of anomaly location data.

The machine specific service judgment database group 150B, which is a database wherein are stored data for determining the content of maintenance, by construction machine type and model, comprises a limiting condition data database 156, a maintenance failure fatality level database 157, and a maintenance time required data database 158.

The limiting condition data database 156 stores limiting conditions on whether or not maintenance is required, by machine type and model, in the form of limiting condition data. The maintenance failure fatality level database 157 stores data indicating the level of fatality that ensues when maintenance is not performed, by machine type and model. And the maintenance time required data database 158 stores times required until maintenance is finished, by machine type and model, in the form of maintenance time required data.

The machine type and model specific machine number database 160 stores data on vehicle IDs that are symbolic codes which specify each individual construction machine, and the correlations between the construction machine types, models, and machine numbers. The 3D parts shape database 161 stores three-dimensional (3D) shape data on parts configuring the construction machines.

The database 162 is a database wherein are stored a program and data necessary in order to immediately contact the proper locations when an anomalous situation such as a construction machine overturn accident or theft has occurred, which program and data constitute an emergency immediate response system.

The database 163 is a database wherein are stored a program and data necessary in order to forecast demand associated with construction projects expected in the future, which program and data constitute a future expected construction project computation system.

The database 164 is a database wherein are stored a program and data necessary in order to display information relating to construction work on a signboard 47 or 57 at a construction site, which program and data constitute an information display selection system.

Figure 2:
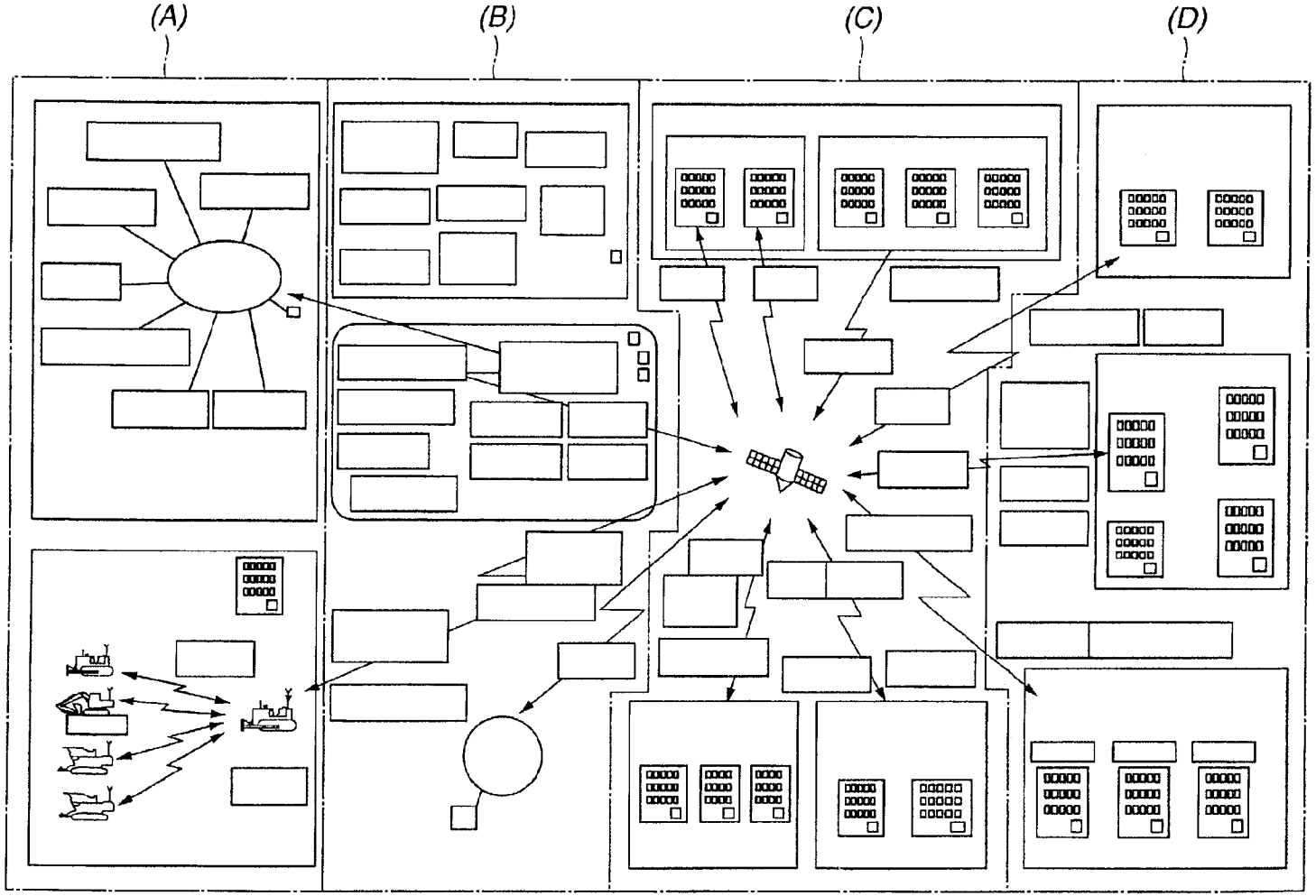

In FIG. 2 is diagrammed the relationship between the services provided to the leader work machine 31 produced on the basis of information collected from the terminal devices carried on board the leader work machines such as the terminal device 31*a* of the leader work machine 31 and on the database 110 at the server apparatus 11, and the like.

In FIG. 2 is diagrammed the construction site of the construction company 30A. A sensor group is provided in each of the construction machines 31 to 35 for detecting such vehicle conditions (called vehicle condition data) as the hydraulic pressure a, oil temperature b, water temperature c, stress d, engine r.p.m. e, lever control input signals f, hour meter time elapsed g, vehicle position h, and vehicle inclination angle k. By lever control input signals f are meant signals indicating the direction and amount of manipulation of a control lever for controlling a working member of a construction machine; the working condition (particulars of work) of a construction machine can be identified according to the lever control input signals f. The construction machines 31 to 41 are each associated with a vehicle ID that specifies the type, model, and number of the vehicle. By stress d, moreover, is meant the value detected by a stress sensor for detecting stresses acting on a working member.

The vehicle ID data and vehicle condition data 200 detected by these multiple construction machines 32 to 35 are transmitted from the leader work machine 31 to the server apparatus 11 via the communication satellite 3, as will be described subsequently. When there has been a request to produce a revised Gantt chart, due to a change in the demands of the client, for example, this revised Gantt chart production request information 600*b* is transmitted from the leader work machine 31 to the server apparatus 11 via the communication satellite 3.

The government offices 92 comprise a police station 92*a*, fire fighting (emergency) station 92*b*, prefectural office 92*c*, national government 92*d*, and city/town/village office 92*e*. In the case where the national government 92*d* of the government offices 92 is the client, the national government 92*d* transmits information on construction projects scheduled to be ordered (client demand data) 600*a* to the server apparatus 11 via the communication satellite 3. The terminal devices 93*a*, 93*b*, 93*c*, 93*d*, and 93*e* are deployed, respectively, at the police station 92*a*, fire fighting (emergency) station 92*b*, prefectural office 92*c*, national government 92*d*, and city/town/village office 92*e*.

The construction companies 30A, 50B, 60C, and 70D transmit information on construction projects scheduled to be ordered 202 to the server apparatus 11 via the communication satellite 3.

The lease company 90 comprises a lease company 90*a* and a rental company 90*b*. The lease company 90*a* or rental company 90*b* transmits information on the construction machines in its possession (machines on hand information) 203 to the server apparatus 11 via the communication satellite 3. The terminal devices 91*a* and 91*b* are deployed in the lease company 90*a* and the rental company 90*b*, respectively.

The parts depot 20 of the service company 20' transmits information indicating the results of a search of parts inventories (parts inventory search result information) 204 to the server apparatus 11 via the communication satellite 3.

The service point 22 of the service company 20' transmits information indicating the results of a search for the whereabouts of a service person (service personnel search results information) 205 to the server apparatus 11 via the communication satellite 3.

The manufacturers (manufacturing companies) of the construction machines 80 comprise the manufacturers 80*a,* 80*b,* and 80*c.* Those manufacturers 80*a,* 80*b,* and 80*c* transmit the machine specific statistical database group 110B and/or the machine specific anomaly judgment database 150A to the server apparatus 11 via the communication satellite 3. The terminals 81*a,* 81*b,* and 81*c* are deployed, respectively, in the manufacturers 80*a,* 80*b,* and 80*c.*

The attachment or construction equipment companies 94 comprise a crusher manufacturing company 94*a* that manufactures crushers, a rock drill manufacturing company 94*b* that manufactures rock drills, and a construction material manufacturing company 94*c* that manufactures construction materials. The crusher manufacturing company 94*a,* the rock drill manufacturing company 94*b,* and the construction material manufacturing company 94*c* transmit information on the attachments or construction equipment in its own possession (information on attachments or equipment on hand) 178 to the server apparatus 11 via the communication satellite 3. The terminal devices 95*a,* 95*b,* and 95*c,* respectively, are deployed at the crusher manufacturing company 94*a,* the rock drill manufacturing company 94*b,* and the construction material manufacturing company 94*c.*

The weather forecasting company 24 transmits regional specific detailed weather information 175 stored in the database 26 to the server apparatus 11 via the internet 1 or the communication satellite 3.

At the server apparatus 11, information 165 for a 3D Gantt chart, whereon are described the optimum processes for construction work yet to be begun, is produced on the basis of the information on construction projects scheduled to be ordered (client demand data) 600*a* and machine specific statistical database group 110B collected, and on the company specific history database group 140 and construction project specific optimized 3D Gantt chart production system 110 stored in the database 100. The following information incidental to the production of the 3D Gantt chart information 165 is also produced.

Specifically, using the 3D Gantt chart information 165 and the future expected construction project computation system 163, construction project cost estimate information 170 indicating a rough estimate of construction project costs is produced. Also, using the 3D Gantt chart information 165 and the future expected construction project computation system 163, optimum fleet estimate information 171 indicating estimates of the numbers and types of construction machines needed to complete the construction project is produced. Also, using the 3D Gantt chart information 165 and the future expected construction project computation system 163, building equipment demand forecast information 172 indicating the demand for building equipment forecast in conjunction with construction project orders is produced. Also, using the 3D Gantt chart information 165 and the future expected construction project computation system 163, attachment demand forecast information 173 indicating the demand for attachments forecast in conjunction with construction project orders is produced. Also, using the 3D Gantt chart information 165 and the future expected construction project computation system 163, parts demand forecast information 176 indicating the demand for parts forecast in conjunction with construction project orders is produced. Also, using the 3D Gantt chart information 165 and the future expected construction project computation system 163, service demand forecast information 177 indicating the demand for services forecast in conjunction with construction project orders is produced. Also, using the 3D Gantt chart information 165 and the future expected construction project computation system 163, unordered construction project demand forecast information 181 indicating the demand for construction projects not yet ordered is produced. Also, using the 3D Gantt chart information 165 and the future expected construction project computation system 163, machine purchase and replacement demand forecast information 169 indicating the demand for new purchases or replacements of construction machines is produced.

At the server apparatus 11, anomaly handling proposal and revised Gantt chart proposal information 166 indicating a proposal on how to handle occurrences of anomalies such as changes in client demands, unscheduled maintenance, trouble correction, and changes in weather conditions, and a proposal for a revised 3D Gantt chart (candidate) that revises the initial 3D Gantt chart is produced, based on the revised Gantt chart production request information 600*b,* regional specific detailed weather information 175 and vehicle ID data/vehicle condition data 200 that have been collected, and on the company specific history database group 140, construction project specific optimized 3D Gantt chart production system 110, and trouble and optimal maintenance judgment system 150 stored in the database 100.

At the server apparatus 11, parts and service personnel arrival date and time information 167 indicating the date and time of the arrivals of parts and service personnel is produced, based on the parts inventory search result information 204 and service personnel search results information 205 collected.

At the server apparatus 11, accident and theft condition information 168 indicating construction machine overturn accidents and construction machine thefts is produced, based on the vehicle ID data and vehicle condition data 200 collected and on the emergency immediate response system 162 stored in the database 100. The accident and theft condition information 168 comprises accident information 179 and overturn accident information 180.

The anomaly handling proposal and revised Gantt chart proposal information 166 and parts and service personnel arrival date and time information 167 produced by the server apparatus 11 are transmitted to the leader work machine 31 of the construction company 30A via the communication satellite 3.

The machine purchase and replacement demand forecast information 169 produced by the server apparatus 11 is transmitted to the manufacturers 80*a,* 80*b,* and 80*c.*

The parts demand forecast information 176 and service demand forecast information 177 produced by the server apparatus 11 are transmitted respectively to the parts depot 20 and service point 22 of the service company 20' via the communication satellite 3.

The attachment demand forecast information 173 and building equipment demand forecast information 172 produced by the server apparatus 11 are transmitted to the attachment or construction equipment companies 94*a,* 94*b,* and 94*c.*

The 3D Gantt chart information 165 and optimum fleet estimate information 171 produced by the server apparatus 11 are transmitted to the construction companies 30A, 50B, 60C, and 70D. The information on construction projects scheduled to be ordered (client demand data) 600*a* transmitted from the government offices 92 is transmitted to the construction companies 30A, 50B, 60C, and 70D via the server apparatus 11 and the communication satellite 3.

The accident and theft condition information 168 and unordered construction project demand forecast information 181 produced by the server apparatus 11 are transmitted via the communication satellite 3 to the lease company 90*a* and the rental company 90*b*.

Of the accident and theft condition information 168 produced by the server apparatus 11, the accident information 179 is transmitted to the police station 92*a* of the government offices 92 via the communication satellite 3. Of the accident and theft condition information 168 produced by the server apparatus 11, moreover, the overturn accident information 180 is transmitted to the fire fighting (emergency) station 92*b* of the government offices 92. And the construction project cost estimate information 170 produced by the server apparatus 11 is transmitted to the national government office 92*d* in the government offices 92 that is the client, via the communication satellite 3.

FIG. 4 diagrams how combinations of a plurality of construction machines change job by job in construction work. In FIG. 4 is exemplified a case where road building construction work is being undertaken at the construction site of the construction company 30A.

More specifically, the road building construction work consists of a construction phase 1 wherein a mound of earth is excavated, a construction phase 2 wherein the excavated mound of earth is shaped, and a construction phase 3 wherein the shaped mound of earth is finished to make a road. The road building construction work is completed when construction phase 3 is finished. In construction phase 1, foundation construction work is performed.

In construction phase 2, gutter construction work is performed. And in construction phase 3, final paving work is performed.

In construction phase 1, the mound of earth is excavated by bulldozers 31 and 32, a hydraulic shovel 33, and crushers 34 and 35. In construction phase 1, the bulldozer 31 becomes the leader work machine, and the other bulldozer 32, the hydraulic shovel 33, and the crushers 34 and 35 become follower machines. In construction phase 1, data are transmitted and received via a radio communication link 5 between the communication satellite 3 and a terminal device 31*a* carried on board the leader work machine 31, and the operator on board the leader work machine 31 manages his or her own construction machine 31 and the other follower machines 32, 33, 34, and 35.

In construction phase 2, the mound of earth is shaped by hydraulic shovels 36, 33, 37, and 38, and a crane 39. In construction phase 2, the hydraulic shovel 36 becomes the leader work machine, and the other hydraulic shovels 33, 37, and 38, and the crane 39, become the follower machines. In construction phase 2, data are transmitted and received via a radio communication link 5 between the communication satellite 3 and a terminal device 36*a* carried on board the leader work machine 36, and the operator on board the leader work machine 36 manages his or her own construction machine 36 and the follower machines 33, 37, 38, and 39.

In construction phase 3, the mound of earth is finished into a road by the hydraulic shovel 33, grader 40, and road roller 41. In construction phase 3, the hydraulic shovel 33 becomes the leader work machine, and the grader 40 and road roller 41 become the follower machines. In construction phase 3, data are transmitted and received via a radio communication link 5 between the communication satellite 3 and a terminal device 33*a* carried on board the leader work machine 33, and the operator on board the leader work machine 33 manages his or her own construction machine 33 and the follower machines 40 and 41.

A sensor group is provided in each of the construction machines 31 to 41 for detecting such vehicle conditions (called vehicle condition data) as the hydraulic pressure a, oil temperature b, water temperature c, stress d, engine r.p.m. e, lever control input signals f, hour meter time elapsed g, vehicle position h, and vehicle inclination angle k. The construction machines 31 to 41 also have vehicle IDs associated therewith.

These vehicle condition data and vehicle ID data are transmitted as transmission data 200 from the follower machines to the leader work machine via the radio communication links 6. In construction phase 1, for example, the transmission data 200 (vehicle condition data and vehicle ID data) are transmitted from the follower machines 32 to 35 to the leader work machine 31 by the radio communication links 6. The leader work machine 31 then transmits the transmission data 200 (vehicle condition data and vehicle ID data) for the follower machines 32 to 35 and the vehicle condition data and vehicle ID data for that lead machine vehicle itself to the communication satellite 3 via the radio communication link 5.

The operations performed with the embodiment are now described with reference to FIGS. 5 to 16 inclusive. In the description which follows, a number of suppositions are made, namely that the national government 92*d* is the client, that road building construction work is performed at the construction site of the construction company 30A, and that the construction work is being carried on in construction phase 1 with the construction machine 31 as the leader work machine.

Figure 7:
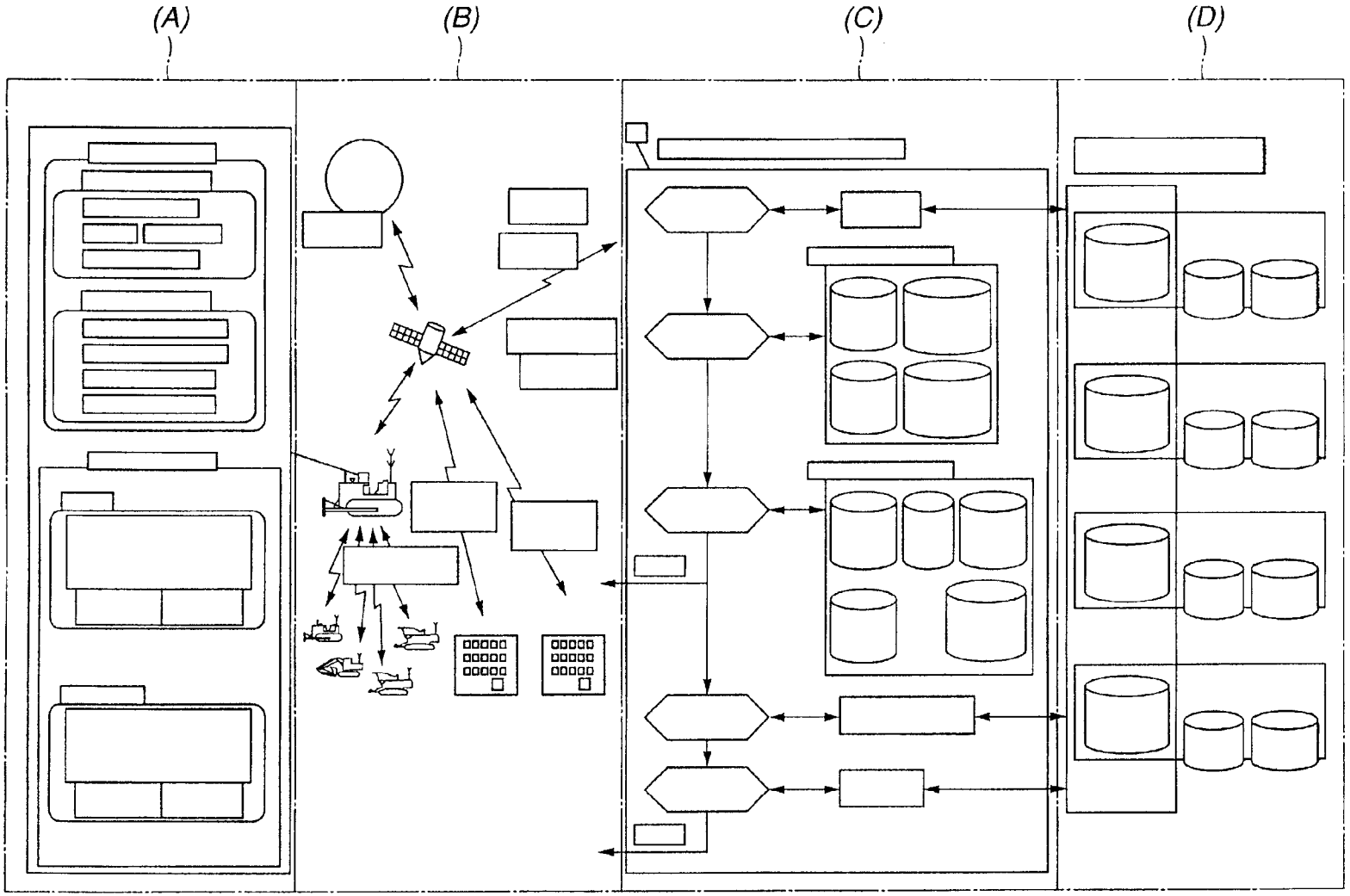
FIG. 7 is a diagram that represents both processing procedures for cases where a Gantt chart is automatically produced and processing procedures for correcting a Gantt chart when an anomaly has occurred in a construction machine.

In FIG. 7 is diagrammed an embodiment wherein the operator of the leader work machine 31 can act both as the general site foreman (construction operations manager) and general site manager. The following description is given with reference to FIG. 2 and FIG. 7.

First, as indicated in FIG. 2, the national government 92*d* inputs data from the terminal device 93*d*, and transmits the information on construction projects scheduled to be ordered (client demand data) 600*a* indicating the particulars demanded by the client as relating to the road building construction work to the server apparatus 11 of the service provider company 10 via a radio communication link 5, communication satellite 3, and radio communication link 5.

As indicated in FIG. 7, the information on construction projects scheduled to be ordered (client demand data) 600*a* is made up of number of lanes and pavement thickness q, budget r, construction phase s, and environmental considerations (exterior appearance, $CO_2$ emission levels, etc.) t. In the database 100 is stored the information on construction projects scheduled to be ordered (client demand data) 600*a*. The construction companies 30A, 50B, 60C, and 70D are authorized to access the information on construction projects scheduled to be ordered (client demand data) 600*a* stored in the database 100. That being so, when data such as a password are input from the terminal devices 48, 58, 68, and 78 of the construction companies 30A, 50B, 60C, and 70D, and the information on construction projects scheduled to be ordered 600*a* is accessed, that information on construction projects scheduled to be ordered 600*a* is transmitted to the terminal devices 48, 58, 68, and 78 of the construction companies 30A, 50B, 60C, and 70D via a radio communication link 5, communication satellite 3, and radio communication link 5, stored in memory inside those terminal devices, and displayed on display screens.

At the server apparatus 11, 3D Gantt chart information 165 wherein are described optimal processes (jobs) for a construction project not yet begun is produced, based on the information on construction projects scheduled to be ordered (client demand data) 600*a,* machine specific statistical database group 110B, company specific history database group 140, and construction project-specific optimized 3D Gantt chart production system 110 stored in the database 100.

Here, every time there is a construction machine design change at the construction machine manufacturers 80*a,* 80*b,* and 80*c,* the data stored in the machine specific statistical database group 110B are transmitted from the manufacturers 80*a,* 80*b,* and 80*c* to the server apparatus 11, and the data stored in the machine specific statistical database group 110B are updated to the latest data.

As indicated in FIG. 7, the construction project-specific optimized 3D Gantt chart production system 110 comprises a similar construction work selection system 706. This similar construction work selection system 706 is a system that selects a Gantt chart, corresponding to past construction work that is similar in terms of the content demanded to the current construction project, from among data stored in 3D Gantt chart schedule and performance results databases 141A, 141B, 141C, and 141D that are part of the company specific history database group 140.

Thereupon, the similar construction work selection system 706 retrieves information on past construction work that is similar to the construction work indicated in the information on construction projects scheduled to be ordered (client demand data) 600*a* from the data stored in the 3D Gantt chart schedule and performance results databases 141A, 141B, 141C, and 141D (step 701).

Next, processing is performed to revise the selected Gantt chart according to regional characteristics. This is done because, in cases where the region where the current construction work is being performed and the region where the construction work corresponding to the Gantt chart selected was performed differ, there will be differences in soil quality, traffic volume, weather, topography, and so on, in correspondence wherewith the construction period and the like will also differ, whereupon the selected Gantt chart cannot be used as it is.

That being so, the selected Gantt chart is revised (step 702) so that it matches the region where the current construction work is to be performed, using the data stored in the soil quality database 113, traffic volume statistics database 114, weather statistics database 111, and 3D topological map database 112 of the region specific statistical database group 110A.

Next, the Gantt chart is revised according to the construction phase s, budget r, and environmental considerations t that are part of the content demanded by the client. Then a Gantt chart that gives highest priority to the construction phase s (hereinafter called the construction period priority Gantt chart), a Gantt chart that gives highest priority to the budget r (hereinafter called the budget priority Gantt chart), and a Gantt chart that gives highest priority to the environmental considerations t (hereinafter called the environment priority Gantt chart), respectively, are produced as Gantt chart candidates. When the highest priority is given to the construction phase s, the number of construction machines to be deployed becomes large, the budget r becomes large as a tradeoff in completing the construction work in a short time, and environmental considerations t are sacrificed. When the highest priority is given to the budget r, as a tradeoff in performing the construction work with a low budget, the number of construction machines deployed becomes fewer while the construction period becomes long. And when the highest priority is given to environmental considerations t, the construction period will become longer as compared to the case where priority is given to the construction phase s, but the impact on the environment will be smaller.

Thereupon, the Gantt chart is revised so as to give the highest priority to the construction phase s, using data in the work capability database 115, fuel consumption database 116, environmental impact database 117, maintenance cost database 119, and lease fee database 118 of the machine specific statistical database group 110B. When the highest priority is given to the construction phase s, many construction machine models that exhibit high work capabilities will be deployed at the construction site.

Similarly, the Gantt chart is revised so as to give the highest priority to the budget r, using data in the work capability database 115, fuel consumption database 116, environmental impact database 117, maintenance cost database 119, and lease fee database 118. When the highest priority is given to the budget r, many construction machines of a model exhibiting low maintenance costs, low lease fees, and low fuel consumption will be deployed at the construction site.

Also, similarly, the Gantt chart is revised so as to give the highest priority to environmental considerations t, using data in the work capability database 115, fuel consumption database 116, environmental impact database 117, maintenance cost database 119, and lease fee database 118. When the highest priority is given to the environmental considerations t, the impact on the environment will be low, but many construction machines of models exhibiting low fuel consumption will be deployed at the construction site.

Thus the construction period priority Gantt chart, budget priority Gantt chart, and environment priority Gantt chart, respectively, are produced as Gantt chart candidates, and stored as unstarted construction work optimal job (3D Gantt chart) information 165 in the database 100.

In this embodiment, the construction period priority Gantt chart, budget priority Gantt chart, and environment priority Gantt chart are exemplified as three Gantt chart candidates, but embodiment is also possible wherewith the number of suitable candidates is further increased, making candidates of a Gantt chart that gives priority to both the construction phase and the budget, a Gantt chart that gives priority to both the budget and the environment, and a Gantt chart that gives priority to both the construction phase and the environment, or the like.

The following information incidental to the production of the 3D Gantt chart information 165 is also produced at the server apparatus 11.

Construction project cost estimate information 170 that indicates a rough estimate of costs for the current construction project is produced, using the 3D Gantt chart information 165 and the future expected construction project computation system 163. Also, optimum fleet estimate information 171 that indicates an estimate of the number and types of construction machines needed to complete the current construction project is produced, using the 3D Gantt chart information 165 and the future expected construction project computation system 163. Also, building equipment demand forecast information 172 indicating the building equipment demand forecast in conjunction with the ordering of the current construction project is produced, using the 3D Gantt chart information 165 and the future expected construction project computation system 163. Also, attachment demand forecast information 173 indicating the demand for attachments forecast in conjunction with the ordering of the current construction project is produced, using the 3D Gantt chart information 165 and the future expected construction project computation system 163. Also, parts demand forecast information 176 indicating the demand for parts forecast in conjunction with the ordering of the current construction project is produced, using the 3D Gantt chart information 165 and the future expected construction project computation system 163. Also, service demand forecast information 177 indicating the demand for services forecast in conjunction with the ordering of the current construction project is produced, using the 3D Gantt chart information 165 and the future expected construction project computation system 163. Also, unordered construction project demand forecast information 181 indicating the demand for construction projects not yet ordered by the clients, including the current construction project wherewith the national government 92*d* is to be the client, is produced using the 3D Gantt chart information 165 and the future expected construction project computation system 163. Also, machine purchase and replacement demand forecast information 169 indicating the demand for newly purchased and replacement construction machines forecast in conjunction with the ordering of unordered construction projects by the clients, including the current construction project wherewith the national government 92*d* is to be the client, is produced, using the 3D Gantt chart information 165 and the future expected construction project computation system 163.

All this produced information, namely the construction project cost estimate information 170, the optimum fleet estimate information 171, the building equipment demand forecast information 172, the attachment demand forecast information 173, the service demand forecast information 177, the unordered construction project demand forecast information 181, and the machine purchase and replacement demand forecast information 169, are stored in the database 100.

The construction companies 30A, 50B, 60C, and 70D are authorized to access the unstarted construction work optimal job (3D Gantt chart) information 165 and optimum fleet estimate information 171 stored in the database 100. That being so, when data such as a password are input from one of the terminal devices 48, 58, 68, and 78 of the construction companies 30A, 50B, 60C, and 70D, and the information on construction projects scheduled to be ordered (client demand data) 600*a* is accessed, in addition to that information on construction projects scheduled to be ordered (client demand data) 600*a,* the unstarted construction work optimal job (3D Gantt chart) information 165 corresponding to construction projects scheduled to be ordered and the optimum fleet estimate information 171 are transmitted to the terminal devices 48, 58, 68, and 78 of the construction companies 30A, 50B, 60C, and 70D via a radio communication link 5, communication satellite 3, and radio communication link 5, stored in memory inside those terminal devices, and displayed on display screens.

For that reason, at the construction companies 30A, 50B, 60C, and 70D, it is possible to make judgments easily and quickly as to whether or not a current construction project order should be accepted or not, using the information on construction projects scheduled to be ordered (client demand data) 600*a,* unstarted construction work optimal job (3D Gantt chart) information 165, and optimum fleet estimate information 171 displayed on the display screens.

Here, the 3D Gantt chart information 165 is produced on the basis of the 3D Gantt chart schedule and performance results databases 141A, 141B, 141C, and 141D in the database 100. For that reason, when work is performed following a newly produced Gantt chart, discrepancies between the newly produced scheduled work plan and the actual work performance results can be minimized.

Meanwhile, the national government 92*d,* which is the client, is authorized to access the construction project cost estimate information 170 stored in the database 100. That being so, when data such as a password are input from the terminal device 93*d* of the national government 92*d,* and the construction project cost estimate information 170 is accessed, that construction project cost estimate information 170 is transmitted to the terminal device 93*d* of the national government 92*d* via a radio communication link 5, communication satellite 3, and radio communication link 5, stored in memory inside the terminal device 93*d,* and displayed on a display screen.

Thus the national government 92*d* is able, easily and quickly, to make a decision as to whether or not the current construction project should be ordered.

The manufacturers 80*a,* 80*b,* and 80*c* that are construction machine manufacturing companies are authorized to access the machine purchase and replacement demand forecast information 169 stored in the database 100. That being so, when data such as a password are input from one of the terminal devices 81*a,* 81*b,* and 81*c* of the manufacturers 80*a,* 80*b,* and 80*c* and the machine purchase and replacement demand forecast information 169 is accessed, that machine purchase and replacement demand forecast information 169 is transmitted to the terminal devices 81*a,* 81*b,* and 81*c* of the manufacturers 80*a,* 80*b,* and 80*c* via a radio communication link 5, communication satellite 3, and radio communication link 5, stored in memory inside those terminal devices, and displayed on display screens.

Thus, every time information on a construction project scheduled for ordering is provided from a client, machine purchase and replacement demand forecast information 169 can be acquired by the manufacturers 80*a,* 80*b,* and 80*c,* and, based thereon, plans for producing construction machines at the factories can be revised, and the construction machines needed for future construction projects can be provided to the market quickly.

Thus, at the point in time when 3D Gantt chart information 165 is produced, the construction companies 30A, 50B, 60C, and 70D that undertake the actual work can quickly secure the construction machines needed from the manufacturers 80*a,* 80*b,* and 80*c.* Not only so, but the machine purchase and replacement demand forecast information 169 is produced incidentally to the 3D Gantt chart information 165, and the 3D Gantt chart information 165 itself is produced on the basis of the 3D Gantt chart schedule and performance results databases 141A, 141B, 141C, and 141D in the database 100, and is very accurate information. Hence the numbers and types of construction machines described in the machine purchase and replacement demand forecast information 169 are extremely accurate. Hence the numbers and types of construction machines produced at the factories of the manufacturers 80*a,* 80*b,* and 80*c* on the basis of the machine purchase and replacement demand forecast information 169 will match future construction project demand with very great accuracy.

Thus the manufacturers 80*a,* 80*b,* and 80*c* can revise their factory production plans quickly, easily, and accurately.

The lease company 90*a* that leases construction machines and the rental company 90*b* that rents construction machines are authorized to access the unordered construction project demand forecast information 181 that is stored in the database 100. That being so, when data such as a password are input from a terminal device 91*a* or 91*b* of the lease company 90*a* or rental company 90*b,* and the unordered construction project demand forecast information 181 accessed, the unordered construction project demand forecast information 181 is transmitted to the terminal devices 91*a* and 91*b* of the lease company 90*a* and rental company 90*b* via a radio communication link 5, communication satellite 3, and radio communication link 5, stored in memory inside those terminal devices, and displayed on display screens.

Thus, every time information on a construction project scheduled for ordering is provided from a client, unordered construction project demand forecast information 181 can be acquired by the lease company 90*a* and the rental company 90*b,* whereupon, based thereon, the machines necessary for future lease or rental can be secured so as to be on hand, and the construction machines needed for future construction projects can be provided to the market.

Thus, the construction companies 30A, 50B, 60C, and 70D and the like that perform the actual work, at the point in time when the 3D Gantt chart information 165 is produced, can quickly secure the construction machines that will be needed from the lease company 90*a* and rental company 90*b*. Not only so, but unordered construction project demand forecast information 181 is produced incidentally to the 3D Gantt chart information 165, and the 3D Gantt chart information 165 itself is produced on the basis of the 3D Gantt chart schedule and performance results databases 141A, 141B, 141C, and 141D in the database 100, so it is extremely accurate information. For that reason, the numbers and types of construction machines described in the unordered construction project demand forecast information 181 are very precise. Therefore, the numbers and types of machines secured by the lease company 90*a* and rental company 90*b* based on the unordered construction project demand forecast information 181 will match an actual construction project demand with very great accuracy.

Thus the lease company 90*a* and rental company 90*b* can secure the machines needed to be on hand for future construction projects quickly, easily, and accurately.

The parts depot 20 that supplies construction machine parts to the market and the service point 22 that performs maintenance and other services on the construction machines are, respectively, authorized to access the parts demand forecast information 176 and the service demand forecast information 177 stored in the database 100. That being so, when data such as a password are input from the terminal device 21 or 23 of the parts depot 20 or the service point 22, and the parts demand forecast information 176 and service demand forecast information 177 are accessed, that parts demand forecast information 176 and service demand forecast information 177 are transmitted respectively to the terminal devices 21 and 23 of the parts depot 20 and the service point 22 via a radio communication link 5, communication satellite 3, and radio communication link 5, stored in memory inside those terminal devices, and displayed on display screens.

Thus, at the parts depot 20 and service point 22, respectively, parts demand forecast information 176 and service demand forecast information 177 can be acquired every time information on construction project scheduled to be ordered is presented from a client, and, based thereon, can secure replacement parts and service personnel for the construction machines that will be necessary for future construction work.

The crusher manufacturing company 94*a* and rock drill manufacturing company 94*b* that supply construction machine attachments and the construction material manufacturing company 94*c* that supplies construction equipment, respectively, are authorized access to the attachment demand forecast information 173 and building equipment demand forecast information 172 stored in the database 100. That being so, when data such as a password are input from any of the terminal devices 95*a,* 95*b,* and 95*c* of the crusher manufacturing company 94*a,* rock drill manufacturing company 94*b,* and construction material manufacturing company 94*c,* and the attachment demand forecast information 173 or building equipment demand forecast information 172 is accessed, the attachment demand forecast information 173 or building equipment demand forecast information 172 is transmitted to the terminal devices 95*a,* 95*b,* and 95*c,* respectively, of the crusher manufacturing company 94*a* and rock drill manufacturing company 94*b,* and construction material manufacturing company 94*c,* via a radio communication link 5, communication satellite 3, and radio communication link 5, stored in memory inside the terminal device or devices, and displayed on a display screen or screens.

Thus, at the crusher manufacturing company 94*a* and rock drill manufacturing company 94*b,* or the construction material manufacturing company 94*c,* the attachment demand forecast information 173 or the building equipment demand forecast information 172 can be acquired every time information on a construction project scheduled to be ordered is provided from a client, and, based thereon, those companies can supply the construction machine attachments or construction equipment required for future construction work to the market.

The case is presumed where the construction company 30A has accepted the current construction project order.

The construction companies 30A, 50B, 60C, and 70D that perform construction work using construction machines are authorized to access the machines on hand information 203 and information on attachments or equipment on hand 178 stored in the database 100.

That being so, when a password or the like is input from the terminal device 48 of the construction company 30A that has accepted an order for construction work, and the machines on hand information 203 and information on attachments or equipment on hand 178 stored in the database 100 are accessed, the machines on hand information 203 and the information on attachments or equipment on hand 178 are transmitted to the terminal device 48 of the construction company 30A via a radio communication link 5, communication satellite 3, and radio communication link 5, stored in memory in the terminal device, and displayed on a display screen.

Thus it becomes possible for the construction company 30A to quickly secure the construction machines 31 to 41 required for the ordered construction work from the lease company 90*a* and the rental company 90*b*. It also becomes possible for the construction company 30A to quickly secure the attachments of the construction machines 31 to 41 and construction equipment needed for the ordered construction work from the crusher manufacturing company 94*a,* rock drill manufacturing company 94*b,* and construction material manufacturing company 94*c.*

When the construction machines 31 to 41 needed for the construction work undertaken by the construction company 30A are secured in this manner, 3D Gantt chart information 165 is transmitted from the server apparatus 11 via a radio communication link 5, communication satellite 3, and radio communication link 5 to the terminal device 31*a* of the construction machine 31, from among the construction machines 31 to 41, that will be the leader work machine in construction phase 1 of the construction project, and stored in memory in that terminal device 31*a.*

Thus, as diagrammed in FIG. 7, the 3D Gantt chart information 165 will be displayed on a display screen 301J on the monitor device 300 carried on board the leader work machine 31.

More specifically, the display screen 301J is configured by a display location 320, a select next candidate button 322 for sequentially moving from a candidate 3D Gantt chart currently being displayed in the display location 320 to the next 3D Gantt chart candidate, and a decision button 321 for definitely deciding on the 3D Gantt chart candidate currently being displayed in the display location 320.

Every time the select next candidate button 322 is pressed, the 3D Gantt chart displayed in the display location 320 is sequentially changed from one candidate to the next, that is, from the construction period priority Gantt chart to the budget priority Gantt chart to the environment priority Gantt chart. Thereupon, when the decision button 321 is pressed, the 3D Gantt chart currently being displayed in the display location 320 (the construction period priority Gantt chart, for example) is determined on.

When the 3D Gantt chart is determined, data indicating the determined 3D Gantt chart (the construction period priority Gantt chart, for example) are transmitted from the terminal device 31*a* of the leader work machine 31 to the server apparatus 11 via a radio communication link 5, communication satellite 3, and radio communication link 5, and stored in the 3D Gantt chart schedule and performance results database 141A in the database 100. Thus the "scheduled" data for the 3D Gantt chart schedule and performance results database 141A corresponding to the construction company 30A are updated.

Thus the operator of the leader work machine 31 can also fulfill the role of general site manager in determining Gantt charts.

Figure 10:
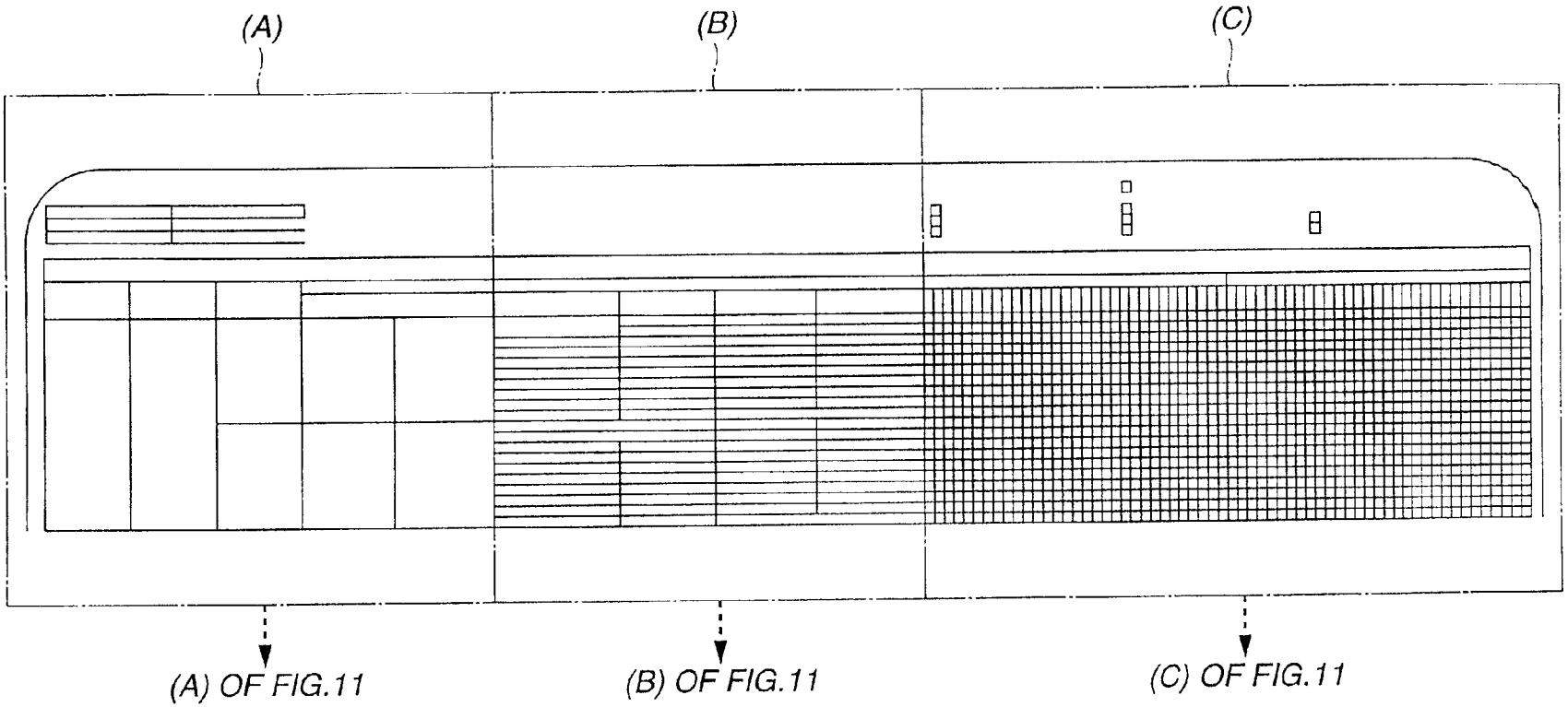
FIG. 10 is a diagram of a Gantt chart in an embodiment.
Figure 11:
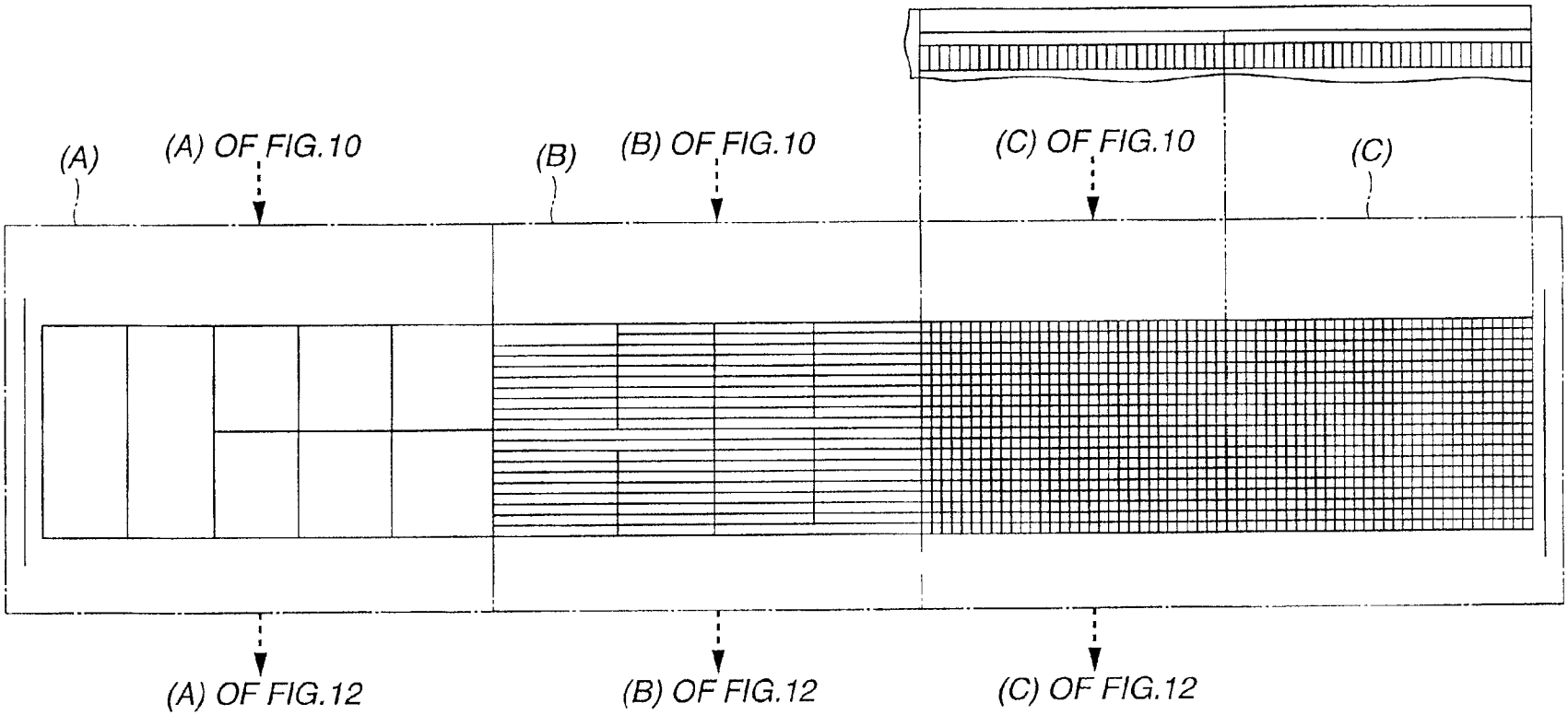
FIG. 11 is a diagram of a Gantt chart in an embodiment.
Figure 12:
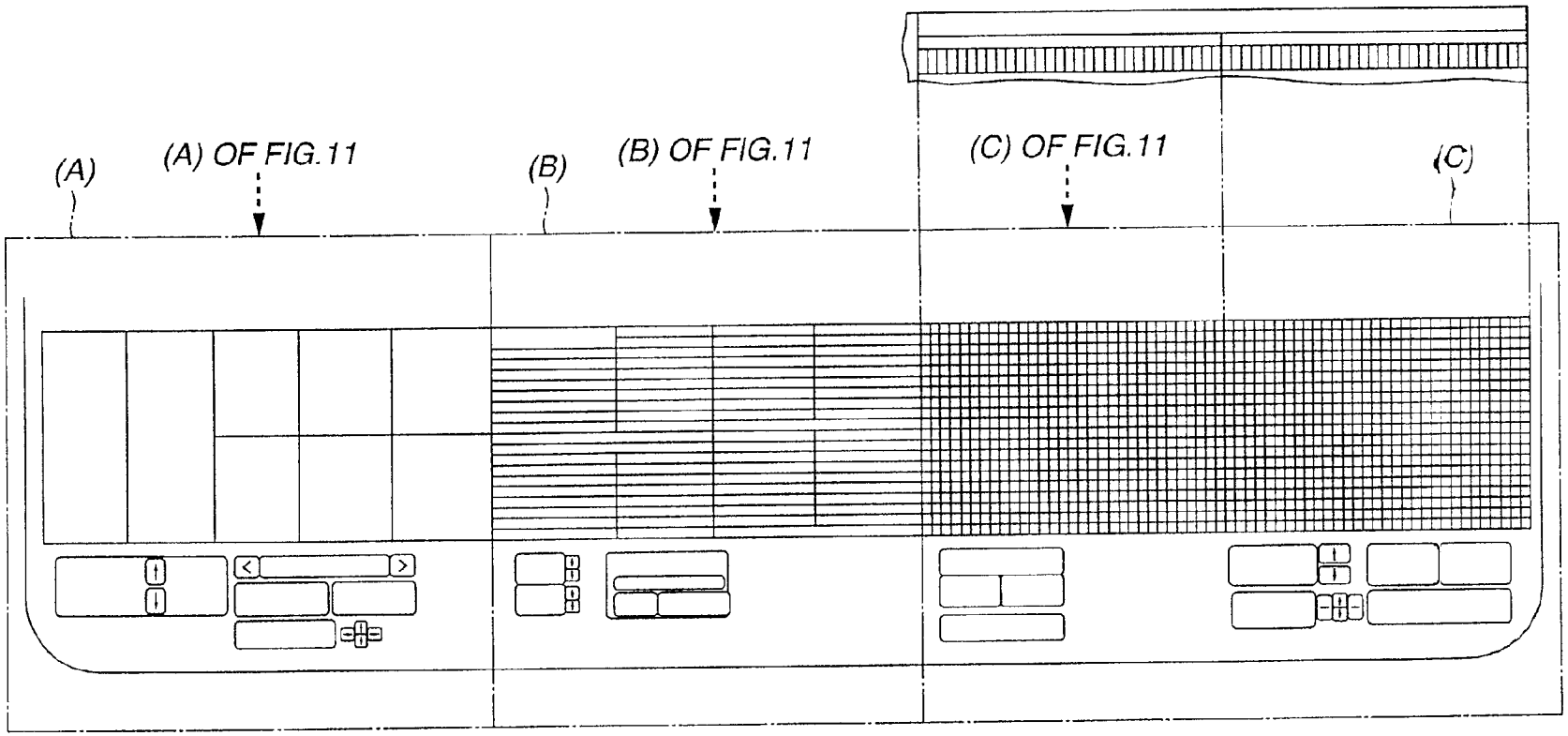
FIG. 12 is a diagram of a Gantt chart in an embodiment.

FIGS. 10, 11, and 12 diagram the display screen 301 in a case where the 3D Gantt chart has been determined. These figures, respectively, represent the display screen 301 cut into three segments in the vertical dimension.

As indicated in these figures, a determined 3D Gantt chart is displayed in the display location 320 of the display screen 301. Various buttons 302 to 318, 321, and 322 for altering the content of the display in the display location 320 are arrayed on the display screen 301.

In the 3D Gantt chart represented in FIGS. 10, 11, and 12, the construction project is divided into construction phase 1, construction phase 2, and construction phase 3. Therein is written a "schedule" that represents the numbers and types of construction machines required for each construction phase, and the number of days required in each construction phase. A "schedule" is written for each construction machine (by the machine number for each machine deployed), and a "schedule" is also written for all of the construction machines combined. In the 3D Gantt chart are entered the construction work "performance results," as the construction project advances, which are compared against the initial "schedule."

Another characteristic of the 3D Gantt chart of this embodiment is that it represents the three-dimensional topography of the construction site, for each "schedule" and "performance result," and for each of the construction phases, namely construction phase 1, construction phase 2, and construction phase 3.

More specifically, graphic representations are made therein, respectively, of the three-dimensional topography of the construction site as "scheduled" before work is begun in construction phase 1, the three-dimensional topography of the construction site as "scheduled" after the completion of construction phase 1, the three-dimensional topography of the construction site as "scheduled" before work is begun in construction phase 2, the three-dimensional topography of the construction site as "scheduled" after the completion of construction phase 2, the three-dimensional topography of the construction site as "scheduled" before work is begun in construction phase 3, and the three-dimensional topography of the construction site as "scheduled" after the completion of construction phase 3.

Also, graphic representations are made therein, respectively, of the three-dimensional topography of the construction site indicating the "performance results" before work is begun in construction phase 1, the three-dimensional topography of the construction site indicating the "performance results" after the completion of construction phase 1, the three-dimensional topography of the construction site indicating the "performance results" before work is begun in construction phase 2, the three-dimensional topography of the construction site indicating the "performance results" after the completion of construction phase 2, the three-dimensional topography of the construction site indicating the "performance results" before work is begun in construction phase 3, and the three-dimensional topography of the construction site indicating the "performance results" after the completion of construction phase 3. Moreover, such indication may be made with actual photographs.

In the 3D Gantt chart information 165, vehicle IDs are given that specify the type, model, and machine number of each of the plurality of construction machines that jointly perform the construction work in each of the construction phases, namely construction phase 1, construction phase 2, and construction phase 3. That is described by referencing FIG. 4 together with FIGS. 10, 11, and 12.

In construction phase 1, the construction machines 31 and 32 of type "D" having the machine numbers "31" and "32," the construction machine 33 of type "P" having the machine number "33," and the construction machines 34 and 35 of type "B" having the machine numbers "34" and "35" are deployed and operated.

In construction phase 2, the construction machines 36, 33, and 37 of type "P" having the machine numbers "36," "33," and "37," the construction machine 38 of type "PU" having the machine number "38," and the construction machine 39 of type "L" having the machine number "39" are deployed and operated.

And in construction phase 3, the construction machine 33 of type "P" having the machine number "33," the construction machine 40 of type "G" having the machine number "40," and the construction machine 41 of type "J" having the machine number "41" are deployed and operated.

The 3D Gantt chart information 165 contains position data P that indicate X-Y two-dimensional positions P(X, Y) at the construction site, and follower-machine 3D Gantt chart information 165'. The position data P here are given as longitude and latitude data, for example. By follower-machine 3D Gantt chart information 165', moreover, is meant Gantt charts whereon are described jobs that are to be done by each individual follower machine. The follower-machine 3D Gantt chart information 165' is transmitted from the terminal device 31*a* of the leader work machine 31 in construction phase 1 to the terminal devices of the follower machines 32, 33, 34, and 35 via radio communication links 6, stored in memory in the terminal devices, and displayed on display screens on the monitor devices 300 carried on board the follower machines.

Each of the operators of the follower machines 32, 33, 34, and 35 in construction phase 1 can perform the work that his or her vehicle is to perform by following the follower-machine 3D Gantt chart information 165' displayed on the display screen of the monitor device 300 in that vehicle.

While construction work is being carried on in construction phase 1, the operator of the leader work machine 31 checks the progress of the work being done by his or her own vehicle 31 and by the follower machines 32 to 35 based on the content displayed on the display screen 301 represented in FIGS. 10, 11, and 12. If the work is delayed, that operator instructs the follower machines 32 to 35 via the radio communication links 6 to make up for that delay. The operator of the leader work machine 31 also informs the follower machines 32 to 35 of operating ranges, via the radio communication links 6, based on the content displayed on the display screen 301 indicated in FIGS. 10, 11, and 12.

In this manner, the operator of the leader work machine 31 is able to fulfill the role also of a general site foreman who oversees the progress of the work of the plurality of construction machines 31 to 35.

The operator of the leader work machine 31 also checks the progress of the work done by his or her own vehicle 31 and by the follower machines 32 to 35, based on the content displayed on the display screen 301 diagrammed in FIGS. 10, 11, and 12, compares the initial "schedule" and "performance results" indicated in the Gantt chart, and, when the work is not progressing according to the initial schedule, judges whether or not additional construction machines should be deployed to make up the work delay.

The leader work machine 31 is authorized to access the machines on hand information 203 stored in the database 100.

That being so, when a password or the like is input from the terminal device 31*a* of the leader work machine 31, and the machines on hand information 203 stored in the database 100 is accessed, the machines on hand information 203 is transmitted to the terminal device 31*a* of the leader work machine 31 via a radio communication link 5, communication satellite 3, and radio communication link 5, stored in memory inside the terminal device, and displayed on a display screen.

Thereupon, the operator of the leader work machine 31 inputs data from the terminal device 31*a* containing a request for vehicle deployment, and requests that the construction machines needed to make up the work delay be deployed. When the type of construction machine is to be changed (or added), a type change button 309, indicated in FIG. 12, is pressed. When the machine number of a construction machine is to be changed (or added), the machine number change button 310 in FIG. 12 is pressed.

Data for requesting vehicle deployment are transmitted to the terminal devices 91*a* and/or 91*b* of the lease company 90*a* and/or rental company 90*b* via a radio communication link 5, communication satellite 3, and radio communication link 5. Thus the needed construction machines are quickly deployed at the construction site.

Thus the operator of the leader work machine 31 also fulfills the role of a general site manager in making arrangements for the deployment of vehicles.

When an anomaly has occurred at the construction site, the Gantt chart is automatically revised by the server apparatus 11, based on anomaly occurrence data (revised Gantt chart production request information) 600*b* as will be described below.

By anomaly, here, is meant such an anomalous situation as unscheduled maintenance u performed on a construction machine, a trouble correction v that corrects a failure or other trouble arising in a construction machine, a weather condition change w, and a client demand change x (change in construction period, discovery of historic remains, etc.).

These anomaly occurrence data (revised Gantt chart production request information) 600*b* may be input directly by the operator of the leader work machine 31 from the terminal device 31*a* and transmitted to the server apparatus 11, or they may be transmitted to the server apparatus 11 automatically as will be described subsequently with reference to FIG. 5 and FIG. 6. For weather information, detailed weather information for each region can be acquired in the form of regional specific detailed weather information 175 from the database 26 of a weather forecasting company 24 via the internet 1. If the regional specific detailed weather information 175 is used, unlike with the region-specific weather statistics database 111, extremely short-range weather forecasts (that a typhoon will reach land in two or three days hence, for example) can be obtained.

When the anomaly occurrence data 600*b* are transmitted to the server apparatus 11, as described earlier, in steps 701, 702, and 703, based on the client demand data 600*a*, a Gantt chart corresponding to a construction project similar to the current construction project is selected (step 701), the selected Gantt chart is revised according to the regional characteristics (step 702), the Gantt chart is further revised according to the construction period s, budget r, and environmental considerations t, and a construction period priority Gantt chart, budget priority Gantt chart, and environment priority Gantt chart, respectively, are produced as Gantt chart candidates (step 703).

The construction project-specific optimized 3D Gantt chart production system 110 has an inclement weather daily schedule revision data extraction system 707. This inclement weather daily schedule revision data extraction system 707 is a system that revises the daily schedules written in Gantt charts, according to weather condition changes w, so that the construction work can be completed within the construction period s.

Thereupon, the inclement weather daily schedule revision data extraction system 707 revises the daily schedules written in Gantt charts, in response to weather condition changes w, so that construction work can be completed with the construction period s (step 704).

Next, the similar construction work selection system 706 retrieves information on past construction work for which the Gantt chart was revised according to unscheduled maintenance u, trouble correction v, or client demand change x, from 3D Gantt chart schedule and performance results databases 141A, 141B, 141C, and 141D, and revises the Gantt chart, in response to current unscheduled maintenance u, trouble correction v, or client demand change x, so that the construction work is completed within the construction period s (step 705).

Thus data indicating the revised Gantt charts, namely the construction period priority Gantt chart, budget priority Gantt chart, and environment priority Gantt chart, are produced as revised 3D Gantt chart data 166*b*.

As is described subsequently with reference to FIG. 5 and FIG. 6, data indicating a handling proposal for handling an anomalous situation such as maintenance or trouble correction are produced as anomaly occurrence handling data 166*a*.

The anomaly occurrence handling data 166*a* and the revised 3D Gantt chart data 166*b* are transmitted as anomaly handling proposal and revised Gantt chart proposal information 166 from the server apparatus 11 to the terminal device 31*a* of the leader work machine 31 via a radio communication link 5, communication satellite 3, and radio communication link 5, and stored in memory in the terminal device 31*a*.

Thus, as diagrammed in FIG. 7, the anomaly handling proposal and revised Gantt chart proposal information 166 is displayed on a display screen 301K of the monitor device 300 carried on board the leader work machine 31.

More specifically, the display screen 301K is configured by a display location 320 where the anomaly handling proposal and revised 3D Gantt chart candidate are displayed, a select next candidate button 322 for sequentially moving from a candidate 3D Gantt chart currently being displayed in the display location 320 to the next 3D Gantt chart candidate, and a decision button 321 for definitely deciding on the 3D Gantt chart candidate currently being displayed in the display location 320.

First, on the display screen 301K, the anomaly handling proposal based on the anomaly occurrence handling data 166*a* is displayed. As described subsequently with reference to FIG. 5 and FIG. 6, the operator judges, from the content displayed on the display screen 301K, whether or not the construction work should be continued as is in view of an anomalous situation such as trouble correction, maintenance, weather, or change in client demands (discovery of historic remains, etc.). In cases where the level of importance of performing maintenance or trouble correction is low, for example, a decision is made not to adopt a revised Gantt chart. In such cases, the operator of the leader work machine 31 will direct the progress of the plurality of work machines 31 to 35 so that the construction work is carried on according to the pre-revision Gantt chart.

Thus the operator of the leader work machine 31 also fulfills the role of a general site foreman who judges whether or not to continue construction work as is in the face of an anomalous situation such as unscheduled maintenance.

In cases where the level of importance of the maintenance or trouble correction is high, on the other hand, a decision is made to adopt a revised Gantt chart, and the display screen 301K of the monitor device 300 is changed from the state wherein the anomaly handling proposal is displayed to one wherein the revised Gantt chart is displayed.

Every time the select next candidate button 322 is pressed, the revised 3D Gantt chart displayed in the display location 320 changes sequentially from the construction period priority Gantt chart to the budget priority Gantt chart to the environment priority Gantt chart. Thereupon, when the decision button 321 is pressed, the revised 3D Gantt chart (say the construction period priority Gantt chart, for example) being displayed currently in the display location 320 is determined on.

When the revised 3D Gantt chart is determined on, the display content diagrammed in FIGS. 10, 11, and 12 changes from that prior to revision to the content of the Gantt chart determined on after revision.

Data indicating the determined 3D Gantt chart (the construction period priority Gantt chart, for example) are transmitted from the terminal device 31*a* of the leader work machine 31 to the server apparatus 11 via a radio communication link 5, communication satellite 3, and radio communication link 5 and stored in the 3D Gantt chart schedule and performance results database 141A in the database 100. Thus the "scheduled" data of the 3D Gantt chart schedule and performance results database 141A corresponding to the construction company 30A are updated.

In this manner, the operator of the leader work machine 31 can also fulfill the role of a general site manager who revises Gantt charts.

The number of construction machines noted in the revised Gantt chart is sometimes a greater number than that noted in the Gantt chart prior to revision.

Thereupon, when a password or the like is input from the terminal device 31*a* of the leader work machine 31 and the machines on hand information 203 stored in the database 100 is accessed, the machines on hand information 203 is transmitted to the terminal device 31*a* of the leader work machine 31 via a radio communication link 5, communication satellite 3, and radio communication link 5, stored in memory in the terminal device, and displayed on a display screen.

Thereupon, if the operator of the leader work machine 31 enters vehicle deployment request data from the terminal device 31*a*, in like manner as described earlier, the required number of construction machines can be quickly secured from the lease company 90*a* and/or rental company 90*b*.

In this manner, the operator of the leader work machine 31 can also fulfill the role of a general site manager who makes arrangements for the deployment of vehicles in accordance with revised Gantt charts.

The revised 3D Gantt chart proposal information 166 comprises follower-machine 3D Gantt chart information 165'. The follower-machine 3D Gantt chart information 165' is transmitted from the terminal device 31*a* of the leader work machine 31 in construction phase 1 to the terminal devices of the follower machines 32, 33, 34, and 35 via the radio communication links 6, stored in memory in the terminal devices, and displayed on display screens in the monitor devices 300.

In this manner, the operator of the leader work machine 31, in cases where the Gantt chart is revised, is able to fulfill the role also of a general site manager in informing the operators of affected construction machines that there has been a revision so that the work can be performed according to the revised content of the revised Gantt chart.

Thereafter, the operators of the follower machines 32, 33, 34, and 35 in construction phase 1 can accomplish the work that should be performed by their vehicles in accordance with the follower-machine 3D Gantt chart information 165' displayed on the display screen of the monitor device 300 in each of their own vehicles.

While construction work is being carried on in construction phase 1, the operator of the leader work machine 31 checks the progress of the work being done by his or her own vehicle 31 and by the follower machines 32 to 35 based on the content displayed on the display screen 301 represented in FIGS. 10, 11, and 12. If the work is delayed, that operator instructs the follower machines 32 to 35 via the radio communication links 6 to make up for that delay. The operator of the leader work machine 31 also informs the follower machines 32 to 35 of operating ranges, via the radio communication links 6, based on the content displayed on the display screen 301 indicated in FIGS. 10, 11, and 12.

A case where a Gantt chart is revised is now described specifically with reference to FIGS. 10, 11, and 12.

The "initial plan" for a construction phase 1 called for starting the construction work on August 2 and finishing it on August 20. According to the long-range regional weather forecast (regional specific weather statistics database 111), it was to be "raining" on August 18. According to the regional specific detailed weather information 175, however, "rain" was forecast for August 11, wherefore a change was made to a "revised plan" according to which operations would be suspended on August 11 but carried on on the holidays August 14 and August 21. In FIG. 10 here, operating days in the modified plan, and days on which the plan progressed according to schedule, respectively, are indicated by being blacked out. As indicated in FIG. 10, moreover, when operations were implemented according to the modified plan, construction phase 1 was completed according to the initial daily schedule.

In the foregoing, the operations of the leader work machine 31 and the follower machines 32 to 35 in construction phase 1 are described, but the leader work machine 36 and follower machines 33, 37, 38, and 39 in construction phase 2, and the leader work machine 33 and the follower machines 40 and 41 in construction phase 3 operate in like manner.

Figure 5:
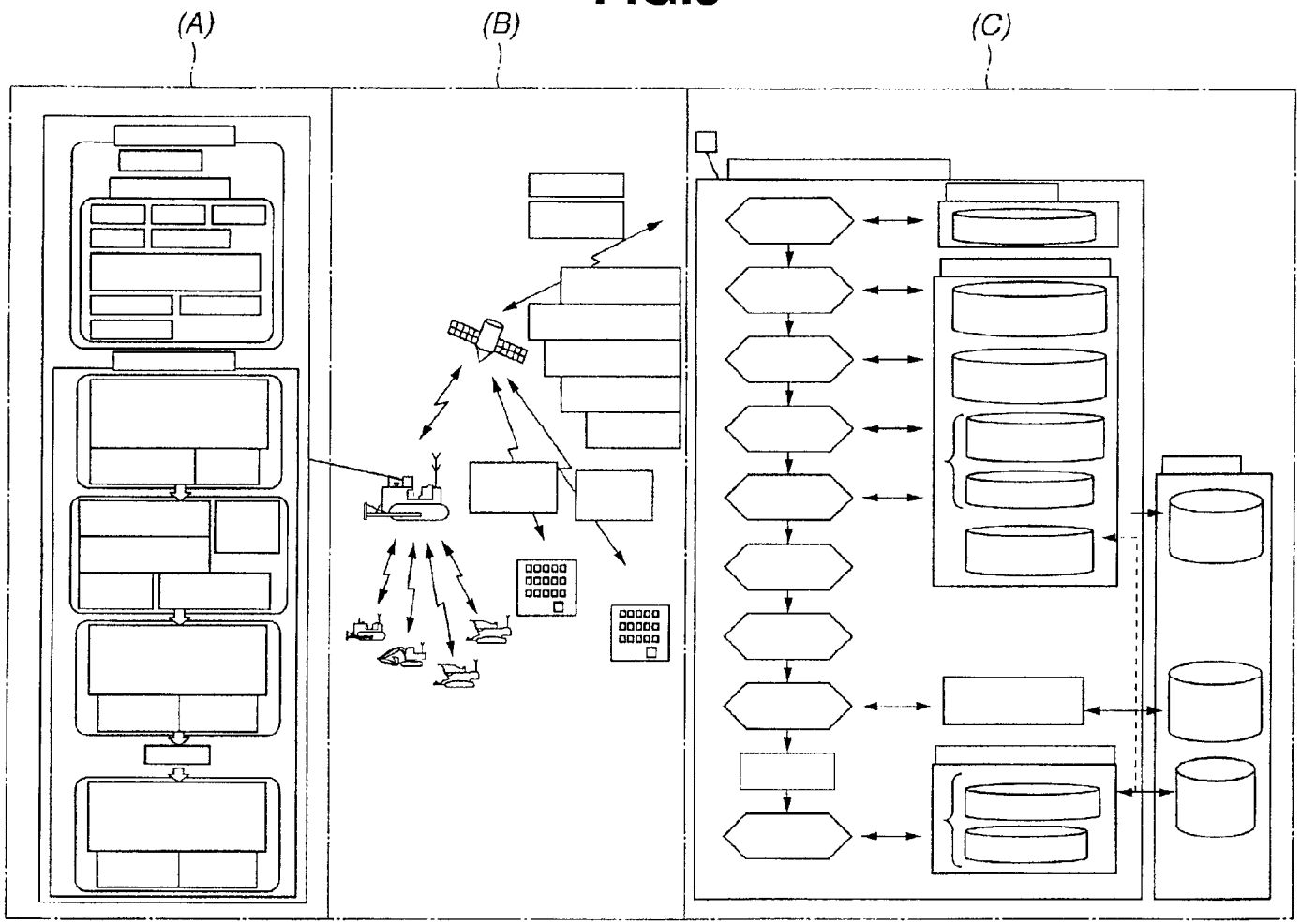
FIG. 5 is a diagram of processing procedures for when an unscheduled maintenance time arrives for a construction machine.

Next, a specific description is given of the content of processing done when the anomaly of the arrival of an unscheduled maintenance time occurs during construction work, making reference to FIG. 5.

Vehicle condition data 200*b*, namely hydraulic pressure a, oil temperature b, water temperature c, stress d, engine r.p.m. e, lever control input signals f, hour meter time elapsed g, vehicle position h, and vehicle inclination angle k, are detected by sensor groups provided in the follower machines 32 to 35.

The vehicle condition data 200*b* detected in the follower machines 32 to 35 are transmitted together with the vehicle ID data 200*s* to the leader work machine 31 via a radio communication link 6.

The vehicle ID data and vehicle condition data 200 detected at the plurality of follower machines 32 to 35, together with the vehicle ID data and vehicle condition data 200 detected at the leader work machine 31, are transmitted from the fan 31*a* of the leader work machine 31 to the server apparatus 11 via a radio communication link 5, communication satellite 3, and radio communication link 5.

A description is now given assuming the case where a time for unscheduled maintenance has arrived in the follower machine 35.

In the server apparatus 11, when the vehicle ID data 200*a* for the follower machine 35 are transmitted, the type "B" and model "model 1" corresponding to the vehicle ID data 200*a* (B-35) are read out from the machine type and model specific machine number database 160. It is assumed here that an association has been effected in the machine type and model specific machine number database 160 such that the machine number "35" corresponds to the model "model 1" (step 401).

Next, the standard condition data corresponding to the type "B" and the model "model 1" are read out from the machine specific standard condition data database 151. Next, a comparison is made between the standard condition data so read out, and the vehicle condition data 200*b* for the follower machine 35 associated with the vehicle ID data 200*a* (B-35) for the follower machine 35, and a judgment is made as to whether the vehicle condition is normal or anomalous.

The content of the standard condition data is exemplified in FIG. 17(*a*).

In the standard condition data indicated in FIG. 17(*a*), standard values for the sensor detection values a, b, c, d, e, and g for every lever control signal f1, f2, and f3, that is, every work condition f1, f2, and f3, are set. When the work condition is f1, for example, the condition is judged to be anomalous if any one of the sensor detection values a, b, c, d, e, or g is equal to or greater (or equal to or less than, depending on the sensor type) than a1, b1, c1, d1, e1, or g1 respectively, but is otherwise judged to be normal (step 402).

As a result of the judgment made in step 402, when the condition is "anomalous," a further judgment is made as to whether or not it is possible to continue operating without performing maintenance.

Specifically, the limiting condition data corresponding to the type "B" and the model "model 1" are read out from the machine specific limiting condition data database 156. Next, a comparison is made between the limiting condition data so read out, and the vehicle condition data 200*b* for the follower machine 35 associated with the vehicle ID data 200*a* (B-35) for the follower machine 35, and a judgment is made as to whether or not it is possible to continue operating without performing maintenance. In this case, the sensor detection values and the limiting condition data are compared in the same manner as in FIG. 17(*a*) (step 403).

When the judgment made in step 403 is to the effect that "continued operation impossible," processing is done next to specify the maintenance location and retrieve three-dimensional shape data on the maintenance location.

That is, maintenance failure fatality level data corresponding to the type "B" and the model "model 1" are read out from the maintenance failure fatality level database 157. Next, a comparison is made between the maintenance failure fatality level data so read out, and the vehicle condition data 200*b* for the follower machine 35 associated with the vehicle ID data 200*a* (B-35) for the follower machine 35, and the maintenance location is specified.

In FIG. 17(*b*) is exemplified the content of maintenance failure fatality level data that specifies "engine oil filter replacement" as the maintenance location.

In the maintenance failure fatality level data, as diagrammed in FIG. 17(*b*), standard values for the specified sensor detection values a, b, e, and g are established for each lever control input signal f4, f5, and f6, that is, for each work condition f4, f5, and f6. When the work condition is f4, for example, the judgment "oil filter replacement necessary" is made when any of the specified detection values a, b, e, or g is equal to or greater (or equal to or less than, depending on the sensor type) than the standard value a4, b4, e4, or g4 respectively, but is otherwise judged to be normal (step 402); otherwise the judgment "oil filter replacement unnecessary" is made. Similar judgments are made for the other maintenance locations, and locations where maintenance should be performed are specified. When, as a result, the judgment "oil filter replacement necessary" is made, three-dimensional shape (3D) data for the maintenance location (vicinity of where the engine oil filter is attached) and for the replacement part (oil filter) are read out from the 3D parts shape database 161 (step 404).

Next, when it is necessary to replace a part in performing the maintenance, data on whether or not that part is in inventory in a warehouse of the construction company 30A that is in possession of the follower machine 35 are retrieved from data stored in the internal company 30A parts inventory database 143A, and that part is requisitioned (step 405).

If the part is not in inventory in the warehouse of the construction company 30A, data requesting a confirmation of the warehouse search for the part and the date and time of part arrival are transmitted from the server apparatus 11 to the terminal device 21 of the parts depot 20 via a radio communication link 5, communication satellite 3, and radio communication link 5, the availability of the part and the date and time of part arrival are queried, and the part is requisitioned. As a result, from the terminal device 21 of the parts depot 20, data indicating the results of the search for the part (parts inventory, parts arrival date) are transmitted to the server apparatus 11 via a radio communication link 5, communication satellite 3, and radio communication link 5 (step 406).

Next, data requesting the date and time of the arrival of service personnel at the construction site, and the repair time (from arrival at construction site to completion of repairs) are transmitted from the server apparatus 11 to the terminal device 23 of the service point 22 via a radio communication link 5, communication satellite 3, and radio communication link 5, and the date and time of arrival of the service personnel and the repair time are queried. As a result, data indicating the results of the retrieval of the date and time of arrival of the service personnel and the repair time are transmitted from the terminal device 23 of the service point 22 to the server apparatus 11 via a radio communication link 5, communication satellite 3, and radio communication link 5 (step 407).

In steps 405, 406, and 407, a part value corresponding to the type "B" and model "model 1" replacement part "oil filter" is read out from the service parts price database 132. Also, the service fees corresponding to the type "B" and model "model 1" replacement part "oil filter" are read out from the service fee database 131. By service fees, here, are meant fees that include both the fees for dispatching service personnel established according to the distance from the service point 22 to the construction site, and the labor cost required for the repair (part replacement). Also, the maintenance time required (repair time) corresponding to the type "B" and model "model 1" replacement part "oil filter" is read out from the maintenance time required data database 158. By maintenance time required (repair time) here is meant the time required for the repair (part replacement) at the construction site.

Next, taking the maintenance time required (repair time) into consideration, the initial 3D Gantt chart is revised in the same manner as described for step 705 in FIG. 7.

That is, the similar construction work selection system 706, in like manner as in step 705 in FIG. 7, retrieves data on past construction work wherein the Gantt chart was revised by unscheduled maintenance u (oil filter replacement) from data stored in the 3D Gantt chart schedule and performance results databases 141A, 141B, 141C, and 141D, and revises the Gantt chart, according to the current unscheduled maintenance u, so that the construction work is completed within the construction period s (step 408).

Thus data indicating revised Gantt charts for the construction period priority Gantt chart, budget priority Gantt chart, and environment priority Gantt chart are produced as revised 3D Gantt chart data 166*b*.

Also, data indicating a handling proposal for handling the anomalous situation constituted by unscheduled maintenance are produced as anomaly occurrence handling data 166*a*.

The anomaly occurrence handling data 166*a* are configured by required maintenance location 3D shape data 166*c* indicating the three-dimensional shapes of maintenance locations acquired in steps 404 to 407, requisitioned part 3D shape and part arrival date and time data 167*a* indicating the three-dimensional shape of requisitioned parts and the date and time the parts are to arrive, service personnel arrival date and time and repair time data 167*b* indicating the date and time service personnel will arrive at the construction site and the time required for repair, and parts price and service cost data 182 indicating the prices of parts and service fees. These anomaly occurrence handling data 166*a* and revised 3D Gantt chart data 166*b* indicating revised three-dimensional Gantt charts are transmitted from the server apparatus 11 to the terminal device 31*a* of the leader work machine 31 via a radio communication link 5, communication satellite 3, and radio communication link 5, and stored in memory in the terminal device 31*a*.

Therefore, in the display location 320 on the display screen 301A of the monitor device 300 carried on board the leader work machine 31 is displayed the three-dimensional shape of the location where maintenance is required (the vicinity of where the engine oil filter is attached), based on the required maintenance location 3D shape data 166*c*, as diagrammed in FIG. 5. From that display content, the operator can judge whether or not maintenance should be performed immediately.

The operator of the leader work machine 31 decides, from the content displayed on the display screen 301A, whether or not maintenance should be performed immediately and the construction work continued according to a revised Gantt chart. When it is decided that maintenance should be performed immediately, the decision button 321 on the display screen 301A is pressed. When it is decided that further study is required, the select next candidate button 322 on the display screen 301A is pressed.

As a result, the display screen 301A transitions to the display screen 301B.

In the display location 320 on the display screen 301B are displayed the three-dimensional shape of the requisitioned part and the date and time the requisitioned part is to arrive at the construction site, based on the requisitioned part 3D shape and part arrival date and time data 167*a*, and the date and time service personnel are to arrive at the construction site, and the repair time, based on the service personnel arrival date and time and repair time data 167*b*, and the price of the part and the service cost, based on the parts price and service cost data 182. The operator, from that displayed content, can make a more careful decision as to whether or not maintenance should be performed immediately.

The operator of the leader work machine 31 decides, from the content displayed on the display screen 301B, whether or not maintenance should be performed immediately and the construction work continued according to a revised Gantt chart. When it is decided that maintenance should be performed immediately, the decision button 321 on the display screen 301B is pressed. When it is decided that further study is required, the select next candidate button 322 on the display screen 301B is pressed.

As a result, the display screen 301B transitions to the display screen 301C.

In the display location 320 on the display screen 301C, the revised 3D Gantt chart candidate is displayed, based on the revised 3D Gantt chart data 166*b*. Every time the select next candidate button 322 is pressed, the revised 3D Gantt chart candidate currently being displayed in the display location 320 changes sequentially to the next revised 3D Gantt chart candidate. When the revised 3D Gantt chart currently displayed in the display location 320 is to be definitely determined on, the decision button 321 is pressed.

When the decision button 321 is pressed, data instructing that maintenance is to be performed are transmitted from the terminal device 31*a* of the leader work machine 31 to the server apparatus 11 via a radio communication link 5, communication satellite 3, and radio communication link 5. From the server apparatus 11, data instructing the requisitioning of a part are transmitted to the terminal device 21 of the parts depot 20 via a radio communication link 5, communication satellite 3, and radio communication link 5, and data instructing the requisitioning of service personnel are transmitted to the terminal device 23 of the service point 22 via a radio communication link 5, communication satellite 3, and radio communication link 5. Thus the parts and the service personnel will arrive at the construction site, and maintenance will be performed on the construction machine 35. In cases where it is impossible to make the repair at the construction site, the construction machine will be conveyed to the repair shop and the repair made there (step 409).

When the maintenance is finished, the parts depot 20 and service point 22 compute the parts price and service costs. Then, from the terminal device 21 of the parts depot 20, data requesting the parts price, and from the terminal device 23 of the service point 22, data requesting the service cost are input, and transmitted to the server apparatus 11 via a radio communication link 5, communication satellite 3, and radio communication link 5. At the server apparatus 11, the prices of parts are retrieved based on data stored in the machine specific service parts price database 132, service costs are retrieved based on data stored in the service fee database 131, and those data are transmitted to the terminal device 21 of the parts depot 20 and the terminal device 23 of the service point 22 via a radio communication link 5, communication satellite 3, and radio communication link 5. Thus the service company 20' (parts depot 20, service point 22) can easily and quickly acquire parts prices and service costs by accessing the database 100 in the server apparatus 11.

Thereupon, data requesting a parts price from the construction company 30A are input to the terminal device 21 of the parts depot 20, and data requesting repair particulars and service costs from the construction company 30A are input to the terminal device 23 of the service point 22. These data are transmitted to the server apparatus 11 via a radio communication link 5, communication satellite 3, and radio communication link 5. The server apparatus 11 transmits those data to the terminal device 31*a* of the leader work machine 31 via a radio communication link 5, communication satellite 3, and radio communication link 5, and stores those data in memory in the terminal device 31*a*.

Thus, in the display location 320 on the display screen 301D of the monitor device 300 carried on board the leader work machine 31, the repair particulars and invoice amount (parts prices and service costs) are displayed.

When the operator has received those display contents and indicated an intent to pay (acceptance possible), button 321 is pressed. If there are troubles with the content displayed and receipt is not possible (acceptance not possible), button 322 is pressed.

When button 322 is pressed on the display screen 301D, data indicating acceptance not possible are input to the terminal device 31*a* of the leader work machine 31 and transmitted to the server apparatus 11 via a radio communication link 5, communication satellite 3, and radio communication link 5. The server apparatus 11 transmits those data to the terminal device 21 of the parts depot 20 and the terminal device 23 of the service point 22 via a radio communication link 5, communication satellite 3, and radio communication link 5. Thereupon, the parts depot 20 and service point 22 review the parts prices and service costs and transmit the parts prices and service costs obtained as a result, in the same manner as before, to the terminal device 31*a* of the leader work machine 31 via the server apparatus 11.

When button 321 on the display screen 301D is pressed, data indicating acceptance possible are input to the terminal device 31*a* of the leader work machine 31 and transmitted to the server apparatus 11 via a radio communication link 5, communication satellite 3, and radio communication link 5. The server apparatus 11 performs processing, by means of electronic settlement, to withdraw funds in payment of fees from a designated account of the construction company 30A and transfer the withdrawn funds in payment of fees to a designated account of the service company 20'.

The server apparatus 11 stores service history data indicating maintenance content (parts replacement, repair particulars) and invoice amounts (parts prices, service costs) in the 30A company service history database 142A, and updates the content stored in the 30A company service history database 142A. In this manner, service history data are stored, categorized by construction company, i.e. whether for construction company 30A, 50B, 60C, or 70D, by type and model of construction machine, and by particulars of construction work (step 410). The processing performed in steps 401 to 410 was described representatively for the follower machine 35, but that processing is performed in the same manner for the other construction machines 31 and 32 to 34.

Thus the operator of the leader work machine 31, when maintenance has been performed, is able to fulfill also the role of office manager (labor manager) in performing processing to settle invoices for the costs of such maintenance, and take measures to transfer funds to the proper parties.

The operator of the leader work machine 31, furthermore, from the content displayed on the display screen 301A, 301B or 301C, can decide to continue the construction work as is without revising the Gantt chart for the anomalous situation constituted by unscheduled maintenance.

In a case where there is but little time remaining until a construction phase is completed and the level of importance of the maintenance is low, for example, he or she can decide not to employ a revised Gantt chart. In that case, the operator of the leader work machine 31 would direct the work progress of the plurality of work machines 31 to 35 so that the construction work is carried on according to the Gantt chart prior to revision.

Thus the operator of the leader work machine 31 is able also to fulfill the role of a general site foreman in deciding whether or not to continue the construction work as is in the face of unscheduled maintenance.

When the decision button 321 on the display screen 301C is pressed, the revised 3D Gantt chart is determined on, and the display content diagrammed in FIGS. 10, 11, and 12 is changed from the content of that prior to revision to the content of the Gantt chart after revision.

Data indicating the determined 3D Gantt chart (such as the construction period priority Gantt chart, for example) are transmitted from the terminal device 31*a* of the leader work machine 31 via a radio communication link 5, communication satellite 3, and radio communication link 5, and stored in the 3D Gantt chart schedule and performance results database 141A of the database 100.

The "scheduled" data in the 3D Gantt chart schedule and performance results database 141A corresponding to the construction company 30A is thereby updated.

Thus the operator of the leader work machine 31 is able also to fulfill the role of a general site manager in revising Gantt charts.

The number of construction machines noted in the revised Gantt chart is sometimes a greater number than that noted in the Gantt chart prior to revision.

Thereupon, when a password or the like is input from the terminal device 31*a* of the leader work machine 31 and the machines on hand information 203 stored in the database 100 is accessed, the machines on hand information 203 is transmitted to the terminal device 31*a* of the leader work machine 31 via a radio communication link 5, communication satellite 3, and radio communication link 5, stored in memory in the terminal device, and displayed on a display screen.

Thereupon, if the operator of the leader work machine 31 enters vehicle deployment request data from the terminal device 31*a,* in like manner as described earlier, the required number of construction machines can be quickly secured from the lease company 90*a* and/or rental company 90*b.*

In this manner, the operator of the leader work machine 31 can also fulfill the role of a general site manager who makes arrangements for the deployment of vehicles in accordance with revised Gantt charts.

The revised 3D Gantt chart proposal information 166 comprises follower-machine 3D Gantt chart information 165'. The follower-machine 3D Gantt chart information 165' is transmitted from the terminal device 31*a* of the leader work machine 31 in construction phase 1 to the terminal devices of the follower machines 32, 33, 34, and 35 via the radio communication links 6, stored in memory in the terminal devices, and displayed on display screens in the monitor devices 300.

In this manner, the operator of the leader work machine 31, in cases where the Gantt chart is revised, is able to fulfill the role also of a general site manager in informing the operators of related construction machines that there has been a revision so that the work can be performed according to the revised content of the revised Gantt chart.

Thereafter, the operators of the follower machines 32, 33, 34, and 35 in construction phase 1 can accomplish the work that should be performed by their vehicles in accordance with the follower-machine 3D Gantt chart information 165' displayed on the display screen of the monitor device 300 in each of their own vehicles.

While construction work is being carried on in construction phase 1, the operator of the leader work machine 31 checks the progress of the work being done by his or her own vehicle 31 and by the follower machines 32 to 35 based on the content displayed on the display screen 301 represented in FIGS. 10, 11, and 12. If the work is delayed, that operator instructs the follower machines 32 to 35 via the radio communication links 6 to make up for that delay. The operator of the leader work machine 31 also informs the follower machines 32 to 35 of operating ranges, via the radio communication links 6, based on the content displayed on the display screen 301 indicated in FIGS. 10, 11, and 12.

In the foregoing, the operations of the leader work machine 31 and the follower machines 32 to 35 in construction phase 1 are described, but the leader work machine 36 and follower machines 33, 37, 38, and 39 in construction phase 2, and the leader work machine 33 and the follower machines 40 and 41 in construction phase 3 operate in like manner.

With reference to FIGS. 10, 11, and 12, judgment examples for cases where an anomalous situation constituted by unscheduled maintenance has occurred are described specifically.

EXAMPLE 1

The "initial plan" for a construction phase 1 calls for starting the construction work on August 2 and finishing it on August 20. Thereupon, information to the effect that maintenance is to be performed on the follower machine 35 on August 19 is transmitted to the leader work machine 31. However, August 19 is right before construction phase 1 is to be completed, and the follower machine 35 is a construction machine that is not scheduled for operation in construction phase 2 or construction phase 3, wherefore the operator of the leader work machine 31 decided not to perform maintenance on the follower machine 35 during construction phase 1. Hence construction phase 1 was completed according to the initial plan.

EXAMPLE 2

The "initial plan" for construction phase 2 calls for starting the construction work on August 16 and finishing it on September 10. According to the long-range regional weather forecast (regional specific weather statistics database 111), it was to be "raining" on August 18. According to the regional specific detailed weather information 175, however, "rain" was forecast for August 19 and September 2, wherefore a change was made to a "revised plan" according to which operations would be suspended on August 19 and September 2 but carried on on the holiday August 22. Thereupon, information that maintenance is to be performed on the follower machine 39 on August 19 was transmitted to the leader work machine 36. August 19 was a non-operating day on which "rain" was forecast, wherefore the judgment was made that maintenance could be performed on the follower machine 39 without affecting the job, and that maintenance was performed. Thus construction phase 2 work was carried on according to the revised plan without the daily schedule being delayed.

Figure 6:
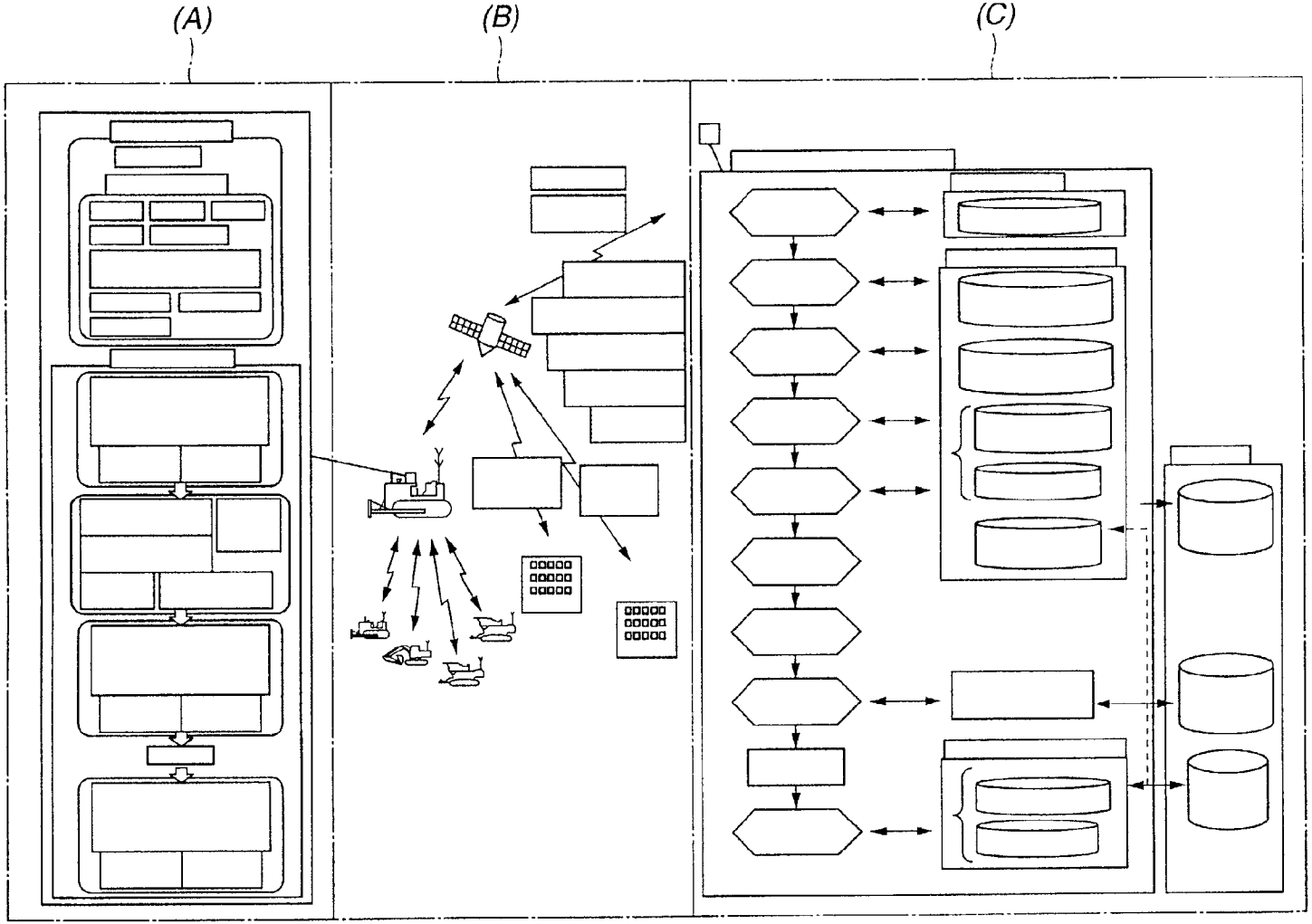
FIG. 6 is a diagram of processing procedures for when a failure or other trouble occurs in a construction machine.

Next, with reference to FIG. 6, the content of processing performed in a case where the anomaly of having to correct a trouble during the construction work has occurred is described specifically.

Vehicle condition data 200*b,* namely hydraulic pressure a, oil temperature b, water temperature c, stress d, engine r.p.m. e, lever control input signals f, hour meter time elapsed g, vehicle position h, and vehicle inclination angle k, are detected by sensor groups provided in the follower machines 32 to 35.

The vehicle condition data 200*b* detected in the follower machines 32 to 35 are transmitted together with the vehicle ID data 200*a* to the leader work machine 31 via a radio communication link 6.

The vehicle ID data and vehicle condition data 200 detected at the plurality of follower machines 32 to 35, together with the vehicle ID data and vehicle condition data 200 detected at the leader work machine 31, are transmitted from the terminal device 31*a* of the leader work machine 31 to the server apparatus 11 via a radio communication link 5, communication satellite 3, and radio communication link 5.

A description is now given assuming the case where an anomaly such as a trouble has occurred in the follower machine 33.

In the server apparatus 11, when the vehicle ID data 200*a* for the follower machine 33 are transmitted, the type "P" and model "model 2" corresponding to the vehicle ID data 200*a* (P-33) are read out from the machine type and model specific machine number database 160. It is assumed here that an association has been effected in the machine type and model specific machine number database 160 such that the machine number "33" corresponds to the model "model 2" (step 501).

Next, the standard condition data corresponding to the type "P" and the model "model 2" are read out from the machine specific standard condition data database 151. Next, a comparison is made between the standard condition data so read out, and the vehicle condition data 200*b* for the follower machine 33 associated with the vehicle ID data 200*a* (P-33) for the follower machine 35, and a judgment is made as to whether the vehicle condition is normal or anomalous, in the same manner as was described with FIG. 17(*a*) (step 502).

When the results of the decision made in step 502 is that the situation is "anomalous," further processing is performed to specify the anomalous phenomenon and the level of importance thereof. By anomalous phenomenon here is meant something like "no power" or "poor fuel economy." And the level of importance is determined according to the amount of time left remaining until a part can no longer be used. The shorter the time remaining, the higher the level of importance.

That is, the anomalous phenomenon data corresponding to the type "P" and the model "model 2" are read out from the machine specific anomalous phenomenon data database 152. Next, a comparison is made between the anomalous phenomenon data so read out, and the vehicle condition data 200*b* for the follower machine 33 associated with the vehicle ID data 200*a* (P-33) for the follower machine 33, and the anomalous phenomenon and level of importance thereof are specified (step 503).

Next, processing is performed to specify the anomaly location and retrieve three-dimensional shape data for that anomaly location. By anomaly location here is meant a "hydraulic pump failure" or "damage to a working member" or the like.

More specifically, anomaly location data corresponding to the type "P" and the model "model 2" are read out from the machine specific anomaly location data database 154. Next, a comparison is made between the anomaly location data so read out and the vehicle condition data 200*b* for the follower machine 33 associated with the vehicle ID data 200*a* (P-33) for the follower machine 33, and the anomaly location is specified.

In FIG. 18 is exemplified the content of anomaly location data that specifies "hydraulic pump failure" and "damage to a working member" as anomaly locations.

As indicated in FIG. 18, standard values for specific sensor detection values are established for each anomaly location. For example, when a lever control input signal f7 (work condition f7) is effected, if the specific sensor detection values a and e are equal to or less than the standard values a7 and e7 respectively, a "hydraulic pump failure" is judged to have occurred. When a lever control input signal f8 (work condition f8) is effected, if the specific sensor detection values d and g are equal to or less than the standard values d8 and g8 respectively, "damage to a working member" is judged to have occurred.

As a result, when the anomaly location is specified, three-dimensional shape (3D) data for the anomaly location (vicinity of the hydraulic pump) and the part to be replaced (hydraulic pump assembly or a part configuring the hydraulic pump) are read out from the 3D parts shape database 161 (step 504).

Next, when it is necessary to replace a part (such as the hydraulic pump assembly, for example) in correcting the trouble, data on whether or not that part is in inventory in a warehouse of the construction company 30A that is in possession of the follower machine 33 are retrieved from data stored in the internal company 30A parts inventory database 143A, and that part is requisitioned (step 505).

If the part is not in inventory in the warehouse of the construction company 30A, data requesting a confirmation of the warehouse search for the part and the date and time of part arrival are transmitted from the server apparatus 11 to the terminal device 21 of the parts depot 20 via a radio communication link 5, communication satellite 3, and radio communication link 5, the availability of the part and the date and time of part arrival are queried, and the part is requisitioned. As a result, from the terminal device 21 of the parts depot 20, data indicating the results of the search for the part (parts inventory, parts arrival date) are transmitted to the server apparatus 11 via a radio communication link 5, communication satellite 3, and radio communication link 5 (step 506).

Next, data requesting the date and time of the arrival of service personnel at the construction site, and the repair time (from arrival at construction site to completion of repairs) are transmitted from the server apparatus 11 to the terminal device 23 of the service point 22 via a radio communication link 5, communication satellite 3, and radio communication link 5, and the date and time of arrival of the service personnel and the repair time are queried. As a result, data indicating the results of the retrieval of the date and time of arrival of the service personnel and the repair time are transmitted from the terminal device 23 of the service point 22 to the server apparatus 11 via a radio communication link 5, communication satellite 3, and radio communication link 5 (step 507).

In steps 505, 506, and 507, a part value corresponding to the type "P" and model "model 2" replacement part "hydraulic pump assembly" is read out from the service parts price database 132. Also, the service fees corresponding to the type "P" and model "model 2" replacement part "hydraulic pump assembly" are read out from the service fee database 131. By service fees, here, are meant fees that include both the fees for dispatching service personnel established according to the distance from the service point 22 to the construction site, and the labor cost required for the repair (part replacement). Also, the maintenance time required (repair time) corresponding to the type "P" and model "model 2" replacement part "hydraulic pump assembly" is read out from the correction time data database 153. By correction time required (repair time) here is meant the time required for the correction (repair) at the construction site.

Next, taking the correction time (repair time) into consideration, the initial 3D Gantt chart is revised in the same manner as described for step 705 in FIG. 7.

That is, the similar construction work selection system 706, in like manner as in step 705 in FIG. 7, retrieves data on past construction work wherein the Gantt chart was revised by the correction v of a trouble (replacement of hydraulic pump assembly) from data stored in the 3D Gantt chart schedule and performance results databases 141A, 141B, 141C, and 141D, and revises the Gantt chart, according to the current trouble correction v, so that the construction work is completed within the construction period s (step 508).

Thus data indicating revised Gantt charts for the construction period priority Gantt chart, budget priority Gantt chart, and environment priority Gantt chart are produced as revised 3D Gantt chart data 166*b*.

Also, data indicating a handling proposal for handling the anomalous situation constituted by the trouble correction are produced as anomaly occurrence handling data 166*a*.

The anomaly occurrence handling data 166*a* are configured by level of importance and anomaly location 3D shape data 166*d* indicating the level of importance and the three-dimensional shapes of anomaly locations acquired in steps 504 to 507, requisitioned part 3D shape and part arrival date and time data 167*a* indicating the three-dimensional shape of requisitioned parts and the date and time the parts are to arrive, service personnel arrival date and time and repair time data 167*b* indicating the date and time service personnel will arrive at the construction site and the time required for repair, and parts price and service cost data 182 indicating the prices of parts and service fees. These anomaly occurrence handling data 166*a* and revised 3D Gantt chart data 166*b* indicating revised three-dimensional Gantt charts are transmitted from the server apparatus 11 to the terminal device 31*a* of the leader work machine 31 via a radio communication link 5, communication satellite 3, and radio communication link 5, and stored in memory in the terminal device 31*a*.

Therefore, in the display location 320 on the display screen 301E of the monitor device 300 carried on board the leader work machine 31 are displayed the level of importance (time remaining until the hydraulic pump can no longer be used) and the three-dimensional shape of the anomaly location (vicinity of hydraulic pump), based on the level of importance and anomaly location 3D shape data 166*d,* as diagrammed in FIG. 6. From that display content, the operator can judge whether or not a correction should be made immediately.

The operator of the leader work machine 31 decides, from the content displayed on the display screen 301E, whether or not a correction should be made immediately and the construction work continued according to a revised Gantt chart. When it is decided that a correction should be made immediately, the decision button 321 on the display screen 301E is pressed. When it is decided that further study is required, the select next candidate button 322 on the display screen 301E is pressed.

As a result, the display screen 301E transitions to the display screen 301F.

In the display location 320 on the display screen 301F are displayed the three-dimensional shape of the requisitioned part and the date and time the requisitioned part is to arrive at the construction site, based on the requisitioned part 3D shape and part arrival date and time data 167*a,* and the date and time service personnel are to arrive at the construction site, and the repair time, based on the service personnel arrival date and time and repair time data 167*b,* and the price of the part and the service cost, based on the parts price and service cost data 182. From that displayed content, the operator can make a more careful decision as to whether or not a correction should be made immediately.

The operator of the leader work machine 31 decides, from the content displayed on the display screen 301F, whether or not a correction should be made immediately and the construction work continued according to a revised Gantt chart. When it is decided that a correction should be made immediately, the decision button 321 on the display screen 301F is pressed. When it is decided that further study is required, the select next candidate button 322 on the display screen 301F is pressed.

As a result, the display screen 301F transitions to the display screen 301G.

In the display location 320 on the display screen 301G, the revised 3D Gantt chart candidate is displayed, based on the revised 3D Gantt chart data 166*b*. Every time the select next candidate button 322 is pressed, the revised 3D Gantt chart candidate currently being displayed in the display location 320 changes sequentially to the next revised 3D Gantt chart candidate. When the revised 3D Gantt chart currently displayed in the display location 320 is to be definitely determined on, the decision button 321 is pressed.

When button 321 is pressed, data instructing that a correction is to be made are transmitted from the terminal device 31*a* of the leader work machine 31 to the server apparatus 11 via a radio communication link 5, communication satellite 3, and radio communication link 5. From the server apparatus 11, data instructing the requisitioning of a part are transmitted to the terminal device 21 of the parts depot 20 via a radio communication link 5, communication satellite 3, and radio communication link 5, and data instructing the requisitioning of service personnel are transmitted to the terminal device 23 of the service point 22 via a radio communication link 5, communication satellite 3, and radio communication link 5. Thus the parts and the service personnel will arrive at the construction site, and the correction will be made on the construction machine 35. In cases where it is impossible to make the repair at the construction site, the construction machine will be conveyed to the repair shop and the repair made there (step 509).

When the correction is finished, the parts depot 20 and service point 22 compute the parts price and service costs. Then, from the terminal device 21 of the parts depot 20, data requesting the parts price, and from the terminal device 23 of the service point 22, data requesting the service cost are input, and transmitted to the server apparatus 11 via a radio communication link 5, communication satellite 3, and radio communication link 5. At the server apparatus 11, the prices of parts are retrieved based on data stored in the machine specific service parts price database 132, service costs are retrieved based on data stored in the service fee database 131, and those data are transmitted to the terminal device 21 of the parts depot 20 and the terminal device 23 of the service point 22 via a radio communication link 5, communication satellite 3, and radio communication link 5. Thus the service company 20' (parts depot 20, service point 22) can easily and quickly acquire parts prices and service costs by accessing the database 100 in the server apparatus 11.

Thereupon, data requesting a parts price from the construction company 30A are input to the terminal device 21 of the parts depot 20, and data requesting repair particulars and service costs from the construction company 30A are input to the terminal device 23 of the service point 22. These data are transmitted to the server apparatus 11 via a radio communication link 5, communication satellite 3, and radio communication link 5. The server apparatus 11 transmits those data to the terminal device 31*a* of the leader work machine 31 via a radio communication link 5, communication satellite 3, and radio communication link 5, and stores those data in memory in the terminal device 31*a*.

Thus, in the display location 320 on the display screen 301H of the monitor device 300 carried on board the leader work machine 31, the repair particulars and invoice amount (parts prices and service costs) are displayed.

When the operator has received those display contents and indicated an intent to pay (acceptance possible), button 321 is pressed. If there are troubles with the content displayed and receipt is not possible (acceptance not possible), button 322 is pressed.

When the button 322 is pressed on the display screen 301H, data indicating acceptance not possible are input to the terminal device 31*a* of the leader work machine 31 and transmitted to the server apparatus 11 via a radio communication link 5, communication satellite 3, and radio communication link 5. The server apparatus 11 transmits those data to the terminal device 21 of the parts depot 20 and the terminal device 23 of the service point 22 via a radio communication link 5, communication satellite 3, and radio communication link 5. Thereupon, the parts depot 20 and service point 22 review the parts prices and service costs and transmit the parts prices and service costs obtained as a result, in the same manner as before, to the terminal device 31*a* of the leader work machine 31 via the server apparatus 11.

When button 321 on the display screen 301H is pressed, data indicating acceptance possible are input to the terminal device 31*a* of the leader work machine 31 and transmitted to the server apparatus 11 via a radio communication link 5, communication satellite 3, and radio communication link 5. The server apparatus 11 performs processing, by means of electronic settlement, to withdraw funds in payment of fees from a designated account of the construction company 30A and transfer the withdrawn funds in payment of fees to a designated account of the service company 20'.

The server apparatus 11 stores service history data indicating maintenance and correction content (parts replacement, repair particulars) and invoice amounts (parts prices, service costs) in the 30A company service history database 142A, and updates the content stored in the 30A company service history database 142A. In this manner, service history data are stored, categorized by construction company, i.e. whether for construction company 30A, 50B, 60C, or 70D, by type and model of construction machine, and by particulars of construction work (step 410). The processing performed in steps 501 to 510 was described representatively for the follower machine 33, but that processing is performed in the same manner for the other construction machines 31, 32, 34, and 35.

Thus the operator of the leader work machine 31, when trouble correction has been effected, is able to fulfill also the role of office manager (labor manager) in performing processing to settle invoices for the costs of such maintenance, and take measures transfer funds to the proper parties.

The operator of the leader work machine 31, furthermore, from the content displayed on the display screen 301E, 301F or 301G, can decide to continue the construction work as is without revising the Gantt chart for the anomalous situation constituted by the trouble correction.

In a case where the level of importance is low and there is but little time remaining until a construction phase is completed, for example, he or she can decide not to employ a revised Gantt chart. In that case, the operator of the leader work machine 31 would direct the work progress of the plurality of work machines 31 to 35 so that the construction work is carried on according to the Gantt chart prior to revision.

Thus the operator of the leader work machine 31 is able also to fulfill the role of a general site foreman in deciding whether or not to continue the construction work as is when a trouble arises.

When the decision button 321 on the display screen 301C is pressed, the revised 3D Gantt chart is determined on, and the display content diagrammed in FIGS. 10, 11, and 12 is changed from the content of that prior to revision to the content of the Gantt chart after revision.

Data indicating the determined 3D Gantt chart (such as the construction period priority Gantt chart, for example) are transmitted from the terminal device 31*a* of the leader work machine 31 to the server apparatus 11 via a radio communication link 5, communication satellite 3, and radio communication link 5, and stored in the 3D Gantt chart schedule and performance results database 141A of the database 100. The "scheduled" data in the 3D Gantt chart schedule and performance results database 141A corresponding to the construction company 30A are thereby updated.

Thus the operator of the leader work machine 31 is able also to fulfill the role of a general site manager in revising Gantt charts.

The number of construction machines noted in the revised Gantt chart is sometimes a greater number than that noted in the Gantt chart prior to revision.

Thereupon, when a password or the like is input from the terminal device 31*a* of the leader work machine 31 and the machines on hand information 203 stored in the database 100 is accessed, the machines on hand information 203 is transmitted to the terminal device 31*a* of the leader work machine 31 via a radio communication link 5, communication satellite 3, and radio communication link 5, stored in memory in the terminal device, and displayed on a display screen.

Thereupon, if the operator of the leader work machine 31 enters vehicle deployment request data from the terminal device 31*a*, in like manner as described earlier, the required number of construction machines can be quickly secured from the lease company 90*a* and/or rental company 90*b*.

In this manner, the operator of the leader work machine 31 can also fulfill the role of a general site manager who makes arrangements for the deployment of vehicles in accordance with revised Gantt charts.

The revised 3D Gantt chart proposal information 166 comprises follower-machine 3D Gantt chart information 165'. The follower-machine 3D Gantt chart information 165' is transmitted from the terminal device 31*a* of the leader work machine 31 in construction phase 1 to the terminal devices of the follower machines 32, 33, 34, and 35 via the radio communication links 6, stored in memory in the terminal devices, and displayed on display screens in the monitor devices 300.

In this manner, the operator of the leader work machine 31, in cases where the Gantt chart is revised, is able to fulfill the role also of a general site manager in informing the operators of related construction machines that there has been a revision so that the work can be performed according to the revised content of the revised Gantt chart.

Thereafter, the operators of the follower machines 32, 33, 34, and 35 in construction phase 1 can accomplish the work that should be performed by their vehicles in accordance with the follower-machine 3D Gantt chart information 165' displayed on the display screen of the monitor device 300 in each of their own vehicles.

While construction work is being carried on in construction phase 1, the operator of the leader work machine 31 checks the progress of the work being done by his or her own vehicle 31 and by the follower machines 32 to 35 based on the content displayed on the display screen 301 represented in FIGS. 10, 11, and 12. If the work is delayed, that operator instructs the follower machines 32 to 35 via the radio communication links 6 to make up for that delay. The operator of the leader work machine 31 also informs the follower machines 32 to 35 of operating ranges, via the radio communication links 6, based on the content displayed on the display screen 301 indicated in FIGS. 10, 11, and 12.

In the foregoing, the operations of the leader work machine 31 and the follower machines 32 to 35 in construction phase 1 are described, but the leader work machine 36 and follower machines 33, 37, 38, and 39 in construction phase 2, and the leader work machine 33 and the follower machines 40 and 41 in construction phase 3 operate in like manner.

With reference to FIGS. 10, 11, and 12, judgment examples for cases where an anomalous situation constituted by unscheduled maintenance has occurred are described specifically.

The "initial plan" for a construction phase 1 calls for starting the construction work on August 2 and finishing it on August 20. Thereupon, information to the effect that a failure was to be repaired on the follower machine 33 on August 19 and 20 was transmitted to the leader work machine 31. The level of importance of this trouble was high, and the follower machine 33 was a construction machine that was scheduled for operation both in construction phase 2, which was to follow, and in construction phase 3. Therefore, the operator of the leader work machine 31 judged that the trouble in the follower machine 33 should be corrected, and effected the correction. When the construction machines 31, 33, 34, and 35 were caused to be operated on August 21, which was a holiday, in order to make up the delay caused by correcting the trouble, construction phase 1 was completed according to the initial daily schedules.

Next, the content displayed on the monitor device 300 carried on board the follower machines 32 to 35 in construction phase 1 is described with reference to FIGS. 13 to 16.

As described earlier, the follower-machine 3D Gantt chart information 165' is transmitted from the terminal device 31*a* of the leader work machine 31 to the terminal devices of the follower machines 32, 33, 34, and 35 via the radio communication links 6, stored in memory in the terminal devices, and displayed on display screens on the monitor devices 300. Jobs to be performed by the individual follower machines are described in the follower-machine 3D Gantt chart information 165'.

Figure 13:
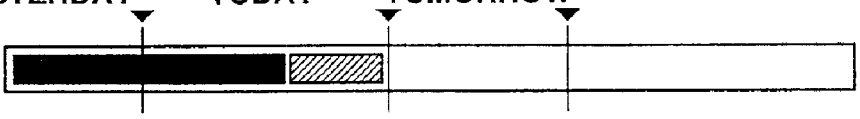
FIG. 13 is a diagram showing an example of the display content on a monitor device in a follower machine.

In FIG. 13 is represented an example display on the monitor device 300 for the follower machine 33 (a hydraulic shovel).

On the display screen of the monitor device 300 of the follower machine 33, as diagrammed in this FIG. 13, are displayed a "work process chart," a "daily schedule for today," and "particulars of work."

In the "work process chart," the work performance results for the follower machine 33 up until today and the scheduled work to be done today are indicated comparatively by a bar graph. In FIG. 13, the portion blacked in represents the work performance results up until today, and the hashed portion the scheduled work to be done today.

In "daily schedule for today," all of the construction machines 31 to 35 are further divided into a plurality of groups and the content of the work to be performed today by each group is noted in plain language.

And, in "particulars of work," the content of the work to be performed today by the follower machine 33 is noted in plain language.

The content of the work to be done today by the follower machine 33 can be graphically displayed.

Figure 14:
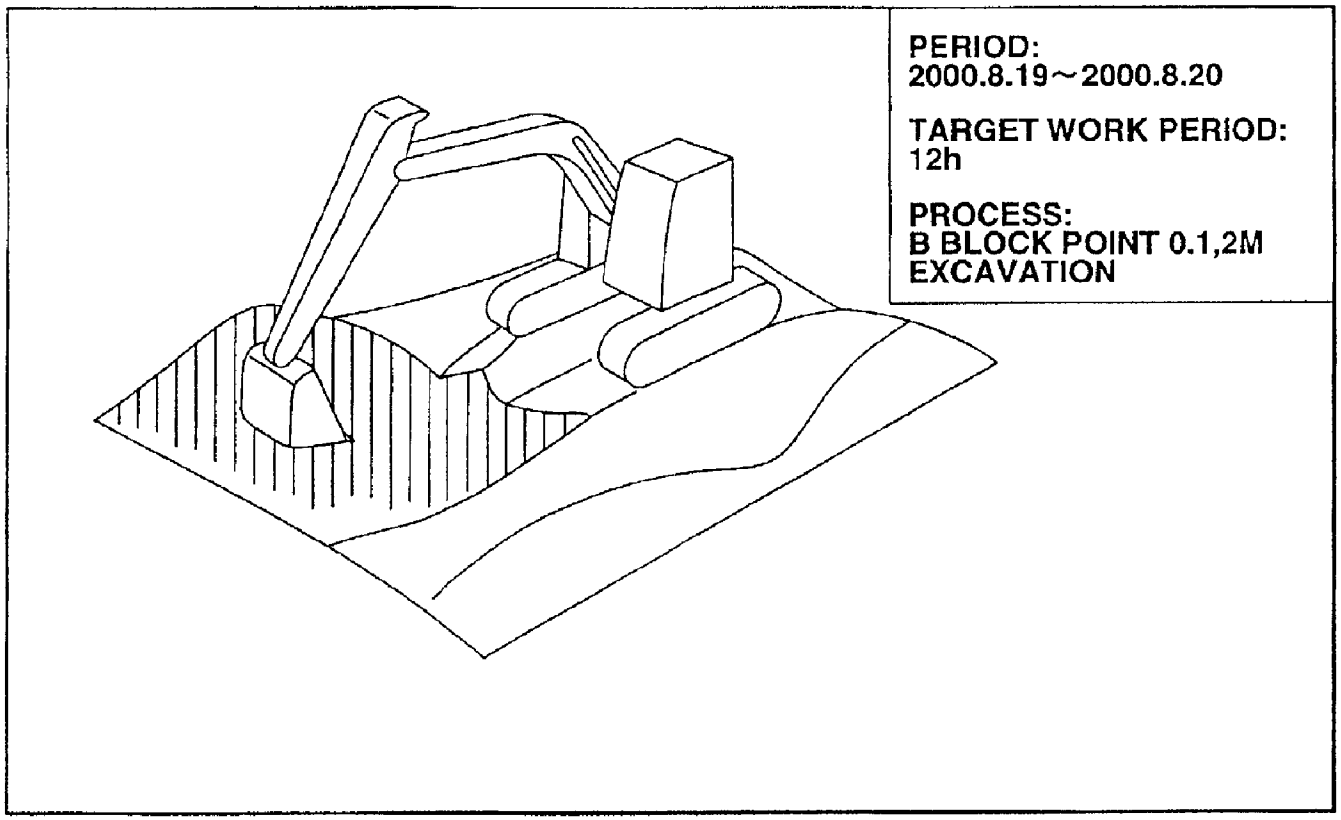
FIG. 14 is a diagram showing an example of the display content on a monitor device in a follower machine.

When a prescribed button on the screen is clicked on, the display screen diagrammed in FIG. 13 transitions to the display screen diagrammed in FIG. 14.

On the display screen of the monitor device 300, as diagrammed in FIG. 14, the content of the work to be performed today by the follower machine 33 is displayed graphically as a hatched area.

Figure 15:
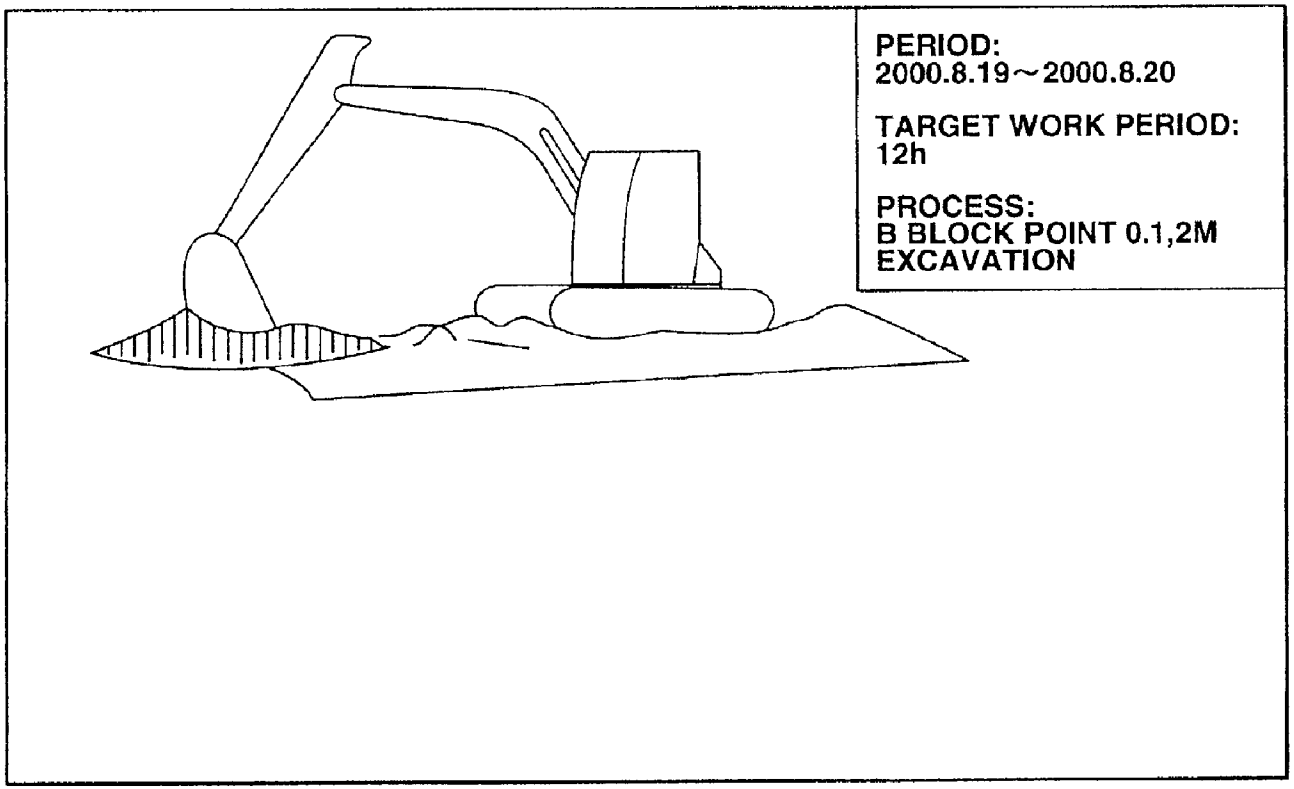
FIG. 15 is a diagram showing an example of the display content on a monitor device in a follower machine.
Figure 16:
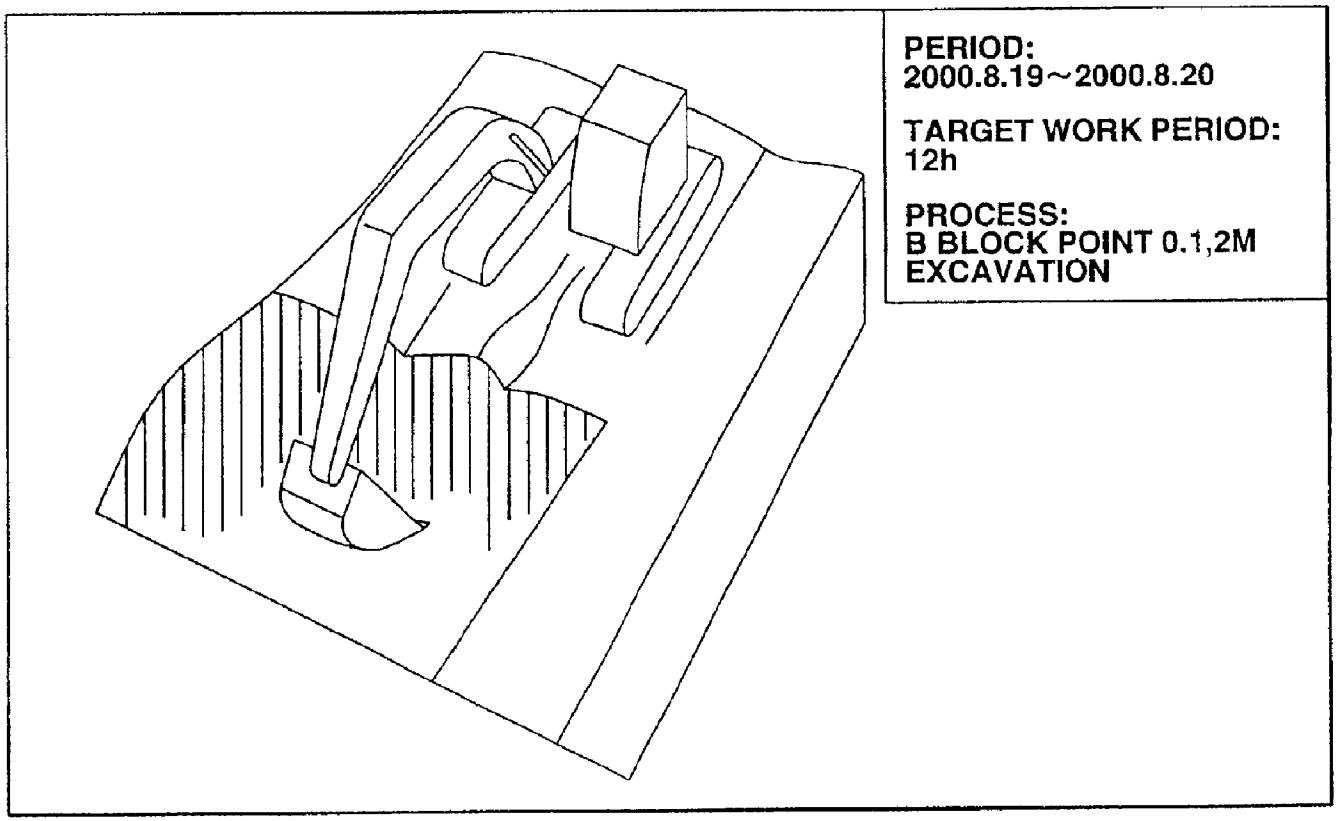
FIG. 16 is a diagram showing an example of the display content on a monitor device in a follower machine.

When a prescribed button on the screen is clicked on, the display screen diagrammed in FIG. 14 transitions to the display screen diagrammed in FIG. 15, and when a prescribed button on the display screen diagrammed in FIG. 15 is clicked on, the display screen diagrammed in FIG. 16 is transitioned to.

FIGS. 15 and 16 represent the content displayed in FIG. 14 with the point of view changed. FIG. 15 displays the construction site as seen from the side, while FIG. 16 displays the construction site as seen from above.

The work performance results for the follower machine 33 can be estimated from the lever control input signals f output from sensors on the follower machine 33 and the hour meter time elapsed g. The work condition can be detected from the lever control input signals f, and the engine operating hours can be detected from the hour meter time elapsed g. Hence a daily work report indicating the actual operating time in one day for the follower machine 33 can be produced on the basis of the hour meter time elapsed g. Also, the volume excavated by the follower machine 33, that is, the work performance results therefor, can be estimated on the basis of the lever control input signals f and the hour meter time elapsed g.

The vehicle condition data 200*b* constituted by the lever control input signals f and the hour meter time elapsed g are detected by the sensor group provided in the follower machine 33. The vehicle condition data 200*b* detected in the follower machine 33, together with the vehicle ID data 200*a*, are transmitted to the leader work machine 31 via a radio communication link 6. These vehicle ID data and vehicle condition data 200 are transmitted from the terminal device 31*a* of the leader work machine 31 to the server apparatus 11 via a radio communication link 5, communication satellite 3, and radio communication link 5.

At the server apparatus 11, the work performance results are computed on the basis of the lever control input signals f and hour meter time elapsed g detected at the follower machine 33. The work performance results for the other construction machines 31, 32, 34, and 35 are computed in the same manner. By estimating the work performance results for these construction machines 31 to 35, furthermore, the overall work performance results for the plurality of construction machines 31 to 35 are computed. The "performance results" column in the 3D Gantt chart diagrammed in FIGS. 10, 11, and 12 is automatically written to by those computed work performance results. Also, the "performance results" data in the 3D Gantt chart schedule and performance results database 141A corresponding to the construction company 30A are renewed by the work performance results computed as described above.

When the "performance results" column in the 3D Gantt chart diagrammed in FIGS. 10, 11, and 12 is automatically written to by the server apparatus 11, those data are transmitted from the server apparatus 11 to the terminal device 31*a* of the leader work machine 31 via a radio communication link 5, communication satellite 3, and radio communication link 5, and stored in memory in the terminal device 31*a*. Therefore, the 3D Gantt chart wherein the "performance results" column is written to is displayed on the display screen of the monitor device 300 in the leader work machine 31. At the time of construction phase 1 completion, moreover, the overall "performance results" are displayed graphically in the Gantt chart diagrammed in FIGS. 10, 11, 12.

Embodiment is also possible such that, instead of the "performance results" column of the 3D Gantt chart being automatically written to by the server apparatus 11, it is written to manually by the operator of the leader work machine 31.

In that case, the operator of the leader work machine 31 operates the button 311 indicated in FIG. 12, and writes in the "performance results" for each of the construction machines 31 to 35 that are displayed in the display location 320. He or she also writes in the "performance results" for all of the construction machines 31 to 35. The data indicating the content so written in are transmitted from the terminal device 31*a* of the leader work machine 31 to the server apparatus 11 via a radio communication link 5, communication satellite 3, and radio communication link 5. Therefore, the "performance results" data in the 3D Gantt chart schedule and performance results database 141A corresponding to the construction company 30A are updated according to the content written in at the leader work machine 31.

In this manner, "performance results" are stored in the 3D Gantt chart schedule and performance results database 141A for each of the construction machines 31 to 35, that is, for each of the vehicle ID data 200*a* for the construction machines 31 to 35. The overall "performance results" for the construction machines 31 to 35 are also stored.

Thus the operator of the leader work machine 31 is also able to fulfill the role of a general site foreman in filling in the "performance results" column in Gantt charts.

Of the "performance results" data stored in the 3D Gantt chart schedule and performance results database 141A, those data associated with the vehicle ID data 200*a* for the follower machine 33 are transmitted from the server apparatus 11 to the terminal device 31*a* of the leader work machine 31 via a radio communication link 5, communication satellite 3, and radio communication link 5. Furthermore, those "performance results" data associated with the vehicle ID data 200*a* for the follower machine 33 are transmitted from the terminal device 31*a* of the leader work machine 31 to the terminal device of the follower machine 33 via a radio communication link 6 and stored in memory in the terminal device. Based on the data stored in that memory, in the "work process chart," as described earlier with FIG. 13, the work performance results up until today (indicated in black) are displayed with the bar graph.

The follower machine 33 is described representatively in the foregoing, but the content indicated in FIGS. 13 to 16 for the other follower machines 32, 34, and 35 also is displayed in the same manner on the monitor device 300 of that operator's own vehicle. The same applies to the follower machines 33, 37, 38, and 39 in construction phase 2 and to the follower machines 40 and 41 in construction phase 3.

As set forth in the foregoing, on the display screens of the monitor devices 300 of the construction machines 31 to 41 in the construction site, a 3D Gantt chart will be displayed as a construction work daily schedule chart for operators so that it can be viewed by the operator of each construction machine.

Here, the data for the construction work daily schedule chart for operators may be processed into a construction work daily schedule chart for residents, to be viewed by residents living in the periphery of the construction site, and displayed on the vehicle-mounted signboard 47 mounted on the construction machine 31 (leader work machine 31). The data processing is performed by the server apparatus 11. Or the data may be processed by the terminal device 31*a* in the construction machine 31 (leader work machine 31).

The vehicle-mounted signboard 47 may be deployed on any one of the construction machines that are follower machines 32 to 35 other than the leader work machine 31, or on a plurality of those construction machines. In such cases, the data for the construction work daily schedule chart for residents are transmitted from the leader work machine 31 to the other follower machines 32 to 35 via the radio communication links 6, and displayed on the vehicle-mounted signboards 47 deployed on the follower machines 32 to 35.

The construction work daily schedule chart for residents may be a simplification of the construction work daily schedule chart for operators, for example, wherein the construction work schedule and performance results are graphically displayed by bar graphs or three-dimensional topographical maps. Whenever the 3D Gantt chart has been modified, moreover, the construction work daily schedule chart for residents is modified accordingly.

The same kind of display can also be made on a stationary type signboard 57 installed at the construction site. In that case, a communication terminal for satellite communications is provided in the stationary type signboard 57, and the data for the construction work daily schedule chart for residents can be transmitted from the server apparatus 11 directly to the stationary type signboard 57 via a radio communication link 5, communication satellite 3, and radio communication link 5, and the construction work daily schedule chart for residents displayed on the stationary type signboard 57. Alternatively, data for the construction work daily schedule chart for residents can be transmitted from the construction machine 51 (leader work machine 51) to the stationary type signboard 57 via a radio communication link 6 and the construction work daily schedule chart for residents displayed on the stationary type signboard 57.

Information indicating environmental conditions in the periphery of the construction site may also be displayed on the signboards 47 and/or 57. Such environmental information as noise levels, $CO_2$ concentrations, and $NO_x$ concentrations in the periphery of the construction site, for example, can be displayed.

In that case, in terms of manners for measuring environmental conditions, those such as the following are conceivable. Construction phase 1 is taken as an example in the following.

1) Provide a noise-level meter for measuring noise levels in the construction machines 31 to 35.
2) Provide such a noise-level meter in a main construction machine such as the leader work machine 31.
3) Provide such a noise-level meter at one or a plurality of prescribed locations at the construction site.
4) Provide fuel sensors in the construction machines 31 to 35 that indirectly measure concentrations of toxic substances in the exhaust gases (such as the $CO_2$ or $NO_x$ concentration) by detecting the volume of fuel consumed. Or, alternatively, provide concentration meters that directly measure concentrations of toxic substances in the exhaust gases (such as the $CO_2$ or $NO_x$ concentration).
5) Provide such fuel sensors or concentration meters in a main construction machine such as the leader work machine 31.

6) Provide a concentration meter at one or a plurality of prescribed locations at the construction site for directly measuring the concentrations of toxic substances in the air (such as the $CO_2$ or $NO_x$ concentration).

The data obtained by the noise-level meters and/or concentration meters (hereinafter called environmental condition data) are transmitted to the leader work machine 31, either from the follower machines 32 to 35 via the radio communication links 6, in like manner as the vehicle condition data 200*b* described earlier, or from installed noise-level meters and/or concentration meters via the radio communication links 6. Then, the leader work machine 31 transmits environmental condition data of the construction machines 31 to 35, inclusive of its own environmental condition data, or the environmental condition data measured by installed noise-level meters and/or concentration meters, to the server apparatus 11 via a radio communication link 5, communication satellite 3, and radio communication link 5. At the server apparatus 11, the environmental condition data are processed into environmental condition data for residents which are to be viewed by residents. Then, from the server apparatus 11, the environmental condition data for residents are transmitted to the leader work machine 31 via a radio communication link 5, communication satellite 3, and radio communication link 5, and the environmental condition data for residents are displayed on the vehicle-mounted signboard 47. On the vehicle-mounted signboard 47 may be displayed, for example, a noise graph wherein the daily construction work schedule (time) is plotted on the horizontal axis and noise level is plotted on the vertical axis, or a toxic substance concentration graph wherein the daily construction work schedule (time) is plotted on the horizontal axis and toxic substance concentrations (such as the $CO_2$ and/or $NO_x$ concentration) are plotted on the vertical axis.

The vehicle-mounted signboard 47 may be deployed on any one of the construction machines that are the follower machines 32 to 35 other than the leader work machine 31, or on a plurality of those construction machines. In such cases, the environmental condition data for residents are transmitted from the leader work machine 31 to the follower machines 32 to 35 via the radio communication links 6, and displayed on vehicle-mounted signboards 47 mounted on the follower machines 32 to 35.

When displayed on a stationary type signboard 57, the environmental condition data for residents may be transmitted from the server apparatus 11 to the stationary type signboard 57 via a radio communication link 5, communication satellite 3, and radio communication link 5, or, alternatively, they may be first transmitted to the leader work machine 51 and then via a radio communication link 6 to a stationary type signboard 57.

Based on this embodiment, as set forth in the foregoing, information relating to the construction site, such as the daily construction work schedule or environmental conditions or the like, can be presented to the residents living in the periphery of the construction site, accurately and in real time. Mutual understanding with the neighboring residents can therefore be better fostered than conventionally.

Furthermore, there is no need, as conventionally, for a person in charge of public relations to write construction work schedules, performance results, and noise-level meter readings by hand on a white board set up at the construction site.

Thus the operator of the leader work machine 31 or 51 can also fulfill the role of the person in charge of public relations in disseminating information relating to the construction site to the neighboring residents. Besides the information described in the foregoing, moreover, any information, such as the weather forecast for that region, for example, may be displayed on the vehicle-mounted signboard 47 or stationary type signboard 57.

Next, an embodiment that automatically produces daily work reports is described with reference to FIG. 8.

As described earlier, in the 3D Gantt chart schedule and performance results database 141A for the service provider company 10, "performance results" are written for each vehicle ID data 200*a* for the construction machines 31 to 35.

Thereupon, when the operator of the leader work machine 31 checks the daily work report for the follower machine 33, the vehicle ID data 200*a* for the follower machine 33, and data requesting the production of a daily work report for the follower machine 33, are input to the terminal device 31*a*. These data are transmitted from the terminal device 31*a* of the leader work machine 31 to the server apparatus 11 via a radio communication link 5, communication satellite 3, and radio communication link 5.

Figure 8:
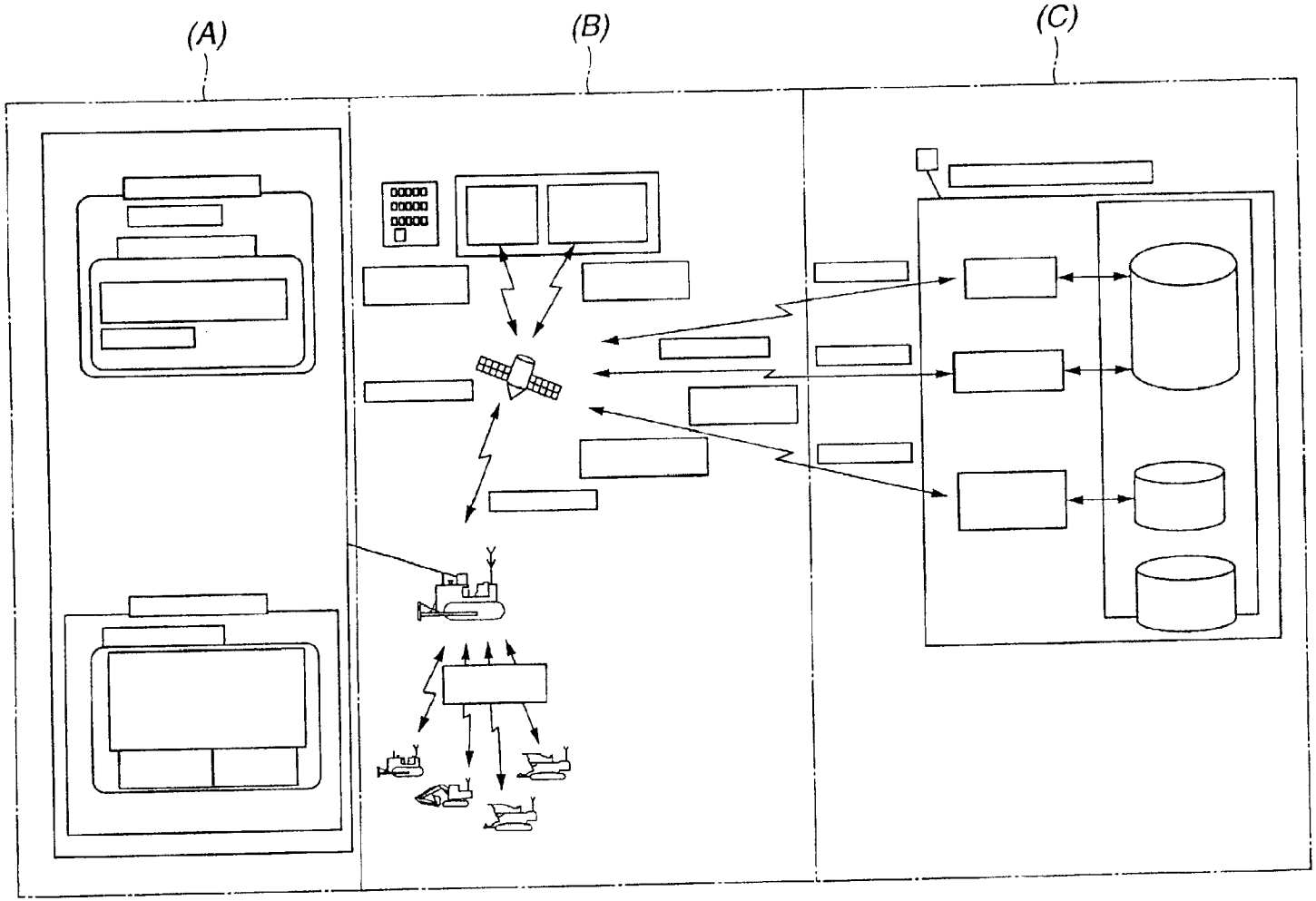
FIG. 8 is a diagram representing an embodiment that automatically produces daily work reports for construction machines.

As diagrammed in FIG. 8, the server apparatus 11 comprises a daily report data production system 185. The daily report data production system 185 is a system for producing data for the daily work report of the construction machine specified by the vehicle ID data 200*a*, based on data stored in the 3D Gantt chart schedule and performance results databases 141A, 141B, 141C, and 141D that are in the company specific history database group 140.

Now, when an instruction requesting that a daily work report be produced for the follower machine 33 is sent to the server apparatus 11, the daily report data production system 185 reads out "performance results" data corresponding to the follower machine 33 based on the vehicle ID data 200*a* from the 3D Gantt chart schedule and performance results database 141A and produces daily work report data 189 for the follower machine 33.

The daily work report data 189 is transmitted from the server apparatus 11 to the terminal device 31*a* of the leader work machine 31 via a radio communication link 5, communication satellite 3, and radio communication link 5 and stored in memory in the terminal device 31*a*.

Hence, as diagrammed in FIG. 8, in the display location 320 of the display screen 301L on the monitor device 300 carried on board the leader work machine 31, a daily work report for the follower machine 33, that is, the 1 H actual operating time of the follower machine 33, is displayed graphically by a bar graph. The operator of the leader work machine 31 can thus perform operator labor management by, among other things, checking the daily work report displayed on that display screen 301L.

The operator of the leader work machine 31 can revise the daily work report displayed in the display location 320 on the display screen 301L. To do so, he or she presses button 322 on the display screen 301L, whereupon the display screen transitions to a revision screen. The daily work report can be revised on this revision screen. When it is judged that the content of the daily work report displayed in the display location 320 is correct, button 321 on the display screen 301L is pressed.

When button 321 on the display screen 301L is pressed, the finally determined daily work report data 189 are transmitted from the terminal device 31*a* of the leader work machine 31 to the terminal device 49 of the site office 30 via a radio communication link 5, communication satellite 3, and radio communication link 5.

In the terminal device 49 of the site office 30 are stored data and a program for a wage computation system 183. The wage computation system 183 is a system for computing wages for the operators on board the construction machines, based on the daily work report data 189.

Now, when the daily work report data 189 corresponding to the follower machine 33 are sent to the terminal device 49 of the site office 30, the wage computation system 183 computes the wages of the operator on board the follower machine 33, based on those daily work report data 189.

The terminal device 49 of the site office 30 also performs processing, by means of electronic settlement, to withdraw the amount of the wages so computed, from a designated account of the construction company A, and transfer that withdrawn amount of wages to a designated account of the operator on board the follower machine 33.

The follower machine 33 is described representatively in the foregoing, but daily work reports are produced automatically, and wages computed automatically, in the same manner for the other follower machines 31, 33, 34, and 35, and for the leader work machine 31.

Thus the operator of the leader work machine 31, by checking the daily work report, among other things, is able to fulfill the role of an office manager (labor manager) in performing operator labor management and implementing procedures for computing the wages to be paid to operators and transferring funds to those operators. Daily work reports are also automatically produced and wages automatically computed in like manner in construction phase 2 and construction phase 3.

The general site manager at the construction site must also produce a written construction report and submit it to the national government 92*d* that is the client. Based on this embodiment, that written construction report can be automatically produced and automatically submitted to the national government 92*d*. In the written construction report are noted construction work delays, how much progress has been made, maintenance costs (parts prices, service costs) incurred during construction work, and trouble correction costs (parts prices, service costs).

More specifically, as described earlier, in the 3D Gantt chart schedule and performance results database 141A of the service provider company 10 are noted "performance results" for each vehicle ID data 200*a* for the construction machines 31 to 35. And in the service history database 142A of the service provider company 10 are stored, for each vehicle ID data 200*a* for the construction machines 31 to 35, service history data, that is, data indicating maintenance and correction particulars (parts replacement, repair particulars), and invoiced amounts (parts prices, service costs).

That being so, when the operator of the leader work machine 31 is to produce a written construction report for the follower machine 33, the vehicle ID data 200*a* for the follower machine 33 and data requesting the production of the written construction report for the follower machine 33 are input to the terminal device 31*a*. Those data are transmitted from the terminal device 31*a* of the leader work machine 31 to the server apparatus 11 via a radio communication link 5, communication satellite 3, and radio communication link 5.

As diagrammed in FIG. 8, the server apparatus 11 comprises a construction work progress data production system 186. This construction work progress data production system 186 is a system for producing construction work progress data 190 that indicate how the construction work of the construction machine specified by the vehicle ID data 200*a* is progressing, based on the 3D Gantt chart schedule and performance results databases 141A, 141B, 141C, and 141D that are in the company specific history database group 140.

The server apparatus 11 also comprises a maintenance and correction cost data production system 187. The maintenance and correction cost data production system 187 is a system for producing maintenance and correction cost data 195 that indicate invoiced amounts paid for the construction machine specified by the vehicle ID data 200*a*, based on the service history databases 142A, 142B, 142C, and 142D that are in the company specific history database group 140.

Now, when an instruction requesting that a written construction report be produced for the follower machine 33 is sent to the server apparatus 11, the construction work progress data production system 186 reads out "performance results" data corresponding to the follower machine 33 based on the vehicle ID data 200*a* from the 3D Gantt chart schedule and performance results database 141A and produces construction work progress data 190 for the follower machine 33.

The maintenance and correction cost data production system 187 also reads out invoiced amount data corresponding to the follower machine 33 based on the vehicle ID data 200*a* from the service history database 142A, and produces maintenance and correction cost data 195 for the follower machine 33.

These construction work progress data 190 and maintenance and correction cost data 195 are transmitted from the server apparatus 11 to the terminal device 49 of the site office 30 via a radio communication link 5, communication satellite 3, and radio communication link 5.

In the terminal device 49 of the site office 30 are stored data and a program for a construction work progress management system 184. This construction work progress management system 184 is a system for producing a written construction report for each construction machine based on the construction work progress data 190 and maintenance and correction cost data 195.

Now, when he construction work progress data 190 and maintenance and correction cost data 195 corresponding to the follower machine 33 are transmitted to the terminal device 49 of the site office 30, the construction work progress management system 184 produces a written construction report for the follower machine 33 based on the construction work progress data 190 and the maintenance and correction cost data 195.

The follower machine 33 is described representatively in the foregoing, but written construction reports are also produced automatically, in the same manner, for the other follower machines 31, 33, 34, and 35, and for the leader work machine 31.

Thus the operator of the leader work machine 31 can also fulfill the role of a general site manager in producing written construction reports. Written construction reports are also produced automatically, in the same manner, in construction phase 2 and construction phase 3.

Now, the operator of the leader work machine 31 in construction phase 1, because he or she oversees the other follower machines 32 to 35 in the construction site, is able to verify from the outside whether or not an overturn accident or theft incident has occurred with any of the follower machines 32 to 35 if during operating hours. However, such verification of overturn accident or theft cannot be verified if before or after the operating hours for the follower machines 32 to 35, or if such follower machines 32 to 35 have moved to a location where visual verification is not possible.

An embodiment is described next, with reference to FIG. 9, wherewith it is possible to discover that an overturn accident or theft has occurred with either the leader work machine 31 or the follower machines 32 to 35, to contact the proper authorities, and to take appropriate measures immediately.

Let it first be assumed that the follower machine 33 in construction phase 1 has been stolen.

The vehicle condition data 200*b* consisting of the hydraulic pressure a, oil temperature b, water temperature c, stress d, engine r.p.m. e, lever control input signals f, hour meter time elapsed g, vehicle position h, and vehicle inclination angle k are detected by the sensor group provided in the follower machine 33. Also, operator ID data 200*c* specifying the operator on board are associated with the follower machine 33. The vehicle condition data 200*b* detected in the follower machine 33, together with the vehicle ID data 200*a,* are transmitted via a radio communication link 6 to the leader work machine 31. These vehicle ID data and vehicle condition data 200 are transmitted from the terminal device 31*a* of the leader work machine 31 to the server apparatus 11 via a radio communication link 5, communication satellite 3, and radio communication link 5.

In the 3D Gantt chart schedule and performance results database 141A of the service provider company 10 is stored the 3D Gantt chart information 165. As described earlier, the 3D Gantt chart information 165 has been provided with vehicle IDs that specify the types, models, and vehicle numbers of a plurality of construction machines that jointly perform construction work in each of the construction phases, namely construction phase 1, construction phase 2, and construction phase 3. In the 3D Gantt chart information 165, moreover, a work "schedule" is associated with each vehicle ID. The 3D Gantt chart information 165 also contains position data P indicating X-Y two-dimensional positions P(X, Y) at the construction site.

The server apparatus 11 comprises a theft notification system 191. The theft notification system 191 is a system that compares the work "schedule" for a construction machine specified by the vehicle ID data 200*a,* and information on whether or not actual work is being performed (obtained from the vehicle condition data 200*b*), based on the 3D Gantt chart schedule and performance results databases 141A, 141B, 141C, and 141D that are in the company specific history database group 140, also compares the actual position (obtained from the vehicle position data h) against the position P at the construction site where the construction machine specified by the vehicle ID data 200*a* belongs, and produces theft information 179 indicating that a theft has occurred.

Now, when the vehicle ID data and vehicle condition data 200 for the follower machine 33 are transmitted to the server apparatus 11, the theft notification system 191, based on the vehicle ID data 200*a,* reads out the work "schedule" data corresponding to the follower machine 33 from the 3D Gantt chart schedule and performance results database 141A. The theft notification system 191 also detects whether actual work is being done or not by the follower machine 33, based on the vehicle condition data 200*b*. Based on the engine r.p.m. e and hour meter time elapsed g, for example, whether or not actual work (running) is being performed can be detected. As a result, if, for example, it is detected that, even though the follower machine 33 is "scheduled to have to be working continuously for 3 days," it is in fact "not working continuously for 3 days," it would be judged that there is a possibility that the machine was stolen and is currently being transported, and that the situation is not one where work is stopped in order to perform maintenance or correct a trouble (step 801).

However, even if the work "schedule" for, and whether or not actual work is being performed by, the follower machine 33 agree in step 801, it is still conceivable that that machine has already been stolen and is performing work outside the construction site. It is also conceivable that the work "schedule" for, and whether or not actual work is being performed by, the follower machine 33 will disagree because maintenance was performed or a trouble was corrected with the "schedule" left unrevised.

That being so, whether or not a theft has occurred is next established by comparing the position P in the construction site where the follower machine 33 should be operating and the actual position.

The theft notification system 191 reads out the construction site position data P corresponding to the follower machine 33, based on the vehicle ID data 200*a,* from the 3D Gantt chart schedule and performance results database 141A, and also detects the actual position of the follower machine 33 based on the vehicle position h that is part of the vehicle condition data 200*b*. As a result, if the construction site position P where the follower machine 33 should be operating and the actually detected position of the follower machine 33 are separated by a prescribed threshold value or more, it is judged that a theft has occurred and that the follower machine 33 has been removed from the construction site, whereupon theft information 179 is produced. Also, the date and hour that the judgment was made that a theft had occurred are recorded as the date and hour of the theft. The theft information 179 comprises data indicating a message to the effect that a theft has occurred, the vehicle ID data 200*a* for the stolen construction machine, the construction site position data P for where the stolen construction machine should be operating, data indicating the date and hour it was stolen, and current detected position data for the stolen construction machine (step 802).

The theft information 179 are transmitted from the server apparatus 11 to the terminal device 31*a* of the leader work machine 31 via a radio communication link 5, communication satellite 3, and radio communication link 5 and stored in memory in the terminal device 31*a*.

Figure 9:
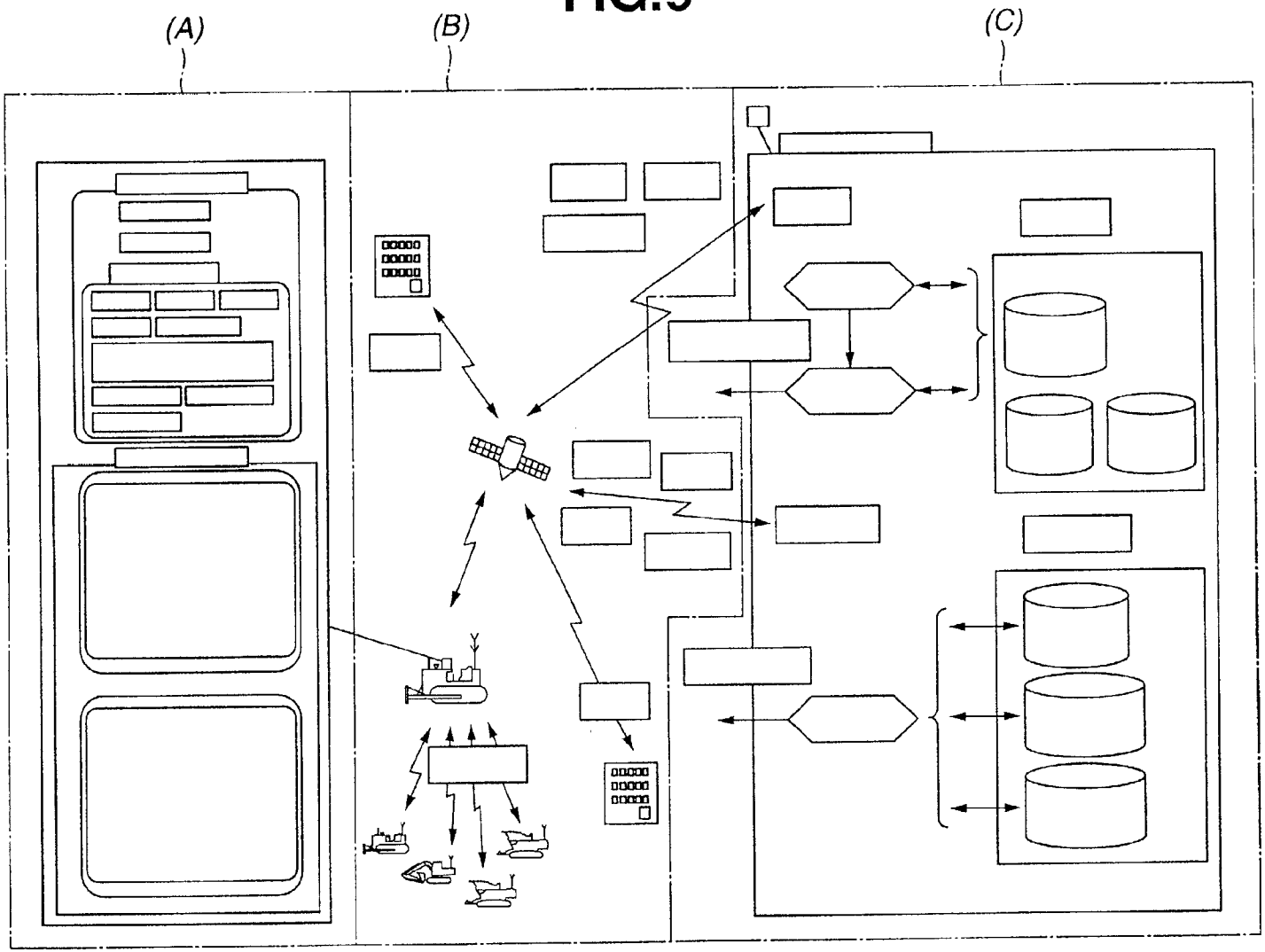
FIG. 9 is a diagram of processing procedures for when a construction machine theft or overturn accident has occurred.

Hence, as diagrammed in FIG. 9, on the display screen 301M of the monitor device 300 carried on board the leader work machine 31 are displayed the theft information 179, that is, a message that the follower machine 33 was stolen, the vehicle ID data 200*a* (P-33) of the stolen follower machine 33, the date and hour the machine was stolen, the construction site position data P for where the stolen follower machine 33 should be operating, and the current position of the stolen follower machine 33. The theft information 179 is emergency information, moreover, wherefore the display screen of the monitor device 300, irrespective of the content currently being displayed, will be forcibly switched to display the theft information 179. In that case, the display location 316 called "emergency screen display" indicated in FIG. 12 will flash, notifying the operator that this is an emergency screen.

The operator of the leader work machine 31 can promptly implement suitable measures himself or herself, such as contacting the proper people (such as the lease company 90*a* or the police station 92*a*), based on the theft information 179 displayed on the display screen 301M.

Also, the theft information 179 is transmitted from the server apparatus 11 directly to the terminal device 93*a* of the police station 92*a,* which constitutes the proper authorities, via a radio communication link 5, communication satellite 3, and radio communication link 5, and is stored in memory in the terminal device 93*a*. In that case, furthermore, the theft information 179 may be made a voice signal. Hence the police station 92*a* can promptly initiate an appropriate investigation based on the theft information 179.

Next, a case where the follower machine 33 in construction phase 1 has been involved in an overturn accident is supposed.

The vehicle condition data 200*b* consisting of the hydraulic pressure a, oil temperature b, water temperature c, stress d, engine r.p.m. e, lever control input signals f, hour meter time elapsed g, vehicle position h, and vehicle inclination angle k are detected by the sensor group provided in the follower machine 33. Also, operator ID data 200*c* specifying the operator on board are associated with the follower machine 33. The vehicle condition data 200*b* detected in the follower machine 33, together with the vehicle ID data 200*a* and the operator ID data 200*c*, are transmitted via a radio communication link 6 to the leader work machine 31. These data are transmitted from the terminal device 31*a* of the leader work machine 31 to the server apparatus 11 via a radio communication link 5, communication satellite 3, and radio communication link 5.

When the vehicle ID data 200*a* for the follower machine 33 are transmitted to the server apparatus 11, the type "P" and model "model 2" corresponding to the vehicle ID data 200*a* (P-33) are read out from the machine type and model specific machine number database 160. It is assumed that the association of the machine number "33" to the model "model 2" has been made in the machine type and model specific machine number database 160.

Next, standard condition data corresponding to the type "P" and model "model 2" are read out from the machine specific standard condition data database 151. Next, the vehicle condition data 200*b* for the follower machine 33 and the read out standard condition data are compared, and a judgment as to whether the vehicle condition is normal or anomalous is made in the same manner as was described with reference to FIG. 17(*a*).

When, as a result thereof, the condition is "anomalous," further processing is then performed to determine whether or not the anomalous phenomenon constituted by an "overturned condition" has occurred.

Specifically, anomalous phenomenon data corresponding to the type "P" and model "model 2" are read out from the machine specific anomalous phenomenon data database 152. Next, the read out anomalous phenomenon data are compared against the vehicle inclination angle k in the vehicle condition data 200*b* for the follower machine 33 to judge an "overturned condition." For example, in a case where "the vehicle inclination angle k continued to equal or exceed the threshold value for a prescribed time or longer," it will be judged that an "overturned condition" has been sustained, and overturn accident information 180 will be produced. The date and hour at which the judgment of that "overturned condition" was made will be recorded as the date and hour the accident occurred. The overturn accident information 180 comprises data indicating a message to the effect that an overturn accident has happened, vehicle ID data 200*a* for the construction machine involved in the overturn accident, the construction site position data P for where the construction machine involved in the overturn accident should be operating, data indicating the date and hour the overturn accident occurred, and the operator ID data 200*c* for the operator on board the construction machine involved in the overturn accident (step 803).

The overturn accident information 180 is transmitted from the server apparatus 11 to the terminal device 31*a* of the leader work machine 31 via a radio communication link 5, communication satellite 3, and radio communication link 5, and stored in memory in the terminal device 31*a*.

As diagrammed in FIG. 9, on the display screen 301N of the monitor device 300 carried on board the leader work machine 31 is displayed the overturn accident information 180, that is, a message that an overturn accident has occurred, the vehicle ID data 200*a* (P-33) for the follower machine 33 involved in the overturn accident, the date and hour the overturn accident occurred, the construction site position data P for where the follower machine 33 involved in the overturn accident should be operating, and the operator ID data 200*c* for the operator on board the follower machine 33 involved in the overturn accident. The overturn accident information 180 is emergency information, moreover, wherefore the display screen of the monitor device 300, irrespective of the content currently being displayed, will be forcibly switched to display the overturn accident information 180. In this case, the display location 316 called "emergency screen display" indicated in FIG. 12 will flash, notifying the operator that this is an emergency screen.

The operator of the leader work machine 31 can promptly implement suitable measures himself or herself, such as contacting the proper people (such as the lease company 90*a* or the fire fighting (emergency) station 92*b*), based on the overturn accident information 180 displayed on the display screen 301N.

Also, overturn accident information 180 is transmitted from the server apparatus 11 directly to the terminal device 93*b* of the fire fighting (emergency) station 92*b*, which constitutes the proper authorities, via a radio communication link 5, communication satellite 3, and radio communication link 5, and is stored in memory in the terminal device 93*b*. In this case, furthermore, the overturn accident information 180 may be made a voice signal. Hence the fire fighting (emergency) station 92*b* can promptly initiate suitable emergency measures based on the overturn accident information 180.

The follower machine 33 is described representatively in the foregoing, but theft information 179 and overturn accident information 180 are also produced automatically, in the same manner, for the other follower machines 31, 33, 34, and 35, and for the leader work machine 31, whereupon appropriate measures can be taken promptly.

Thus the operator of the leader work machine 31 can also fulfill the role of a general site manager in making notifications of thefts or overturn accidents. Theft information 179 and overturn accident information 180 are also produced automatically, in the same manner, in construction phase 2 and construction phase 3, whereupon appropriate measures can be taken promptly.

Based on this embodiment, as described in the foregoing, the operator of a leader work machine of a plurality of construction machines is able to fulfill the multiple roles of such managers as a service supervisor, general site foreman, general site manager, and office manager, without requiring other managers, wherefore work efficiency improves dramatically.

In this embodiment, furthermore, one construction machine out of a plurality of construction machines is made the leader work machine, but it is permissible to have two or more leader work machines.

With these embodiments, furthermore, application to construction machines that perform work at a construction site is presumed, but application may be made to any type of work machine so long as a plurality of those work machines are jointly performing work. The present invention can be applied in cases where, for example, a plurality of ordinary automobiles are jointly engaged in work.

What is claimed is:

1. A display device for construction machine, which is arranged in a construction machine and comprises:

a memory device that stores operator data, the operator data being suitable for operators of the construction machine and including a work process chart that sets forth scheduled works to be done and work performance results in a construction site;

a data retrieving device that retrieves the operator data stored in the memory device;

a data processing device that processes the operator data retrieved by the data retrieving device into simplified data, the simplified data being the operator data that is changed and made suitable for people in the neighborhood of the construction site; and a data display screen that is arranged to face toward an outside of the construction machine, the data display screen displaying the simplified data so that the simplified data is readable from the outside of the construction machine.

2. A display device for construction machine, which is arranged in a construction machine and comprises:

a measuring instrument for measuring noise levels;

a memory device that stores noise data on the noise levels in a construction site measured by the measuring instrument;

a data retrieving device that retrieves the noise data stored in the memory device;

a data processing device that processes the noise data into processed data, the processed data being the noise data that is changed and made suitable for people in the neighborhood of the construction site; and a data display screen that is arranged to face toward an outside of the construction machine, the data display screen displaying the process data that was processed from the noise data so that the processed data is readable from the outside of the construction machine.

3. A display device for construction machine, which is arranged in a construction machine and comprises:

a measuring instrument for measuring toxic substance concentrations in a construction site;

a memory device that stores toxicity data on the toxic substance concentrations in the construction site;

a data retrieving device that retrieves the toxicity data stored in the memory device;

a data processing device that processes the toxicity data retrieved by the data retrieving device into processed data, the processed data being the toxicity data that is changed and made suitable for people in the neighborhood of the construction site; and a data display screen that is arranged to face toward an outside of the construction machine, and the display device displaying the processed data that was processed from the toxicity data by the data processing device so that the processed data is readable from the outside of the construction machine.

4. A display system for construction machines adapted for a construction site where a plurality of construction machines are in operation, the plurality of construction machines being connected through a communication apparatus so as to enable transmission and reception of data among the construction machines, which includes:

one of the plurality of construction machine is designated as a leader machine, and remaining construction machines are designated as follower machines;

operator data is transmitted from the leader machine to the follower machines via the communication apparatus, the operator data being suitable for operators of the construction machine and including a work process chart that sets forth scheduled works to be done and work performance results in a construction site data; and at least one of the construction machines is provided with:

a data processing device that processes the operator data into simplified data, the simplified data being the operator data that is changed and made suitable for people in the neighborhood of the construction site; and a data display screen that is arranged to face toward an outside of said at least one of the construction machines, the data display screen displaying the simplified data so that the simplified data is readable from the outside of the construction machine.

5. A display system for construction machines adapted for a construction site where a plurality of construction machines are in operation, the plurality of construction machines being connected through a communication apparatus so as to enable transmission and reception of data among the constructions machines, which includes:

a measuring instrument for measuring noise levels in the construction site is provided on one or plural construction machines, and the measuring instrument on the one or plural construction machines measuring noise levels in the construction site;

one of the one or plural construction machines having measured noise levels transmitting the measured noise levels to other of the plurality of construction machines via the communication apparatus; and at least one of the plurality of construction machines is provided with:

a data processing device that processes the measured noise levels into processed data, the processed data being the measured noise levels that are changed and made suitable for people in the neighborhood of the construction site; and a data display screen that is arranged to face toward an outside of said at least one of the construction machines, the data display screen displaying the processed data that was processed from the measured noise levels so that the processed data is readable from the outside of said at least one of the construction machines.

6. A display system for construction machines adapted for a construction site where a plurality of construction machines are in operation, the plurality of construction machines being connected through a communication apparatus so as to enable transmission and reception of data among the constructions machines, including:

a measuring instrument for measuring toxic substance concentrations in the construction site is provided on one or plural construction machines, and the measuring instrument on the one or plural construction machines measuring toxic substance concentrations in the construction site;

one of the one or plural construction machines having measured toxic substance concentrations transmitting the measured toxic substance concentrations to other of the plurality of construction machines via the communication apparatus; and at least one of the plurality of construction machines is provided with:

a data processing device that processes the measured toxic substance concentrations into processed data, the processed data being the measured toxic substance concentrations that are changed and made suitable for people in the neighborhood of the construction site; and a data display screen that is arranged to face toward an outside of said at least one of the construction machines, the data display screen displaying the processed data that was processed the measured toxic substance concentrations into the processed data so that the processed data is readable from the outside of said at least one of the construction machines.

7. The display device for construction machine as set forth in claim 1, wherein:

an operator display device for use by an operator is provided in an operator room of the construction machine; and the operator display device displays the operator data which is retrieved from the memory device by the data retrieving device and which is not processed by the data processing device.

8. The display device for construction machine as set forth claim 4, wherein:

an operator display device for use by an operator is provided in an operator room of the construction machine; and the operator display device displays the operator data which is retrieved from the memory device by the data retrieving device and which is not processed by the data processing device.

* * * * *